US009857149B2

(12) United States Patent
Rubtsov et al.

(10) Patent No.: US 9,857,149 B2
(45) Date of Patent: Jan. 2, 2018

(54) LIGHT-BASED INCAPACITATING APPARATUS AND METHOD

(71) Applicants: Vladimir Rubtsov, Los Angeles, CA (US); Gennady Sigal, Oakville, CA (US)

(72) Inventors: Vladimir Rubtsov, Los Angeles, CA (US); Gennady Sigal, Oakville, CA (US)

(73) Assignee: Optech Ventures, LLC, Torrance, CA (US)

( * ) Notice: Subject to any disclaimer, the term of this patent is extended or adjusted under 35 U.S.C. 154(b) by 690 days.

(21) Appl. No.: 14/209,990

(22) Filed: Mar. 13, 2014

(65) Prior Publication Data

US 2016/0377391 A1 Dec. 29, 2016

Related U.S. Application Data

(60) Provisional application No. 61/783,566, filed on Mar. 14, 2013.

(51) Int. Cl.

| | |
|---|---|
| ***F41H 13/00*** | (2006.01) |
| ***F21L 4/02*** | (2006.01) |
| ***F21V 5/04*** | (2006.01) |
| ***F21V 7/06*** | (2006.01) |
| ***F21V 23/04*** | (2006.01) |
| ***H05B 33/08*** | (2006.01) |
| ***H05B 37/02*** | (2006.01) |
| *F21Y 113/10* | (2016.01) |
| *F21Y 115/10* | (2016.01) |

(52) U.S. Cl.

CPC ..... *F41H 13/0087* (2013.01); *F21L 4/027* (2013.01); *F21V 5/04* (2013.01); *F21V 7/06* (2013.01); *F21V 23/0407* (2013.01); *H05B 33/0842* (2013.01); *H05B 37/0281* (2013.01); *F21Y 2113/10* (2016.08); *F21Y 2115/10* (2016.08)

(58) Field of Classification Search

CPC ..... F21S 10/02; F21S 10/06; F21V 23/0407; F41H 13/0087; H05B 33/0818; H05B 33/0842; H05B 33/0857; F21Y 2101/00; F21Y 2101/02; Y10S 362/80

See application file for complete search history.

(56) References Cited

U.S. PATENT DOCUMENTS

2008/0013311 A1* 1/2008 Rubtsov ..... F41H 13/0087 362/231
2010/0188018 A1* 7/2010 Salm ..... F21V 7/00 315/294

* cited by examiner

*Primary Examiner* — Francis M Legasse, Jr.
(74) *Attorney, Agent, or Firm* — Lawrence S. Cohen

(57) ABSTRACT

Apparatus and method for using a light source having spatially separated light emitting areas emitting light at different wavelengths to incapacitate a subject by a pattern of temporal flashing and/or color flashing of the light source. Reflectors adapted for use with spatially separated light substrates provide for light concentration from lower powered optical sources.

31 Claims, 53 Drawing Sheets

LED SBM-160 with 60mm Combined Reflector.
Object Distance 3m. Four DIEs Operate.
Contours of Illuminance.

Pure Parabolic Reflector with Diameter 60mm.
Object Distance 3m. Four DIEs Operate.
Contours of Illuminance.

LED SBM-160 with 60mm Combined Reflector.
Object Distance 3m. Four DIEs Operate.
Cross-Section of of Illuminance at X = 0mm.

Pure Parabolic Reflector with Diameter 60mm.
Object Distance 3m. Four DIEs Operate.
Cross-Section of of Illuminance at X = 0mm.

LIGHT-BASED INCAPACITATING APPARATUS AND METHOD

CROSS-REFERENCE TO RELATED APPLICATIONS

This application is related to and claims the benefit of the U.S. Provisional Patent Application No. 61/783,566, titled "LED-Based Incapacitating Apparatus and Method," filed on Mar. 14, 2013; the entire contents of which is incorporated herein by reference.

STATEMENT REGARDING FEDERALLY SPONSORED RESEARCH OR DEVELOPMENT

The U.S. Government has certain rights in this invention pursuant to Contract No. NBCHC080093 by Department of Homeland Security.

BACKGROUND

1. Field

This disclosure relates to a method and apparatus for producing flashing electromagnetic energy for incapacitating a person or animal. More particularly, the present disclosure describes flashing visible light for individual or crowd control.

2. Description of Related Art

Security devices using visible light are known in the art. For example, U.S. Pat. No. 6,007,218 describes a laser based security device that uses visible laser light at predetermined wavelengths and intensities to create temporary visual impairment to cause hesitation, delay, distraction and reductions in combat and functional effectiveness. U.S. Pat. No. 6,190,022 describes a visual security device that uses sequentially flashing multiple LEDs.

As indicated above, flashing light incapacitating apparatus may employ lasers to achieve desired incapacitating effects. However, lasers are typically expensive and, when employed in incapacitating devices, may result in unacceptable levels of eye damage. Hence, the market has not found laser-based visual incapacitating devices to be acceptable for use, especially for civilian use.

LED-based incapacitating devices are also known in the art. However, such devices typically provide insufficient irradiation levels to produce desired incapacitating effects at weights that allow desirable levels of portability.

SUMMARY

As described in additional detail in the present disclosure, incapacitation of a human subject may be achieved by sequentially flashing a light at the subject. The sequence of the flashing, the colors used in the light flashes, and the duration, frequency, and duty factor of the flashes may all impact the incapacitation effects. These effects may also be increased by an increase in light level perceived by the subject. High brightness light emitting devices, such as light emitting diode substrates, may provide the desired light level. Additional techniques and mechanisms may also be used to concentrate and direct light from the light emitting devices to increase the perceived light level.

One embodiment of the present invention comprises a method for visual incapacitation, where the method comprises: providing four light emitting areas, where each light emitting area of the four light emitting areas outputs light at a different wavelength or color temperature from other light emitting areas of the four light emitting areas; concentrating light from the four light emitting areas to produce a light beam; controlling the light from the four light emitting areas to flash in a sequence of at least four separate intervals to cause the light beam to flash, wherein the at least four intervals comprise: a first interval, wherein the first interval comprises simultaneously flashing on and off all four light emitting areas at frequencies between 11 to 17 Hz with duty cycles from 35 to 50%; a second interval, wherein the second interval comprises simultaneously flashing on and off three light emitting areas of the four light emitting areas at frequencies between 11 to 17 Hz with duty cycles from 35 to 50% and wherein amplitudes of the three light emitting areas are controlled to obtain light of a first flashed color; a third interval, wherein the third interval comprises simultaneously flashing on and off three light emitting areas of the four light emitting areas at frequencies between 11 to 17 Hz with duty cycles from 35 to 50% and wherein amplitudes of the three light emitting areas are controlled to obtain light of a second flashed color, wherein the second flashed color is different from the first flashed color; and a fourth interval, wherein the fourth interval comprises simultaneously flashing on and off all four light emitting areas at frequencies between 11 to 17 Hz with duty cycles from 35 to 50%; and directing the flashing light beam towards the subject.

Another embodiment of the present invention is an apparatus for causing incapacitation, where the apparatus comprises: a handle and a head member, wherein the head member comprises: a light emitting device comprising four light emitting areas consisting of a red light emitting area, a green light emitting area, a blue light emitting area, and a white light emitting area, and; a light concentrating element configured to concentrate light from the four light emitting areas into a light beam; an electronics assembly configured to control the four light emitting areas to flash the light beam in a sequence of at least four separate intervals, wherein the at least four intervals comprise: a first interval, wherein the first interval comprises simultaneously flashing on and off all four light emitting areas at frequencies between 11 to 17 Hz with duty cycles from 35 to 50%; a second interval, wherein the second interval comprises simultaneously flashing on and off three light emitting areas of the four light emitting areas at frequencies between 11 to 17 Hz with duty cycles from 35 to 50% and wherein amplitudes of the three light emitting areas are controlled to obtain light of a first flashed color; a third interval, wherein the third interval comprises simultaneously flashing on and off three light emitting areas of the four light emitting areas at frequencies between 11 to 17 Hz with duty cycles from 35 to 50% and wherein amplitudes of the three light emitting areas are controlled to obtain light of a second flashed color, wherein the second flashed color is different from the first flashed color; and a fourth interval, wherein the fourth interval comprises simultaneously flashing on and off all four light emitting areas at frequencies between 11 to 17 Hz with duty cycles from 35 to 50%.

Another embodiment of the present invention is an apparatus for incapacitating a human subject, where the apparatus comprises: means for holding the apparatus in a human hand, wherein the means for holing comprises a power source; a housing coupled to the means for holding the apparatus, wherein the housing comprises: means for emitting light at multiple wavelengths, wherein the light at multiple wavelengths comprise white light, amber-orange colored light in a wavelength range of 580 nm and cyan colored light in a wavelength range of 485-505 nm, and means for controlling the emission of light from the means for emitting light; and means for concentrating light, wherein the means for concentrating light is disposed to receive light from the means for emitting light, and wherein the means for controlling the emission of light controls the means for emitting light to emit a flashed light beam in a sequence of at least four separate intervals, wherein the at least four intervals comprise: a first interval, wherein the first interval comprises simultaneously flashing on and off white light at frequencies between 11 to 17 Hz with duty cycles from 35 to 50%; a second interval, wherein the second interval comprises simultaneously flashing on and off amber-orange colored light at frequencies between 11 to 17 Hz with duty cycles from 35 to 50%; a third interval, wherein the third interval comprises simultaneously flashing on and off cyan colored light at frequencies between 11 to 17 Hz with duty cycles from 35 to 50%; and a fourth interval, wherein the fourth interval comprises simultaneously flashing on and off white light at frequencies between 11 to 17 Hz with duty cycles from 35 to 50%.

Another embodiment of the present invention is an apparatus for causing incapacitation, where the apparatus comprises: a handle configured for being held within a human hand; a head coupled to the handle, wherein the head comprises: a light emitting apparatus having at least two spatially separated light emitting areas, wherein each light emitting area emits light at a different wavelength; an electronics assembly for controlling the emission of light from the light emitting apparatus; a combined parabolic reflector disposed to receive light from the light emitting apparatus, wherein the combined parabolic reflector has at least two paraboloid conical sections and each paraboloid conical section has a curvature center aligned with a diagonal through a center of a corresponding light emitting area, whereby the light emitting areas are enabled on and off either together or separately by the electronics assembly.

Another embodiment of the present invention is a method for visual incapacitation of a subject, where the method comprises: providing at least two light emitting areas, wherein at least one of the light emitting areas emits colored light; flashing the light emitting areas in a pattern; concentrating the light emitted from the light emitting areas into one or more light beams with a combined parabolic reflector, wherein the combined parabolic reflector has at least two paraboloid conical sections and each paraboloid conical section has a curvature center aligned with a diagonal through a center of a corresponding light emitting area; directing the one or more light beams towards the subject.

Another embodiment of the present invention is an apparatus for incapacitating a human subject, where the apparatus comprises: means for holding the apparatus in a human hand; a housing coupled to the means for holding the apparatus, wherein the housing comprises: means for emitting light at multiple wavelengths, wherein the means for emitting light at multiple wavelengths comprises at least two spatially separated light emitting areas and wherein the at least two spatially separated light emitting areas emit light at different wavelengths, and means for controlling the emission of light from the means for emitting light; and a combined parabolic reflector disposed to receive light from the means for emitting light at multiple wavelengths, wherein the combined parabolic reflector has at least two paraboloid conical sections and each paraboloid conical section has a curvature center aligned with a diagonal through a center of a corresponding light emitting area, wherein the means for controlling the emission of light controls the means for emitting light to emit a flashed light beam.

DETAILED DESCRIPTION

Figure 1:
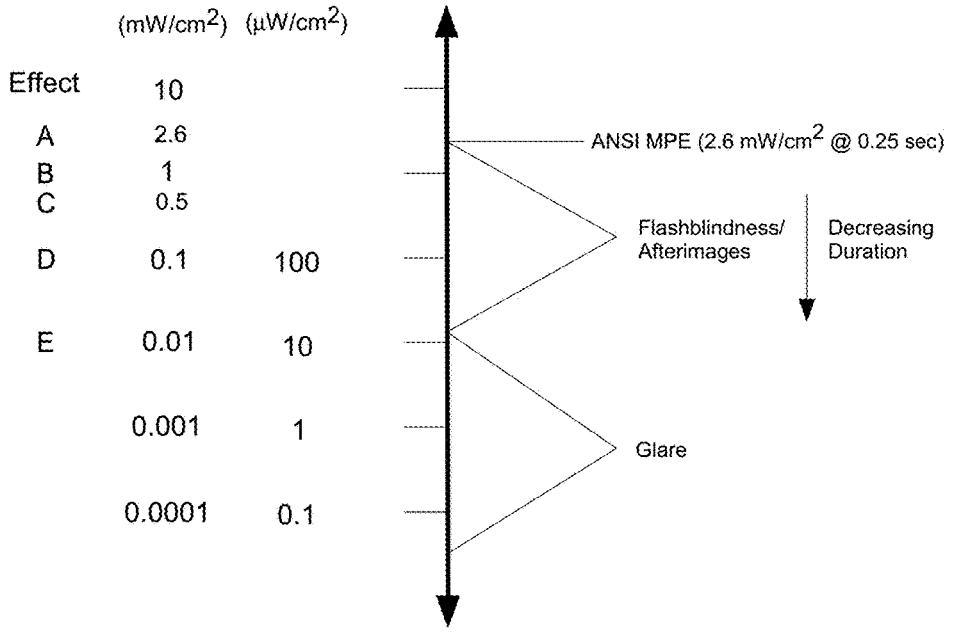
FIG. 1 shows the different levels of physiological effects that are produced from visual impairment induced by various levels of irradiance.

Embodiments according to the present disclosure are based upon the impact on human beings when their eyes are exposed to bright, flashing light. There are three types of non-damaging effects that impact human vision when the eyes are exposed to a bright light: (1) glare, (2) flashblindness, and (3) bio-physiological effects. Which effect will occur depends on the wavelength of the light (measured in nanometers), the energy of the light beam at the pupil of the eye (measured in watts/square centimeter), whether the light source is pulsed or continuous-wave, exposure time and how many colors of light are flashing.

The glare effect is a reduced visibility condition caused by contraction of the pupil induced by a bright source of light in a person's field of view. It is a temporary effect that disappears as soon as the light source is extinguished, turned off, or directed away from the subject. Flashblindness is a reduced visibility condition that continues after a bright source of light is switched off. It appears as a spot or afterimage in an individual's vision that interferes with the ability to see in any direction. The nature of this impairment makes it difficult for a person to discern objects, especially small, low-contrast objects, or objects at a distance. The duration of the visual impairment can range from a few seconds to several minutes. The major difference between flashblindness and glare is that flashblindness persists after the light source is extinguished, whereas the glare effect does not.

The psychophysical effects of exposure to pulsed light sources are less investigated. In general, these effects are composed of a number of subjective responses ranging from distraction, to disruption, to disorientation, and to even incapacitation. This type of effect is directly related to the brain activity, and in particular to brain waves. Brain waves, periodic electrical signals that mirror shifting patterns of mental activity, tend to fall into four categories: beta, alpha, theta, and delta.

Brainwave activity tends to mirror flickering light, particularly in the alpha and theta frequencies; this effect is known as the "frequency-following effect." These findings have been used by psychologists for the therapeutic treatment of psychologically unstable patients. A number of studies, however, have indicated that many subjects find flashing lights to be very uncomfortable. Instead of treating disturbed patients, these machines cause harm, especially when the light is relatively bright.

This has led to the use of the frequency-following effect to provide a destructive effect, in nonlethal weapons. Various "less than lethal" weapons based on the frequency-following effect in military investigations have been investigated; in the majority of cases, the results of these studies are classified. Unclassified sources also report that high intensity strobe lights, which flash at or near human brain wave frequencies, cause vertigo, disorientation, and vomiting. Some devices that use stroboscopic flashing have been employed against demonstrators. In the 5-15 hertz range, these devices can cause various physical symptoms, and, in a small portion of the population, may trigger epileptic seizures.

[Flash durations, colors, and the effects of rapidly changing frequencies within the alpha-theta band have been, and are still being, investigated for their effects on brain activity. The general rule of light-brain interaction from the frequency-following effect is that all three factors play an important role in modulating brain rhythms. As these factors become more variable and more random, they introduce more modulation, and thus more confusion in the brain rhythms.

Since the early 1970s, programs related to optical nonlethal weapons have been started and stopped several times. On some occasions, safety measures were ignored, and lasers (which were used as light sources in virtually all cases) caused permanent damage to an individual's eye. Embodiments according to the present disclosure will generally use the guidance of the safety standards developed by the Laser Institute of America, ANSI 2136.1-2000, Safe Use of Lasers and Bright Light Sources. The Laser Institute safety standards provide a number of rules that should be followed for the safe use of lasers and extended sources of bright light. Embodiments according to the present disclosure should be non-damaging to the human eye, therefore, the intensity present at a subject's eye should be below the threshold for permanent damage. The definitive safety parameter, as defined in ANSI Z136.1-2000, is the Maximum Permissible Exposure (MPE). ANSI Z136.1-2000 presents an MPE diagram that shows the relationship between intensity and exposure, and the Eye-Damage Threshold.

The Eye Damage Threshold defines the upper boundary of the regime for eye-safe operation (typically measured in W/cm$^2$) and ranges from 0.0583 W/cm$^2$ for extremely short exposures to less than 0.0001 W/cm$^2$ for extended exposures. The lower boundary of 0.0001 W/cm$^2$ is also considered to be the lower limit of intensity for any useful degree of glare and flashblindness. For pulses shorter than 0.01 seconds, the eye typically does not respond sufficiently for any useful effects to occur. The MPE diagram provides parameters for a single exposure, but some embodiments according to the present disclosure rely upon a train of pulses to obtain an effective bio-physiological effect. Calculations for MPE for a train of pulses are discussed below.

Different levels of irradiance at the eye will have different levels of incapacitating effects. R. J. Rockwell, et al. in "Safety Recommendations of Laser Pointers," Laser-Resources, http://www.laser-resources.net/pointer-safety.htm (Apr. 15, 2003), show a chart that classifies visual impairment effects according to different intensities of light for exposure of 0.25 sec (the time equal to the aversion response or blink effect). FIG. 1 summarizes this data. FIG. 1 shows effects ranging from very strong flashblindness (which includes vertigo, disorientation, and startle) to simple glare (see right column of FIG. 1) versus irradiance level on the eye (left column of FIG. 1). The strongest effects appear when the irradiance is at the MPE level, which is 2.6 mW/cm$^2$, or above. The arrow on the right side of FIG. 1 pointing down indicates a decrease of the effectiveness, as the exposure time diminishes.

Table 1 below summarizes the various levels of impairment produced by various levels of irradiance as shown in FIG. 1. These levels (levels A-E) provide guidance as to the effects expected to be produced by some embodiments according to the present disclosure equivalent to the effects produced by a single exposure for 0.25 seconds.

TABLE 1

| Effects Produced | Equivalent to Irradiance Levels Shown in FIG. 1 | Required Power (% of MPE level) |
|---|---|---|
| A. Very strong: severe flashblindness with after images, startle, disorientation, vertigo, occasional vomiting. | 2.6 mW/cm$^2$, MPE for a single exposure | 100% |
| B. Strong: strong flashblindness with afterimages, startle, disorientation, vertigo | 1 mW/cm$^2$ | 38.4% |
| C. Moderate to strong: strong flashblindness with afterimages, disorientation, startle | 0.5 mW/cm$^2$ | 19.23% |
| D. Moderate: flashblindness with afterimages, disorientation, occasional startle | 0.1 mW/cm$^2$ | 3.84% |
| E. Weak: strong glare, flashblindness, occasional afterimages | 0.01 mW/cm$^2$ | 0.384% |

The table above summarizes the effects caused by a single exposure to continuous light, but some embodiments according to the present disclosure provide trains of light pulses. Hence, MPE calculations for a train of pulses should be performed. The light sources used in some embodiments according to the present disclosure may be considered to be extended sources of radiation. An extended radiation source is defined as a source viewed by the observer at an angle larger than $\alpha_{min}$, which is 1.5 mrad. The formula for calculating $MPE_{pulses}$ in terms of source energy level for extended light sources is given in ANSI Z136.1-2000:

$$MPE_{pulses} = 1.8 \times C_E \times n^{-0.25} \times \tau^{0.75} \frac{\text{mJ}}{\text{cm}^2}, \quad \text{Eq. 1}$$

where $\tau$ is the pulse duration or exposure time, n is the number of pulses in the train, $C_E = \alpha/\alpha_{min}$ when $\alpha_{min} \leq \alpha \leq \alpha_{max}$, and where $\alpha_{max}$ is 100 mrad ($\alpha$ is the angle at which the aperture of the device is observed from the target plane).

In terms of irradiance, for average pulse power, MPE:

$$E_{pulses} = MPE_{pulse} \frac{F}{d},$$

where F is the frequency, and d is the pulse duty cycle. Since only part of the energy reaches the human retina through the iris (approximately 7 mm in diameter), the $MPE_{pulses}$ must be reduced by a factor of 0.775. The final formula is:

$$MPE\text{: } E_{pulses} = \frac{1.8 \times \tau^{0.75} \times C_E \times n^{-0.25} \times F}{0.775 \times d} \frac{\text{mW}}{\text{cm}^2}. \quad \text{Eq. 2}$$

At the frequencies of 7-15 Hz, a single exposure duration of 0.25 sec is not achievable, therefore, a number of pulses should be applied to accomplish an incapacitating effect. As shown in Eq. 2, the MPE, and hence the strongest effect, could be provided at any level of irradiance by applying the respective number of pulses, while maintaining the equivalence of the other parameters. There would be more pulses at lower irradiance and vice versa. In turn, the number of pulses will define the incapacitating time. To estimate this time, the formula is rewritten as:

$$n = \left(\frac{1.8 \times \tau^{0.75} \times C_E \times F}{0.775 \times d} \times \frac{1}{MPE:\ E_{pulses}}\right)^4, \quad \text{Eq. 3}$$

and the irradiance emitted by the device considered to be the MPE. The number of pulses derived from Eq. 3 gives the estimated time necessary to produce the highest level of the incapacitating effect at a given irradiance, frequency, pulse duration, device aperture size, and distance to the target.

The visual impairment that is produced by intense flashing light has a cumulative effect; therefore, the dosage of radiation received depends on the number of pulses delivered. As fewer pulses are delivered, the MPE would be higher (see Eq. (1)). The number of pulses necessary to produce a visual impairment effect at a level of irradiance lower than MPE can be estimated by using the equation:

$$n_I = \frac{n_{MPE}}{A}, \quad \text{Eq. 4}$$

where $$A = \frac{I_{MPE}}{I}$$

($I_{MPE}$ is the irradiation produced by a device (which is considered the MPE), and I is the level of irradiance under consideration).

By substituting Eq. 1 for Eq. 4, the final Eq. 3 is rewritten as:

$$n = \left(\frac{1.8 \times \tau^{0.75} \times C_E \times F}{0.775 \times d} \times \frac{1}{A \times MPE:\ E_{pulses}}\right)^4 \quad \text{Eq. 5}$$

Eq. 5 may then be used to calculate the time durations necessary to produce visual impairments effects at levels equivalent to the single irradiance levels of 2.6, 1, 0.5, 0.1 and 0.01 mW/cm$^2$ for a given frequency of pulses. The values of A are 1, 2.6, 5.2, 26 and 260, respectively. These values were selected to provide the degrees of incapacitation (A, B, C, D, and E) shown in Table 1.

The spectral sensitivity of the human eye to visible light is well documented in numerous references. The human eye has a maximum sensitivity to green light at 532 nm in daytime conditions, and to cyan (blue-green) color at nighttime. In contrast, the sensitivity to red light (620-630 nm) is a few times less during daytime, and is extremely low at nighttime. Hence, one embodiment according to the present disclosure flashes with at least two colors: green and cyan. This combination of colors provides for effectiveness during both daytime and nighttime conditions.

The strictly physiological effects of color are known in the art. Blue stimulates the anterior hypothalamus, which harbors the main regulating part of the parasympathetic nervous system. This means that all colors in the bluish spectrum—from blue/green through blue to violet—normally have a sedating, digestion-activating, sleep-inducing effect. Red simulates the posterior hypothalamus and therefore the sympathetic nervous system. Red provokes anger. All colors in the red spectrum—from magenta through red/orange to yellow—have a stimulating, sometimes even provocative, character. Green mediates between both systems.

A side-branch of the optic nerve tract reaches the amygdala directly, bypassing the hypothalamus. The two corpora amygdaloidea comprise the color sensitive area of the limbic system, and are highly responsive to the color to which the eyes are exposed. One study demonstrated that each monochromatic color frequency excites specific neurons. If adjacent, but dissimilar color-wavelengths are used, the same neuron stays unexcited. Each frequency in the color spectrum therefore has its own specific neurological and psychological effect. A neurosurgeon, Norman Shealy, M.D., Ph.D. conducted a study investigating biochemical changes in the brain after beaming different colors into the eye. Remarkable changes were evident in the concentration of the following neurotransmitters in the cerebro-spinal fluid: norepinephrine (having an identical structure to epinephrine, increasing heart rate, as well as blood pressure), serotonin (mood regulator, lack of norepinephrine causes depression), beta-endorphin (pain killer), cholinesterase (cholinesterase inhibition is associated with a variety of acute symptoms such as nausea, vomiting, blurred vision, stomach cramps, rapid heart rate), melatonin, oxytocin, growth-hormone, LH, prolactin, and progesterone. (These results explain why emitting different colors into the eye can have a profound effect on the hormonal system, the emotions, stress levels, sleep, brain function, and many other aspects of the person's biochemistry and well-being.) Hence, some embodiments according to the present disclosure take advantage of both the exposure of a person to bright flashing lights and to light of selected colors.

Figure 2:
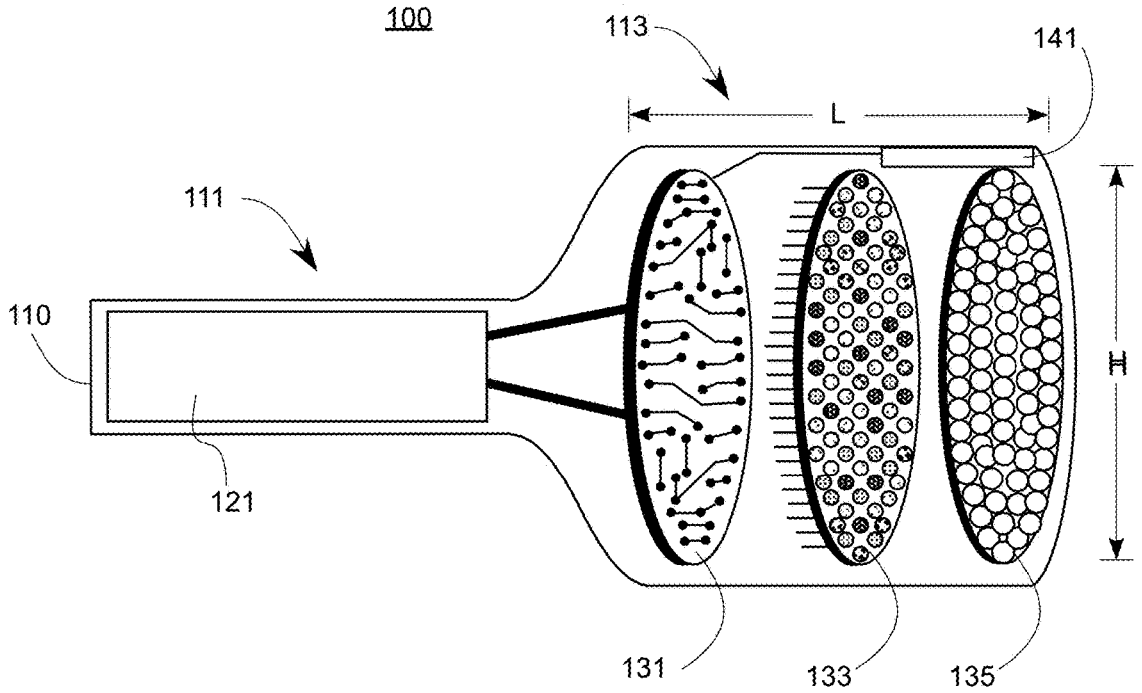
FIG. 2 is a schematic view of an exemplary embodiment according to the present disclosure.

FIG. 2 illustrates an apparatus 100 in accordance with one embodiment of the present disclosure. The apparatus 100 has a case 110, which contains the operating components of the apparatus 100. The operating components comprise a power supply 121, an electronics control module 131, a LED array 133, and a beam former 135. The operating components may also include a range finding device 141.

FIG. 2 shows the case 110 having the general shape of a typical flashlight, having a handle portion 111 and a head portion 113. The handle portion is preferably sized to contain the power supply 121. The head portion 113 is preferably sized with a length L and a diameter D to contain the electronics control module 131, the LED array 133, and the beam former 135. Other embodiments according to the present disclosure may place at least some of the components in other areas of the case or may have altogether different case shapes.

The power supply 121 preferably comprises a rechargeable battery or rechargeable battery pack. One type of rechargeable battery which may be used in embodiments according to the present disclosure is a high power lithium battery, such as Model TLM-1550HP from Tadiran Batteries assembled in a battery pack. This type of battery has the ability to handle pulses of up to 15 A with a 5 A maximum continuous load at 4.0V. The power supply 121 may also comprise a receptacle for connection to an external power source. The power supply 121 may also additionally comprise power conditioning electronics or circuitry for provision of proper power forms to the electronics control module 131.

The electronics control module 131 receives power from the power supply 121 and controls the emission of light from the LEDs on the LED array 133. As is described in additional detail below, the electronics control module 131 controls the flashing of the LEDs on the LED array 133 to achieve desired flash patterns. FIG. 2 depicts the electronics control module 131 as being circuitry disposed on a single circular shaped substrate, but other embodiments may use multiple substrates, electronic circuit modules, or other means or apparatus known in the art for providing and/or containing electronic circuitry.

Figure 3:
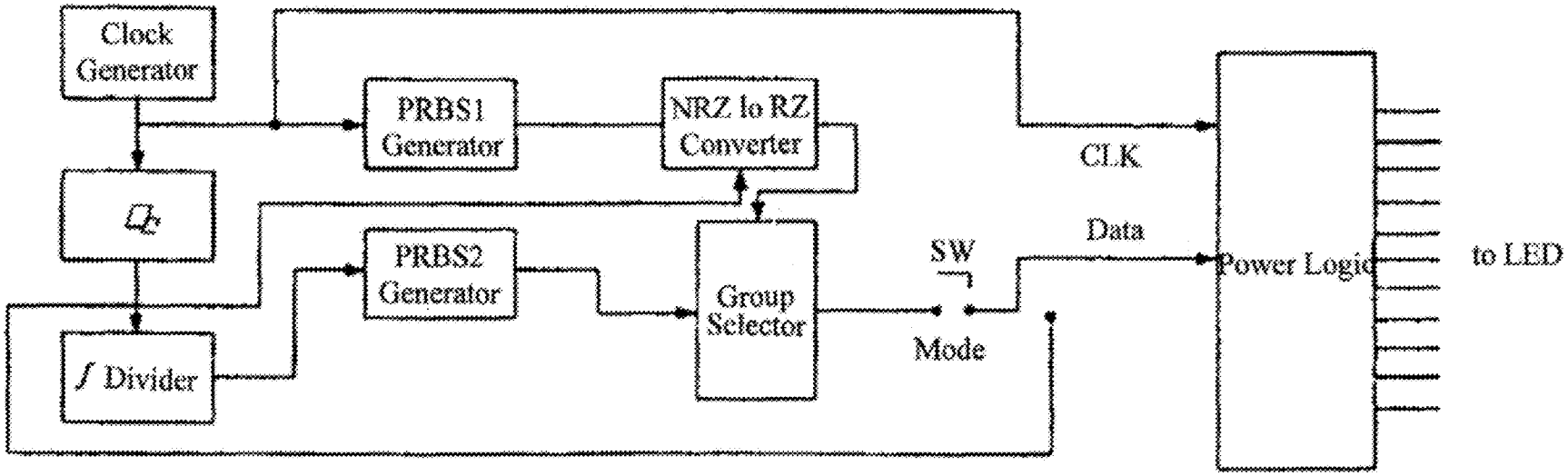
FIG. 3 shows a block diagram of a system to provide pseudorandom flashing of LEDs.
Figure 4A:
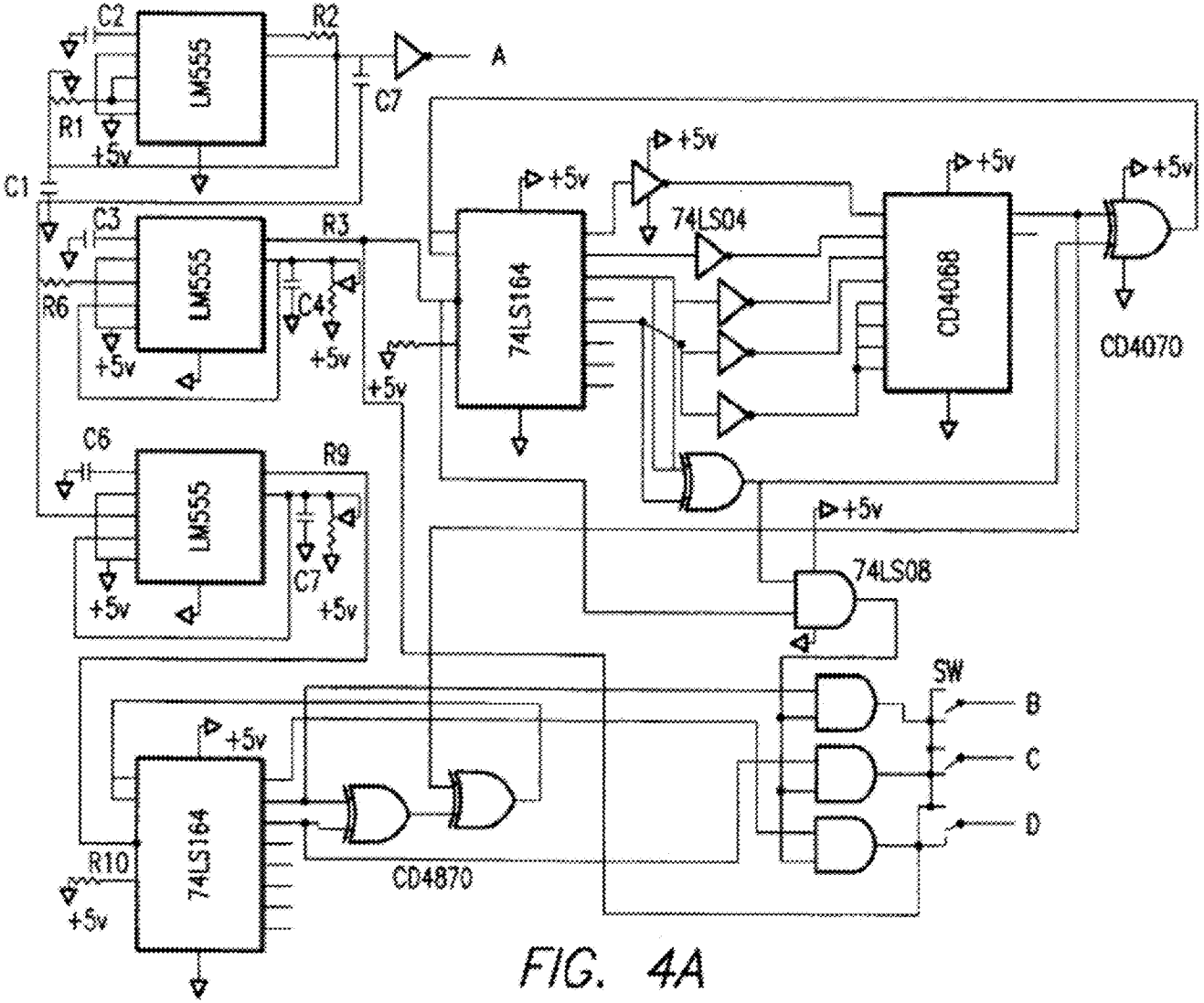
FIGS. 4A and 4B shows a circuit schematic for a pseudorandom flashing control circuit.
Figure 4B:
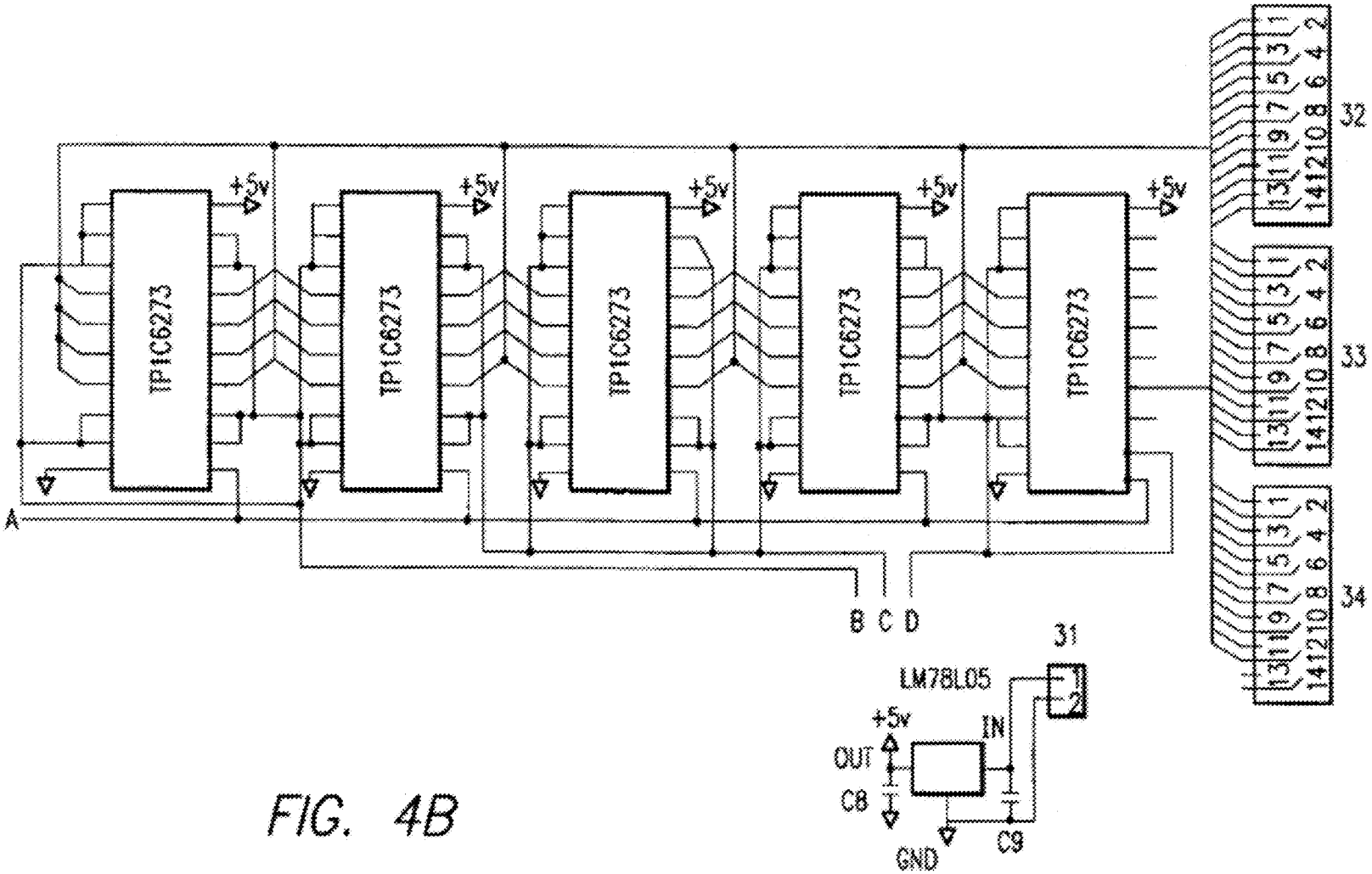

The electronics control module 131 provides the ability to flash some or all of the LEDs on the LED array 133 in a periodic and/or nonperiodic manner. The periodic manner comprises pulsing the LEDS on and off at a selected frequency, where the on duration of the LEDs is preferably less than the off duration. The selected frequency is preferably between 5 Hz and 15 Hz. The nonperiodic manner comprises pulsing the LEDs on and off, where the on durations are preferably the same, while the off durations vary randomly or pseudo randomly. In this nonperiodic flashing, the time from the start from one light pulse to the start of the next light pulse preferably varies between 0.666 seconds and 0.2 seconds. FIG. 3 shows a block diagram for a system to provide pseudorandom flashing of the LEDs and FIGS. 4A and 4B show a circuit schematic for pseudorandom flashing control.

The LED array 133 can be an array of discrete LEDs or it can be one or more LED clusters. For example, one embodiment may employ high power discrete LEDs, such as the Luxeon V emitters from Lumileds, which are disposed on a surface and coupled to the electronics control module 131. The discrete LEDs preferably comprise LEDs of different colors. The Luxeon V emitter can provide a luminance flux of 160 lm, which helps obtain the high radiance that may be in embodiments according to the present disclosure.

As indicated, the LED array 133 may comprise one or more LED clusters, such as those LED clusters available from Norlux Corp. Such LED clusters typically comprise a number of light emitting dies incorporated on a metal substrate in a honeycomb arrangement. Dies emitting different colors can be fabricated on one substrate plate. The number of dies, the dimensions of the dies, and the separation between the dies define the luminance flux (or radiant power) of the cluster. Norlux has provided LED clusters with green and red dies, where the green cluster has provided a luminous flux up to 850 lm (1.9 W of radiant power) in a continuous wave mode and the red cluster has provided a luminous flux up to 600 lm (4 W of radiant power) in the continuous wave mode. Higher radiant powers are to be expected when the LED clusters are operated in a pulsed mode.

The beam former 135 is an optical element that functions to form a desired beam or beams from the light emitted by the LED array 133. LEDs typically emit light with a high divergence angle, so the beam former preferably functions to form a light beam with a smaller divergence angle. If individual LEDs are used in the LED array 133, individual collimating LED lenses may be used with each LED. Collimating, nonimaging, single LED lenses with divergence angles of 12°, 8°, and 4° are known in the art. The use of such lenses helps increase the irradiance produced by the apparatus 100. However, as the divergence angle decreases with such a lens, the overall diameter of the lens increases. This then increases the overall diameter of the apparatus or reduces the number of individual LEDs that may be used.

Figure 5:
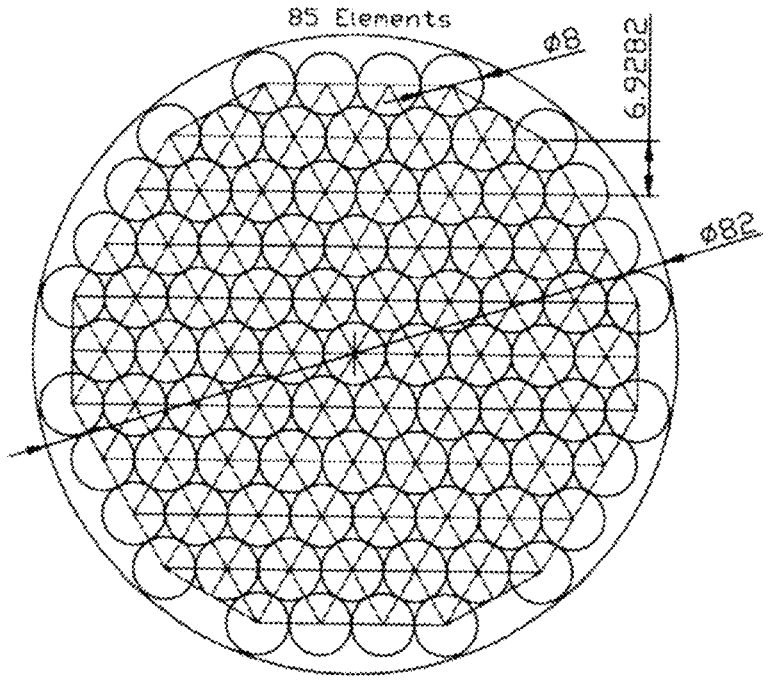
FIG. 5 illustrates the geometry of an exemplary LED cluster.
Figure 6:
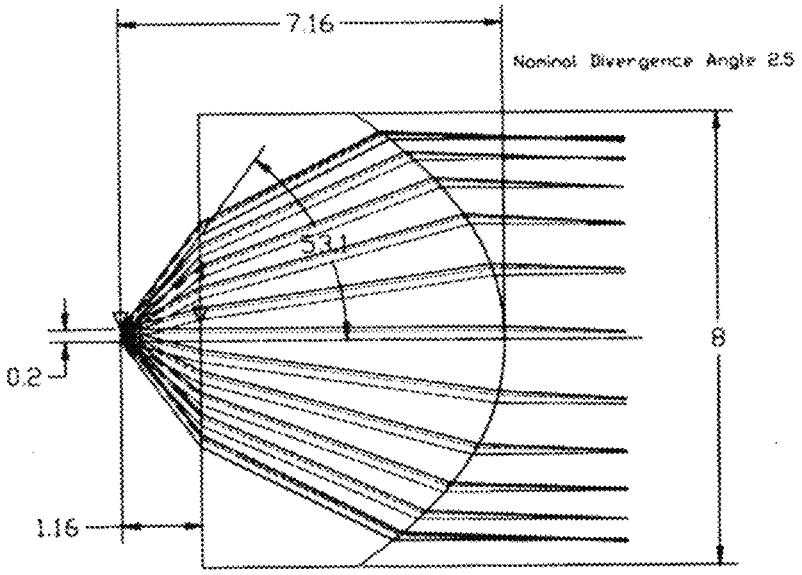
FIG. 6 illustrates the basic lens for a single lens microstructure.
Figure 7A:
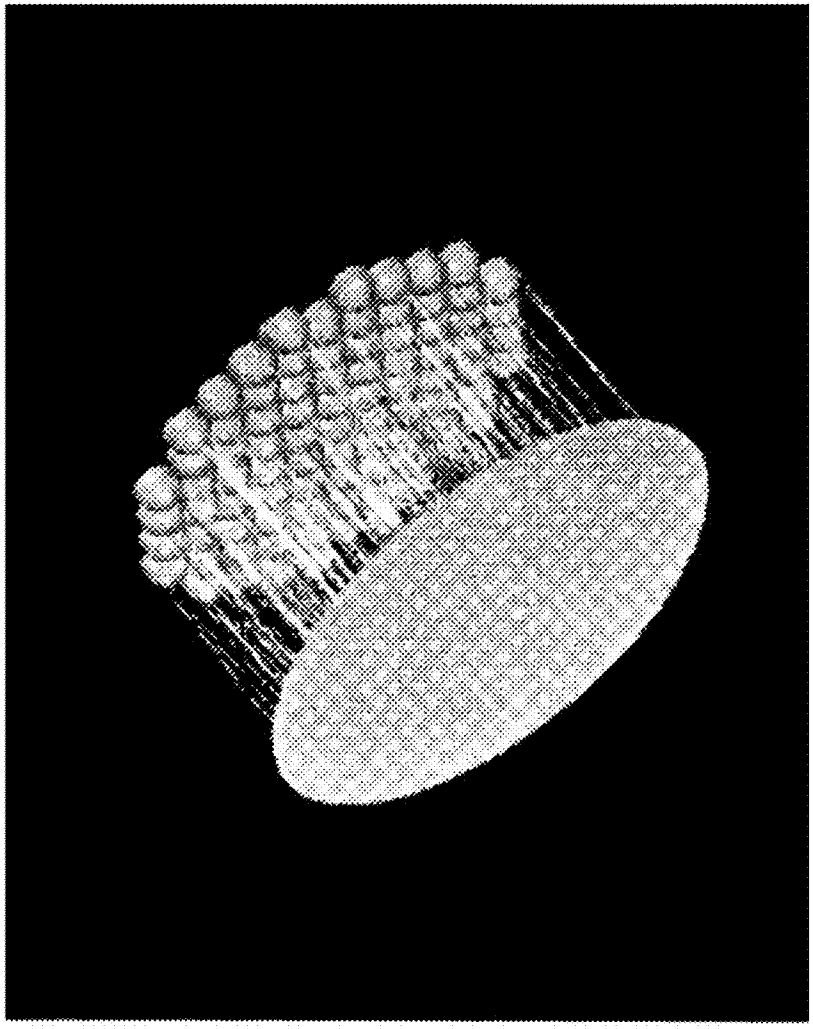
FIG. 7A shows a three-dimensional view of the lens microstructure shown in FIG. 6.

If the LED array 133 comprises one or more LED clusters, the use of microstructured lens may provide the beam former 135 for light emitted from the dies of the LED clusters. FIG. 5 illustrates a geometry for arranging the dies on a substrate. A single lens microstructure may provide the beam former 135 for some embodiments according to the present disclosure. FIG. 6 illustrates the basic lens for a single lens microstructure (where a lens is disposed at each die location on the LED cluster). FIG. 7A illustrates a three dimensional view of the entire microstructured beam former using the lens depicted in FIG. 6.

Figure 7B:
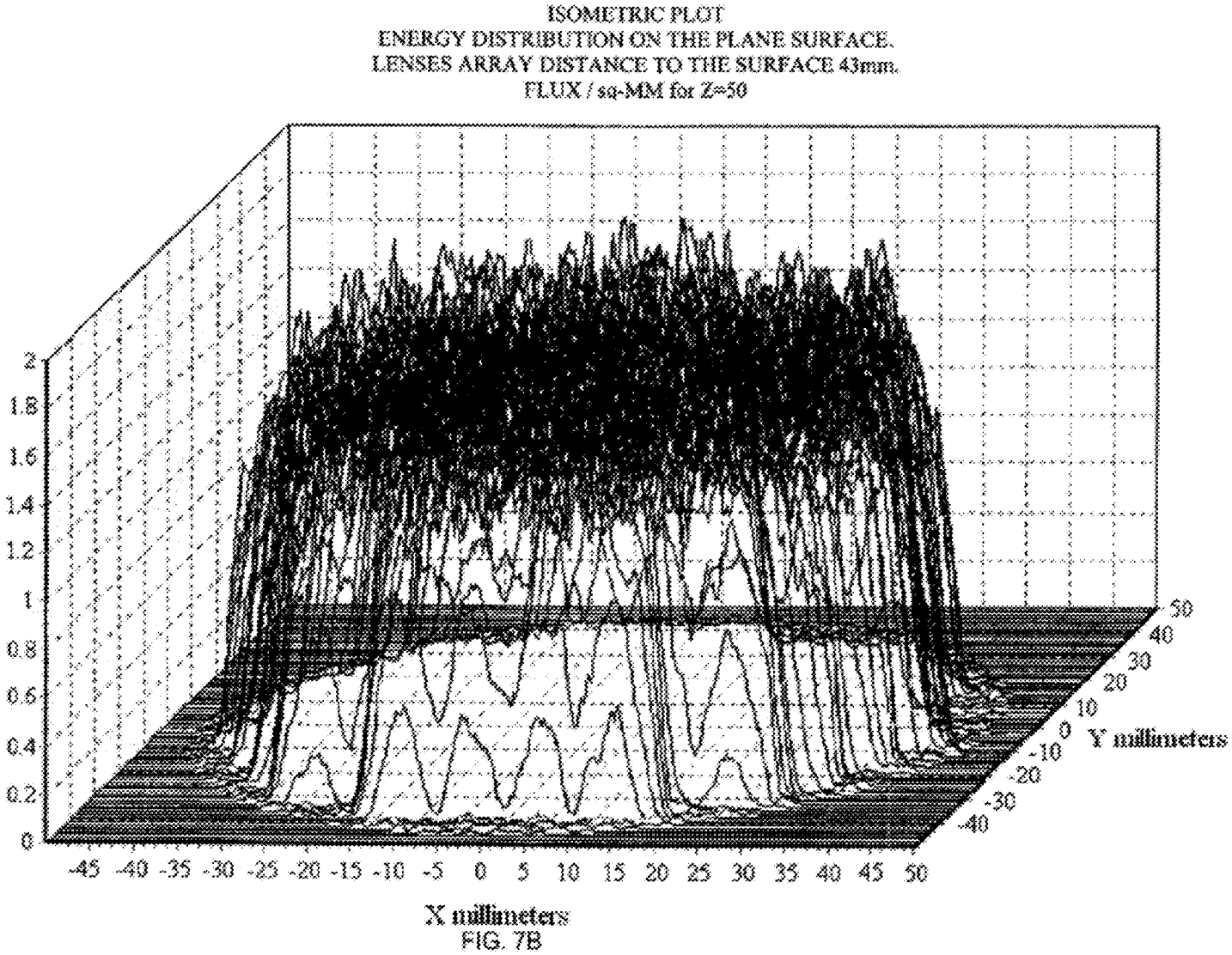
FIGS. 7B-7D show the results for calculations based on the lens microstructure depicted in FIG. 6.
Figure 7C:
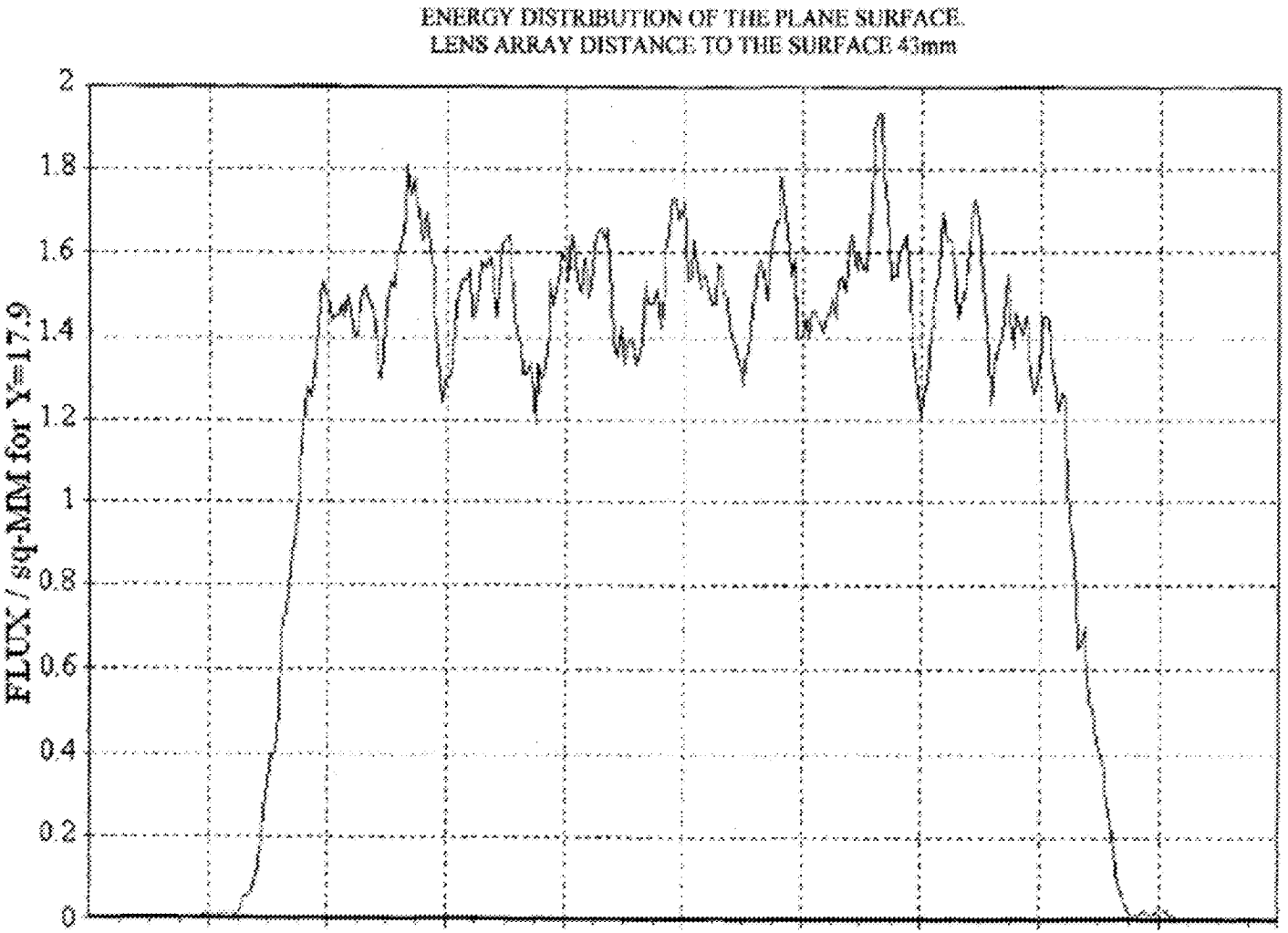
Figure 7D:
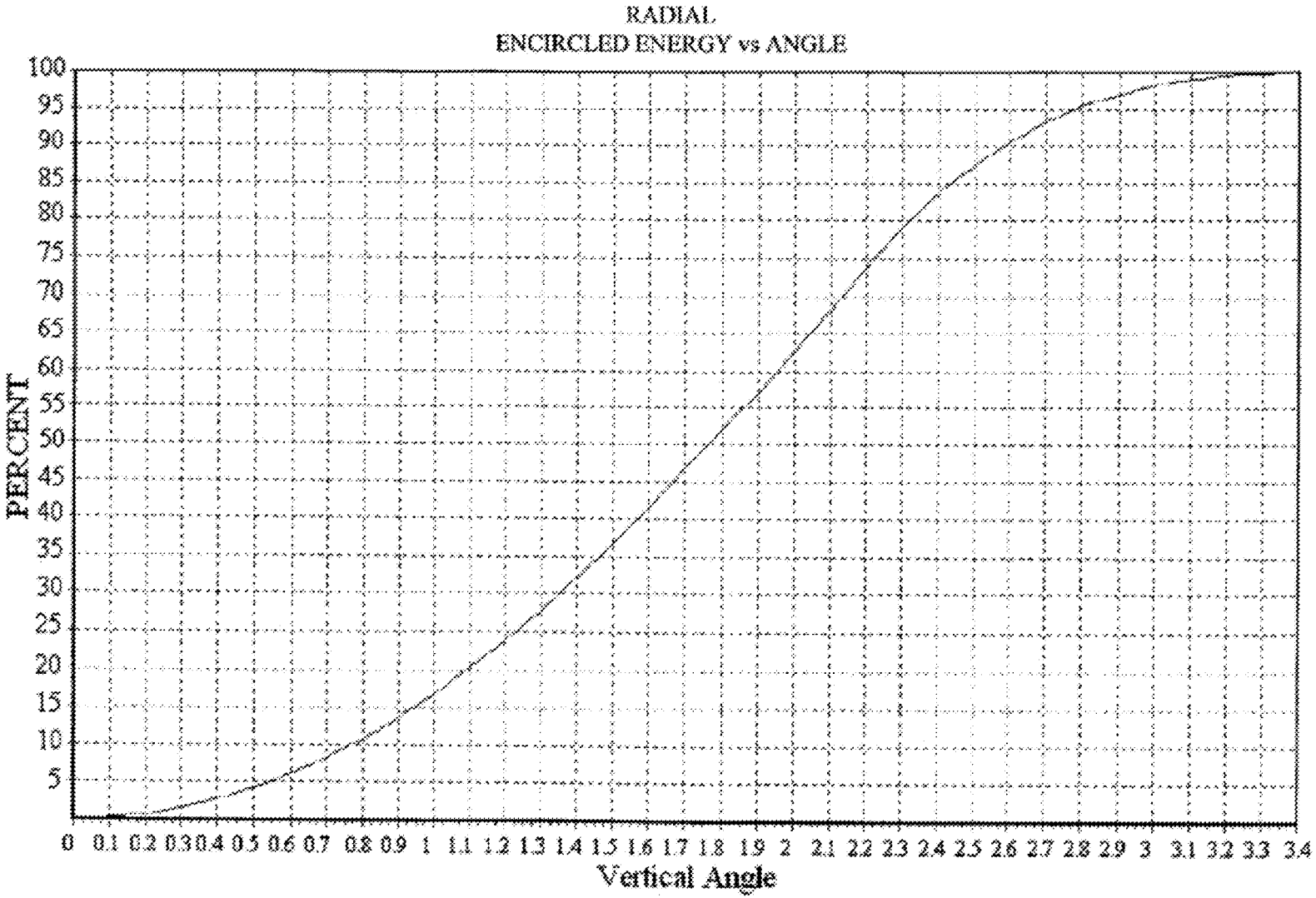
Figure 8A:
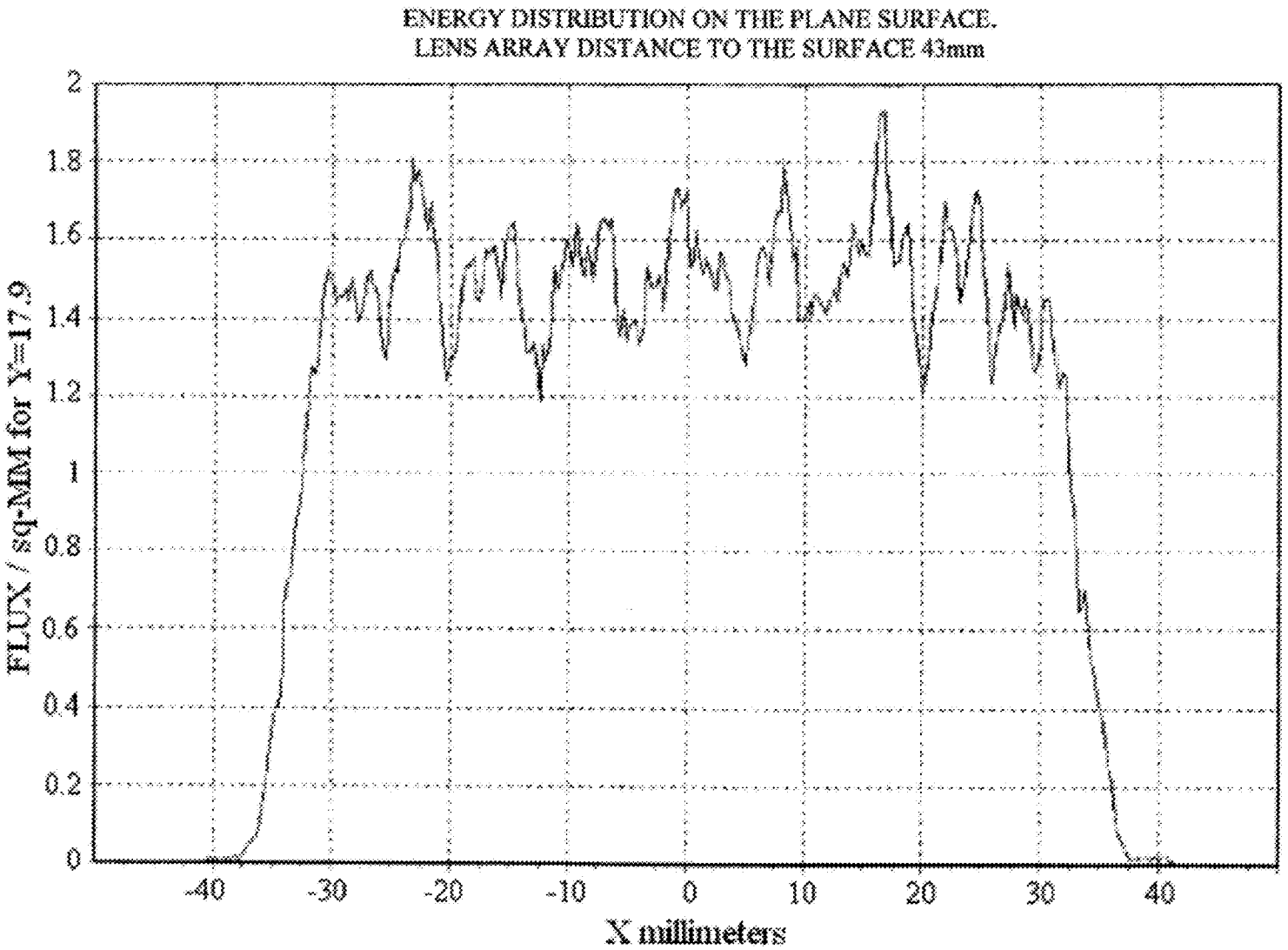
FIGS. 8A-8D show the energy distribution along an illuminated area at different distances from the lens microstructure shown in FIG. 6
Figure 8B:
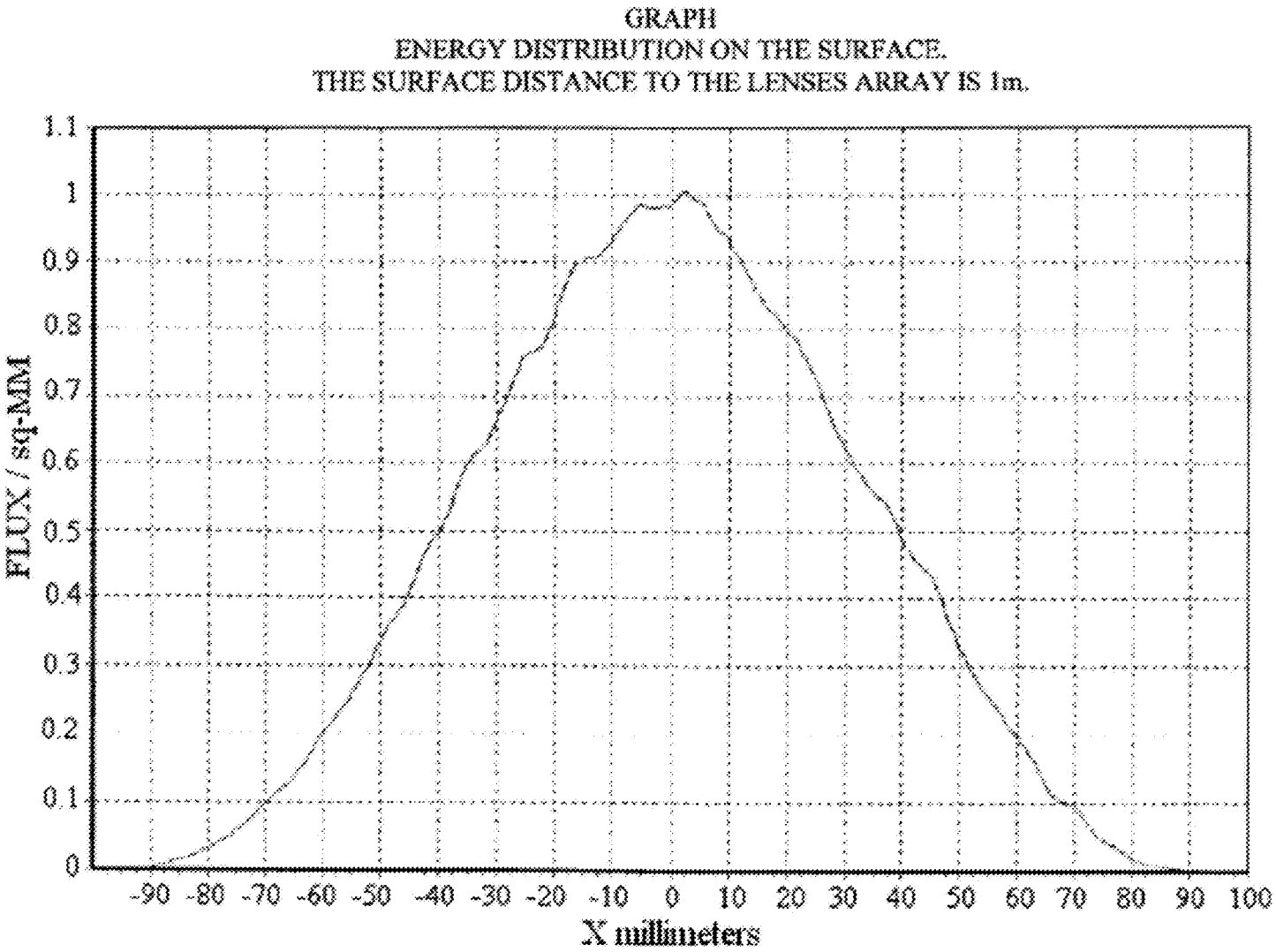
Figure 8C:
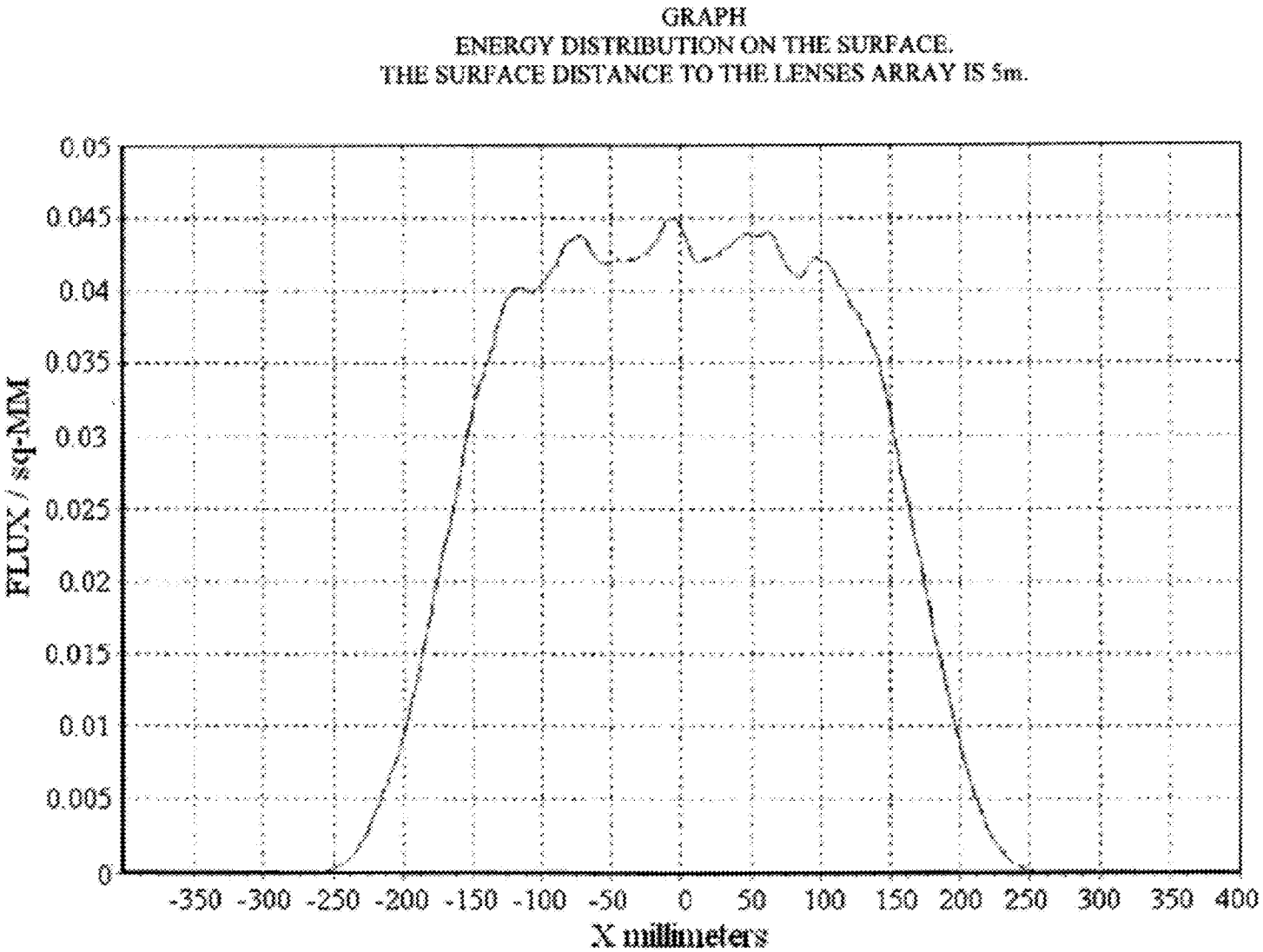
Figure 8D:
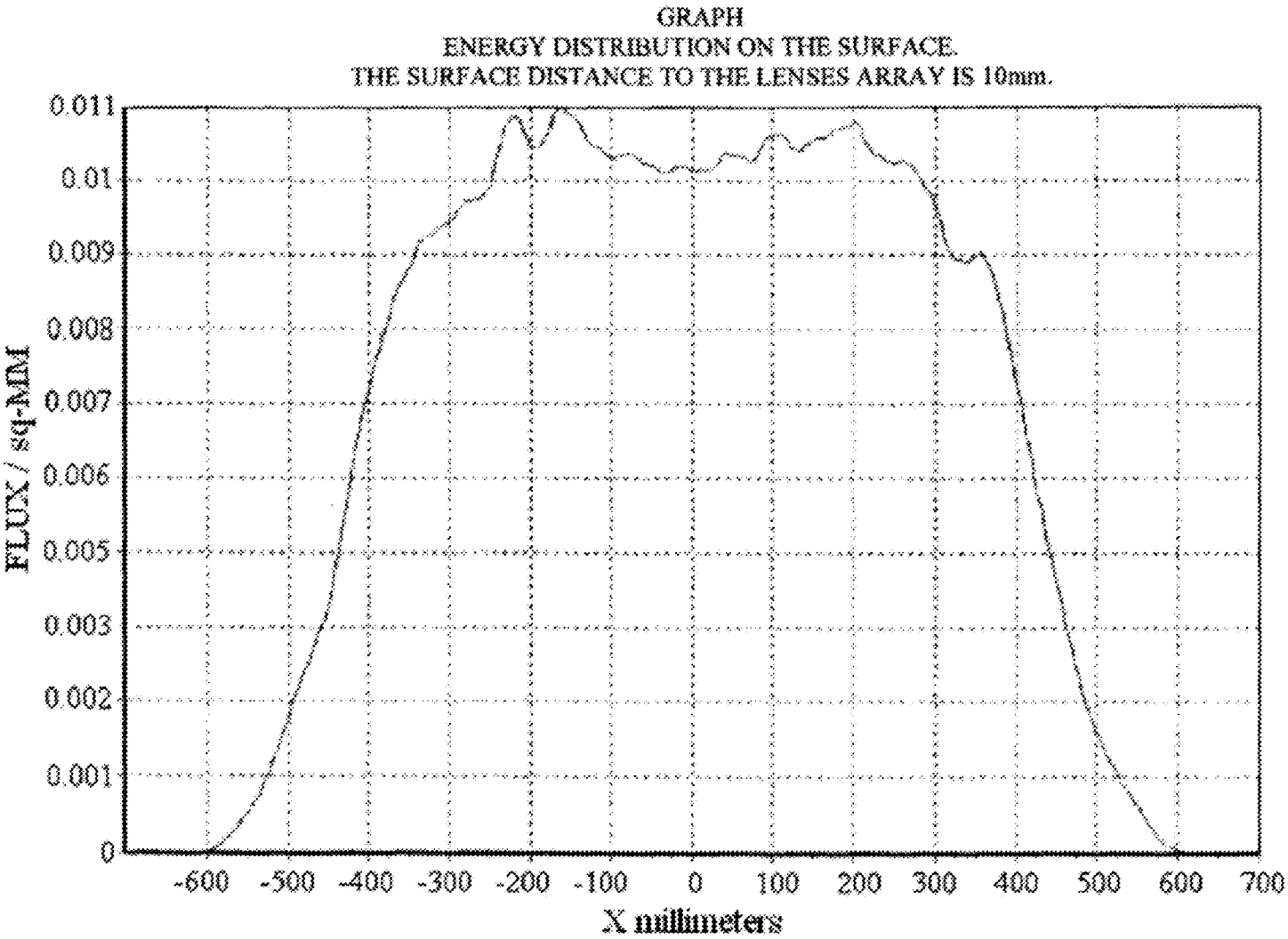

Calculations were performed to determine the performance of a round LED cluster with the spacing shown in FIG. 5 and a lens microstructure such as the one depicted in FIGS. 6 and 7A. The calculations were performed assuming circular dies on the LED cluster with diameters of about 0.4 mm and die spacing of about 7 mm. The diameter of each lens in the microstructure is 8 mm and the overall diameter of the microstructure is equal to or just slightly later than the LED cluster. The lens microstructure is preferably made with plastic from Carl Zeiss/Claret with n=1.74 and the thickness of the micro structural lens is about 7.5 mm. Such a lens could be manufactured with polycarbonate. Calculations based on the lens microstructure are shown in FIGS. 7B-7D. FIG. 7B shows the expected 3D flux distribution from the lens microstructure. FIG. 7C shows the total flux distribution graph. FIG. 7D shows the angular radiant power distribution. FIGS. 8A-8D show the energy distribution along an illuminated area at different distances from the lens microstructure: 8A is at 43 cm; 8B is at 1 m; 8C is at 5 m; and 8D is at 10 m.

With the lens microstructure and LED cluster combination described above, the expected divergence angle is ±2.5°, the light coupling from the source is close to 90% (the full coupling angle is greater than 90°), and the loss of light in the output beam outside the 5° full angle is less than 10%. These results present a significant over other lens designs used with LED clusters, where coupling efficiencies between the cluster and lens of only 70% were seen. Hence, this combination provides a way to achieve increased output powers.

With the die diameter and die spacing described above, the overall cluster diameter would be 3.5 inches and the substrate would have 91 dies. Increased power would be obtained by increasing the number of dies on the substrate, but this would also result in an increased overall cluster diameter. Table 2 summarizes the number of dies and cluster diameters used in additional performance calculations.

TABLE 2

| | Substrate Diameter (inch) | | | | | | | | | | | | | |
|---|---|---|---|---|---|---|---|---|---|---|---|---|---|---|
| | 3 | 3.25 | 3.5 | 3.75 | 4 | 4.25 | 4.5 | 4.75 | 5 | 5.25 | 5.5 | 5.75 | 6 | 6.25 |
| N of dies | 61 | 85 | 91 | 121 | 127 | 163 | 169 | 211 | 217 | 265 | 271 | 325 | 331 | 391 |

Additional calculations were performed to account for manufacturing tolerances that may be seen in the manufacture of clusters and in lens microstructures. The die dimensions and pitches typically do not vary more than 0.1 mm. If the lens is fabricated with the usual tolerances for optics (less than 0.05 mm for stock optics), the overall tolerances would be in the 0.1 mm range. With such tolerances, the increase in beam divergence would be increased to 2.32°.

Figure 13A:
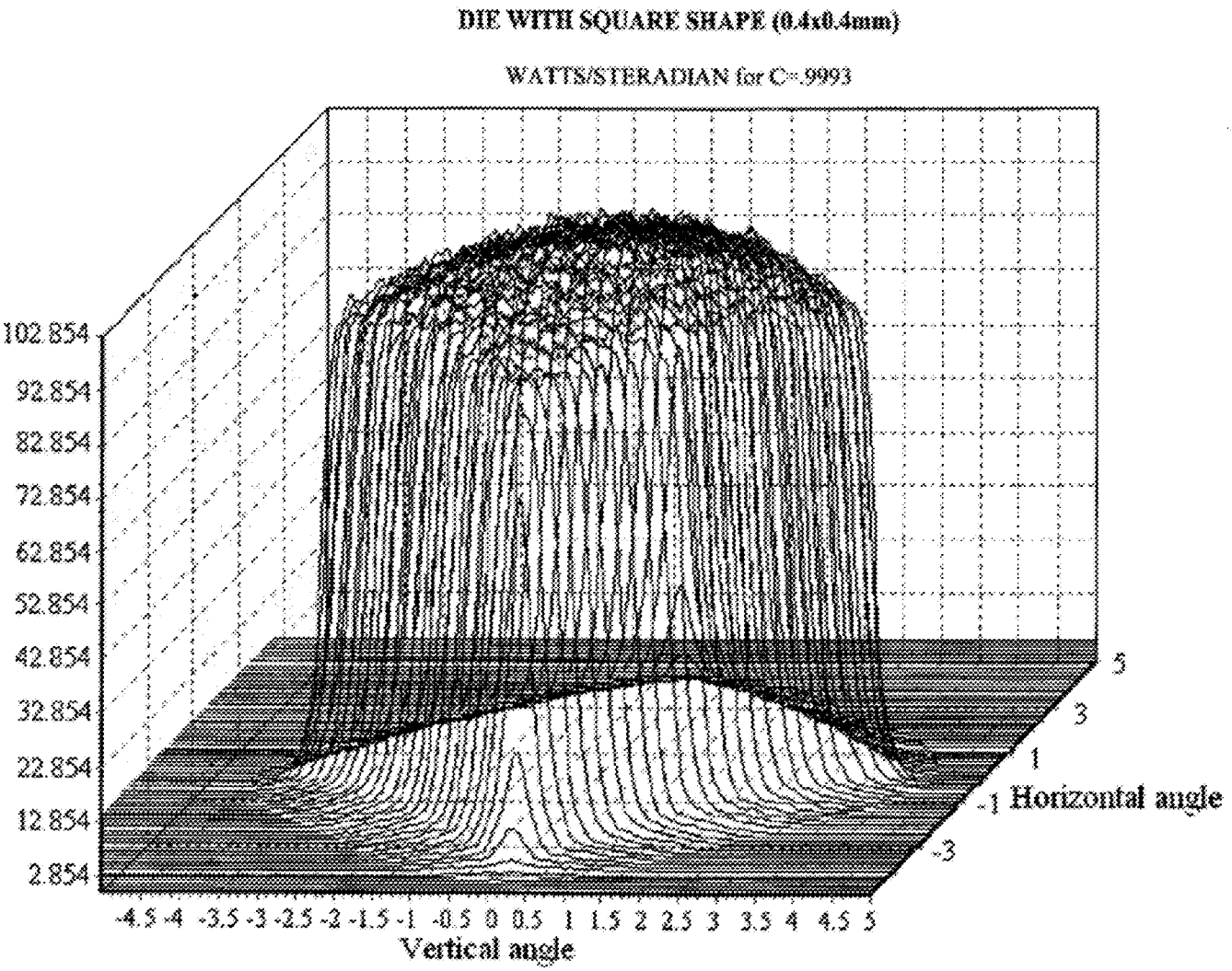
FIGS. 13A-13B show the calculation results for a beam shape for a square die with a dimension of 0.4 mm×0.4 mm
Figure 13B:
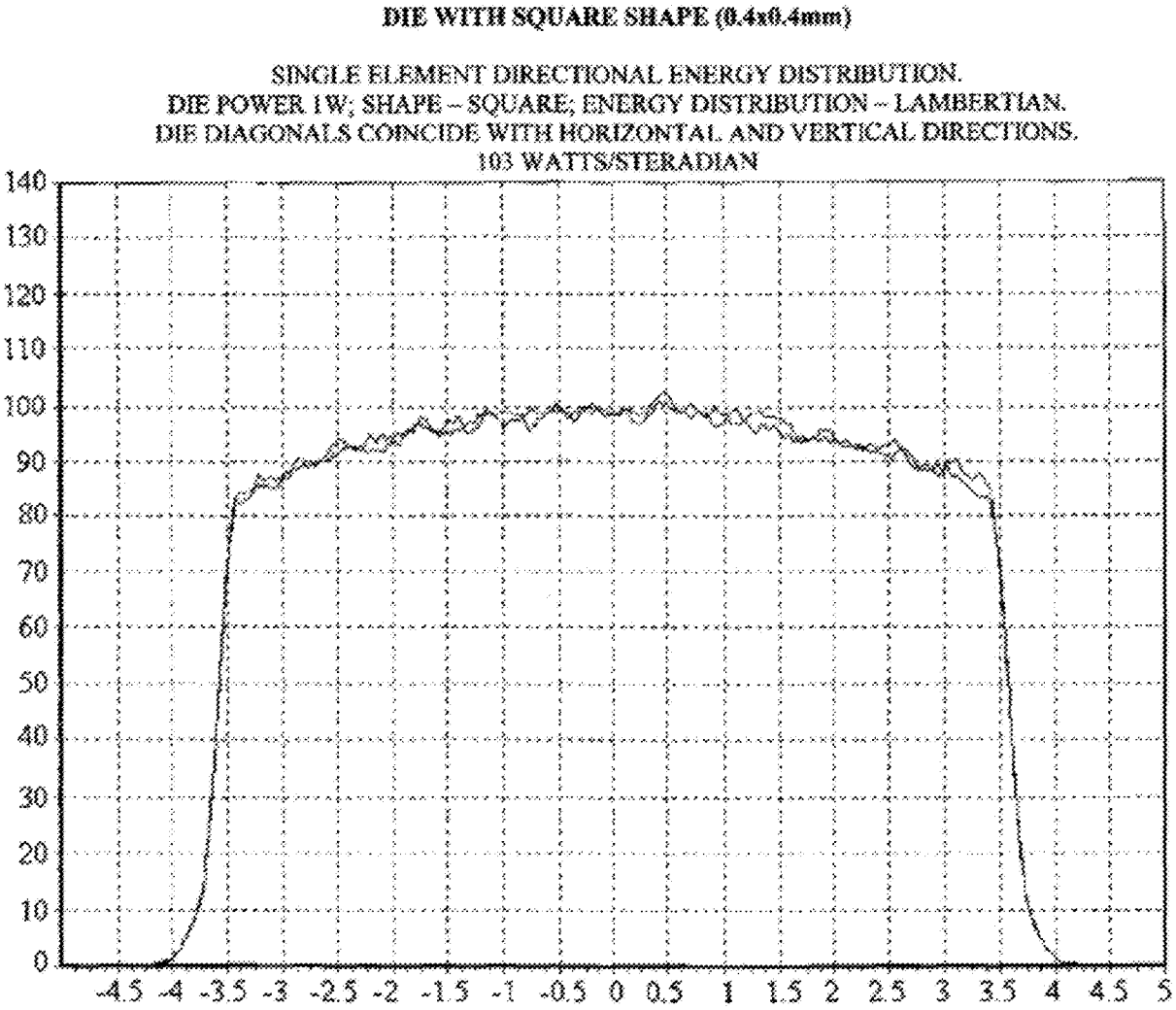

The calculations performed above were based on the use of circular dies in the LED cluster. While circular dies are available in LED clusters, manufacture of LED clusters with rectangular or square dies is typically less expensive. FIGS. 13A and 13B show the calculation results for a beam shape for a square die with a dimension of 0.4 mm×0.4 mm. FIG. 13A shows the 3-D beam shape pattern and FIG. 13B shows the beam divergence. The use of a square die would lead to an increase in the divergence angle of about 2-2.5° and would square the beam shape. Such changes would not be considered as being an appreciably reduction in performance.

A target range for operation of an apparatus according to an embodiment according to the present disclosure is 21 feet. That is, it is desirable to be able to operate at the MPE level at a distance of 21 feet from the apparatus, since, in law enforcement conditions; this provides a minimum standoff distance for a law enforcement officer to take action if a subject tries to move within that distance. It is estimated that to achieve the MPE level at 21 feet having a spot with a radius of 28 cm with a device according to an embodiment according to the present disclosure with a divergence angle of 5° would require that the radiant power of the device should be 40 W. LED clusters presently available from Norlux Corp. typically provide about 0.066 W optical output per die on average for dies with an area of 0.7 mm×0.7 mm at an operating frequency of 1 kHz with a duty factor of 0.1. However, at lower frequencies, the clusters can be operated at elevated duty cycles. With a duty factor of 0.3 or 0.5, the radiant power can be three to five times higher. AT a duty factor of 0.3, the output power per die is 0.2 W. For the lens described above, the die size should be reduced to 0.4 mm×0.4 mm, but this will result in a decreased output power per die of about 0.065 W. At a duty factor of 0.5, the output power per die would be about 0.11 W. As discussed above, the desired output power is 40 W, so the number of dies required to produce that power is about 614 dies at a duty factor of 0.3 and 366 dies at a duty factor of 0.5. With these dies, the cluster diameter would be close to 8" for a 614 dies and 6.25" for 366 dies. If the output power from each die could be doubled, the number of dies could be cut by one-half and 307 dies used at a duty factor of 0.3 and 183 dies at a duty factor of 0.5. This would result in cluster diameters of 5.75" and 4.75" respectively.

One embodiment according to the present disclosure comprises an LED cluster with a mix of LED colors. LED clusters from Norlux Corp. typically demonstrate a radiant power of about 33 mW/die for blue green or cyan dies and about 165 mW/die for red dies. Calculations show that using such an LED cluster from Norlux Corp. would require 682 dies and the light would be concentrated in an angle of 9° with a head format of 4-4.5 inches to achieve the desired MPE power level at 21 feet. Further enhancement of the LED cluster technology may allow for a reduction in the number of dies and a reduction in the diameter of the head. Table 3 shows the head diameter achievable at different die separations, where the head size and die calculations for irradiance angle of 9° and considering 5% loss for cyan and blue dies (square dies of 0.5 mm×0.5 mm) and 30% loss for red dies (square dies of 0.7 mm×0.7 mm).

TABLE 3

| Die separation | Head diameter at 9° angle (3.3 foot spot) at 21 feet (number of dies) | Head diameter at 5° angle (1.8 foot spot) at 21 feet (number of dies) |
|---|---|---|
| 8 | 9.44 inch (682 dies) | 5.75 inch (294 dies) |
| 6 | 7.08 inch (682 dies) | 4.7 inch (294 dies) |
| 4 | 4.72 inch (682 dies) | 3.5 inch (294 dies) |
| 3.39 | 4 inch (682 dies) | |
| 2.96 | 3.5 inch (682 dies) | |

Hence, an embodiment according to the present disclosure comprises an LED cluster combined with a lens microstructure. Such an embodiment has been shown to achieve desired MPE levels at 21 feet with relatively small-sized clusters. Such an embodiment can be easily fit within a flashlight-sized housing, which provides for portability and ease of use.

Figure 12A:
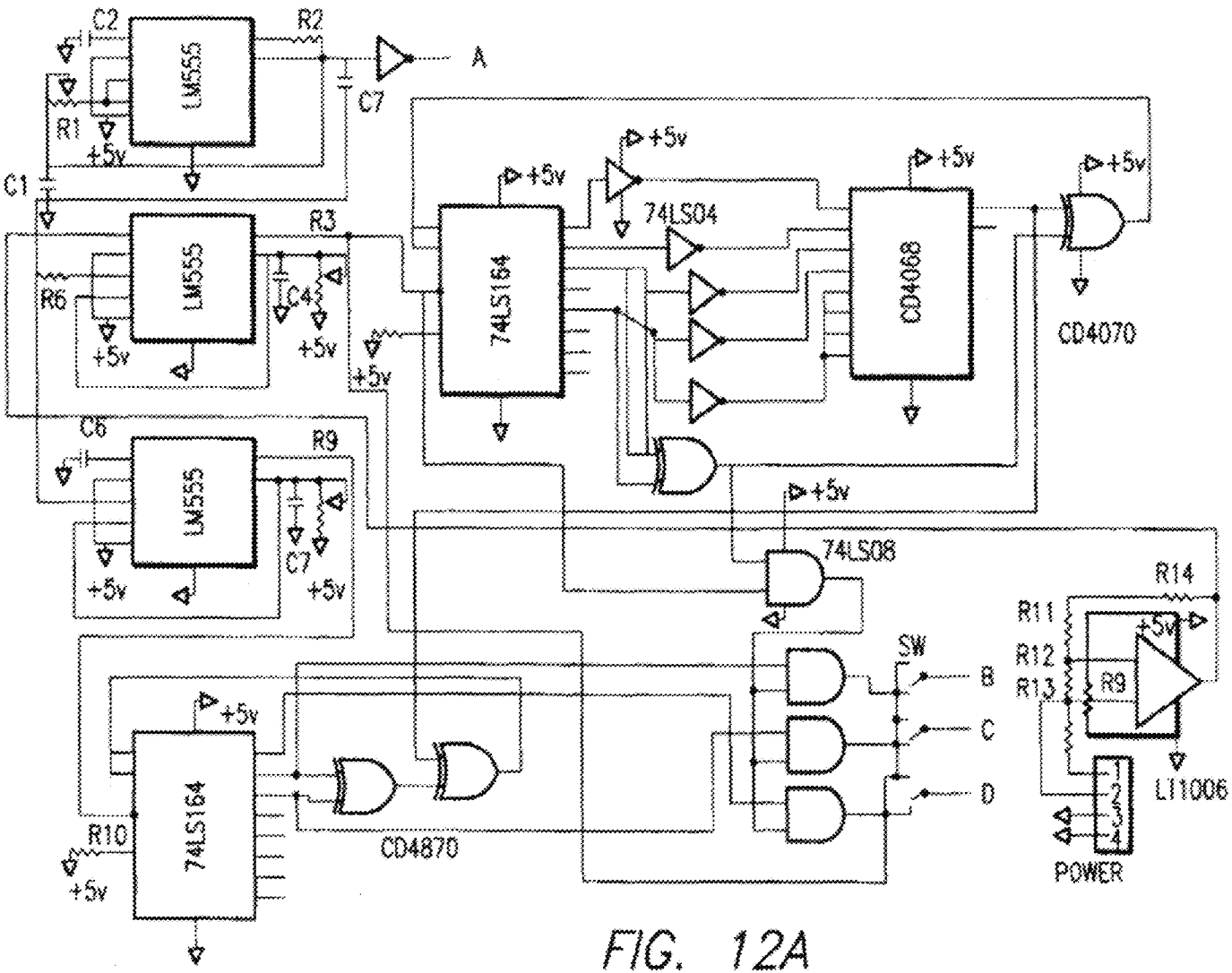
FIGS. 12A and 12B show a circuit schematic having rangefinder feedback control for LEDs.
Figure 12B:
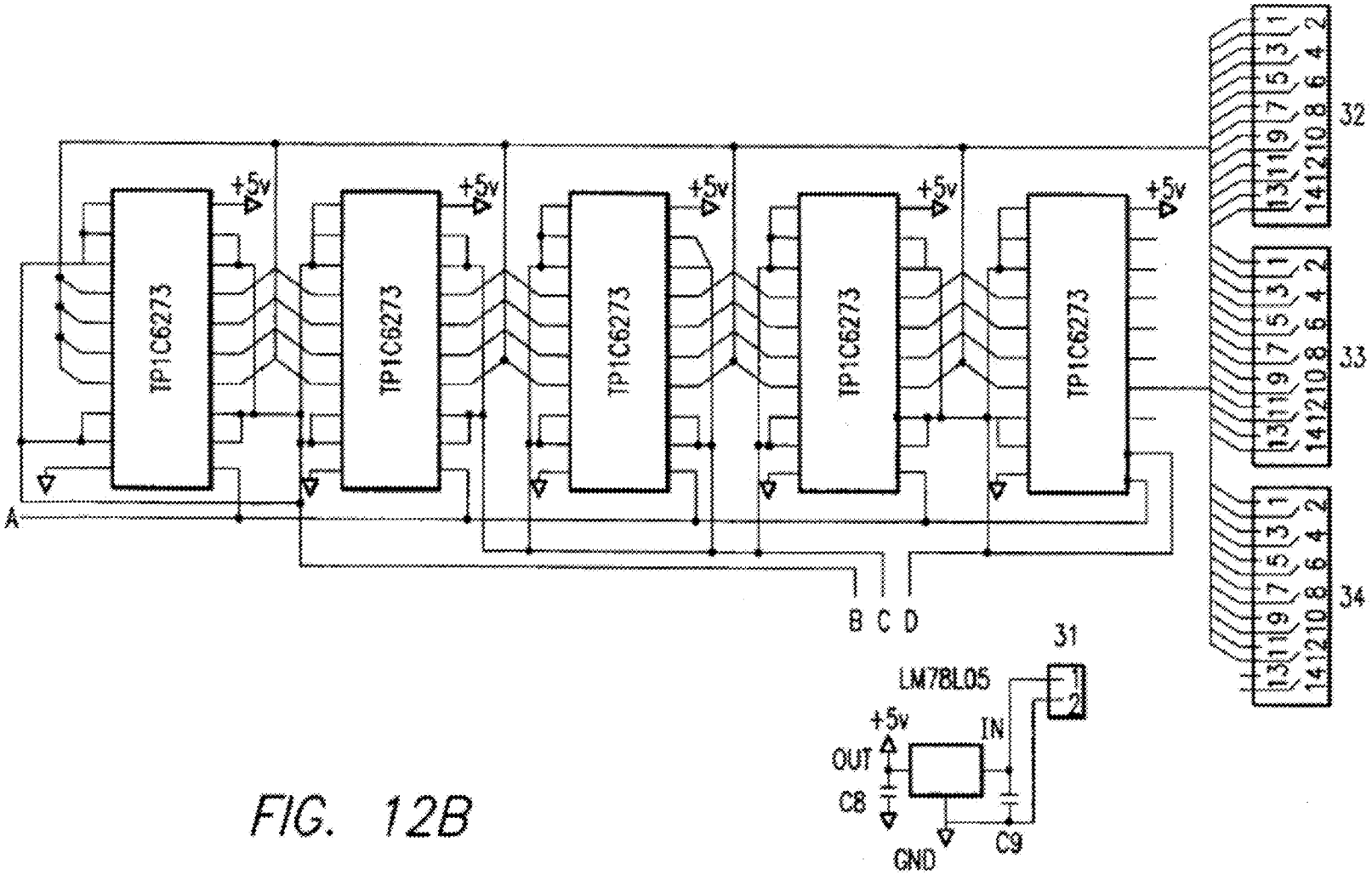

The range finding device 141 shown in FIG. 2 is used to lower or eliminate the light output from the apparatus if a subject may be exposed to power in excess of the MPE. The eye safe operation of the apparatus can be provided by a feedback electrical signal from the rangefinder to the electronics control module 131. If an object appears between the target and the apparatus, the feedback signal can be used to command the electronics to reduce or eliminate the output power. The rangefinder may comprise range finding devices known in the art, such as laser range finding devices or acoustic rangefinders. Some embodiments according to the present disclosure use an acoustic rangefinder, such as the self-contained, ultrasonic analog output sensor Model SM906 from Hyde Park Electronics, LLC. FIGS. 12A and 12B show a schematic of a circuit used to control LEDs with rangefinder feedback control. Note that the rangefinder may be used to shut off all of the LEDs in the apparatus to eliminate all output optical power or shut off selected groups of LEDs to merely reduce the output optical power.

Figure 9:
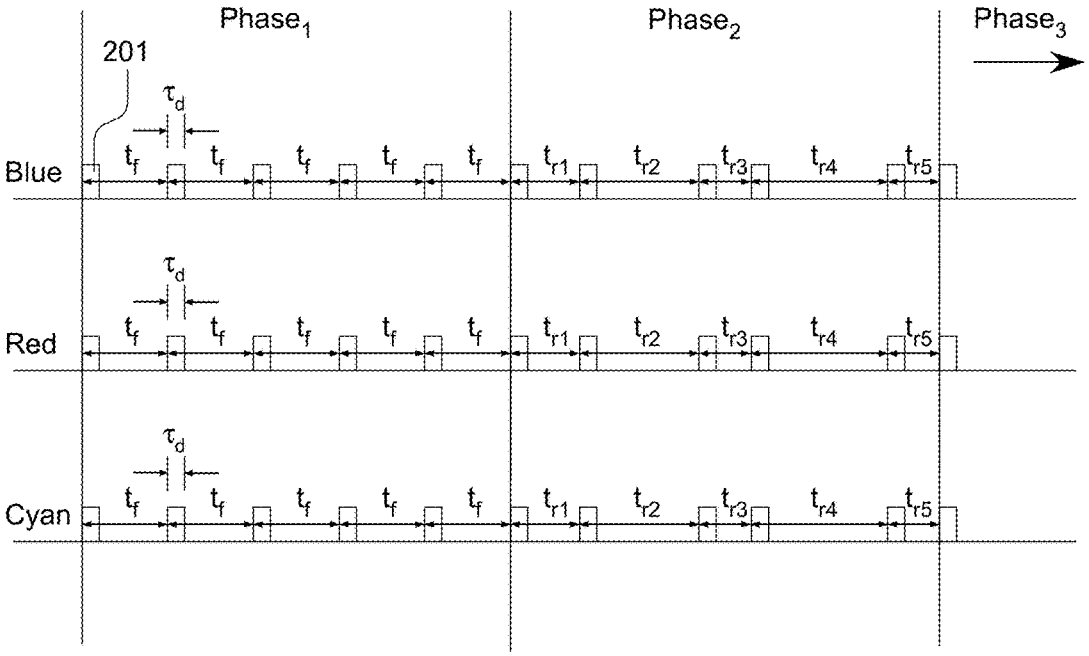
FIG. 9 shows a timeline for phases of a light pattern according to an embodiment of the present disclosure.

As discussed above, some embodiments according to the present disclosure provide a flashing light pattern that has distinct phases. FIG. 9 shows a general timeline for two phases of a light pattern according to an embodiment according to the present disclosure. FIG. 9 shows the timeline for light produced from LEDs of three separate colors, Blue, Red, and Cyan. An alternative embodiment may comprise light produced from blue, red, and green LEDs. Other embodiments of the present invention may have different color LEDs and may also have fewer than or more than three colors. Also note that the number of LEDs producing each color may also vary.

In FIG. 9, light pulses 201 have a constant duration $\tau_d$ seconds, while other embodiments may have lights pulses with varying durations. FIG. 9 also shows that each phase has the same duration of $t_{phase}$ seconds, while other embodiments according to the present disclosure may have phases that vary in duration. FIG. 9 depicts the difference between a periodic phase, Phase 1, and a random or pseudorandom phase, Phase 2. In a periodic phase, the time spacing $t_f$ from the start of one light pulse 201 to the start of the next light pulse 201 is the same. Hence, the pulses repeat at a frequency of $1/t_f$. In a random or pseudorandom phase, the time spacing $t_{rx}$ from one pulse 201 to the next pulse 201 varies in a random or pseudorandom manner. Note that while FIG. 9 shows a pattern having five light pulses in each phase, each phase will typically comprise more than five light pulses. Note also that the overall light pattern may comprise repeating the phases after the phase sequence is completed.

As briefly discussed above, embodiments according to the present disclosure typically have pulse frequencies of the periodic phases between 5 and 15 Hz, with some embodiments having frequencies between 7 and 9 Hz. For example, one frequency is 7 Hz. In a periodic phase, the frequency remains generally fixed throughout the phase. The time spacing for pulses in random or pseudorandom phases also preferably fit within pulse frequencies between 5 Hz and 15 Hz. That is, the time spacing of random pulses vary between 0.066 seconds and 0.2 seconds. The duration of each phase is preferably between 3 seconds and 15 seconds. The duration $\tau_d$ of the light pulses is generally such that the duty factor of the light pulses is less than 50%.

FIG. 9 illustrates a first phase where all or substantially all of the light emitting elements are flashed on and off in a periodic manner for some duration of time. This first phase takes advantage of the flashblindness and other incapacitating effects described above by irradiating a subject with light at or near the MPE with a flashing pattern. The random second phase of flashing all or substantially all of the light emitting elements in a random fashion has an incapacitating effect due to the bright flashing light that has a random periodicity within the frequency range of 5 Hz and 15 Hz.

Figure 10:
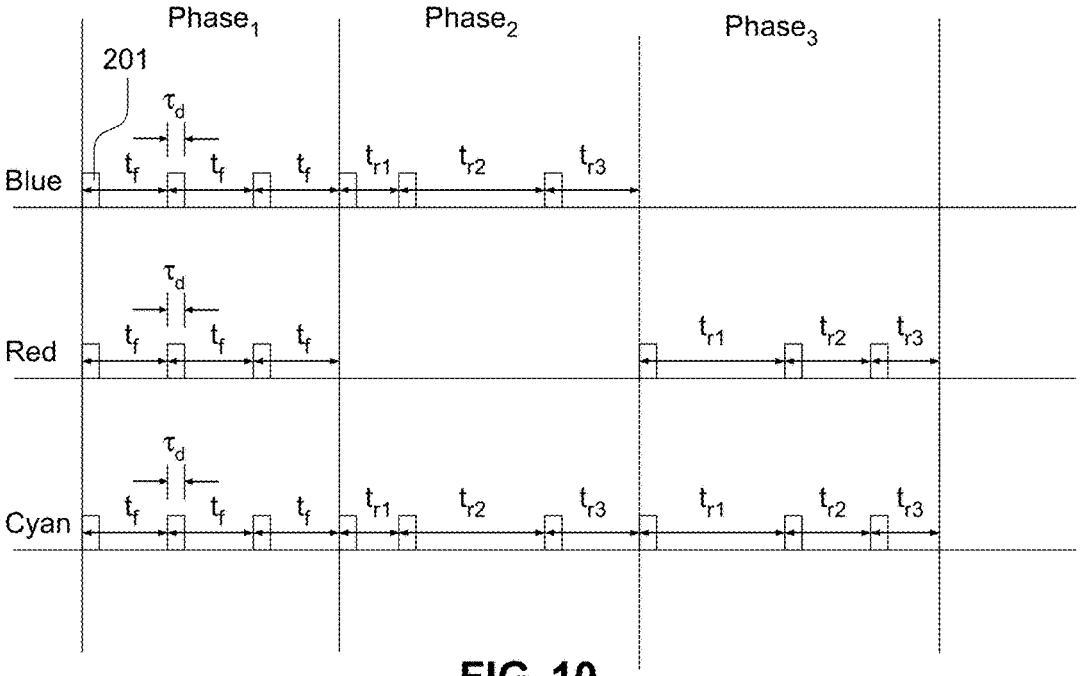
FIG. 10 shows a three phase light pattern.

FIG. 10 illustrates a three phase light pattern. The first phase comprises flashing on and off all or substantially all of the light emitting elements in a periodic manner. The second phase comprises a phase with a different duration than the first phase where two of three colors are flashed in a random manner. The third phase comprises another phase having a different duration than the first phase where a different two of the three colors are flashed in a random manner.

Figure 11:
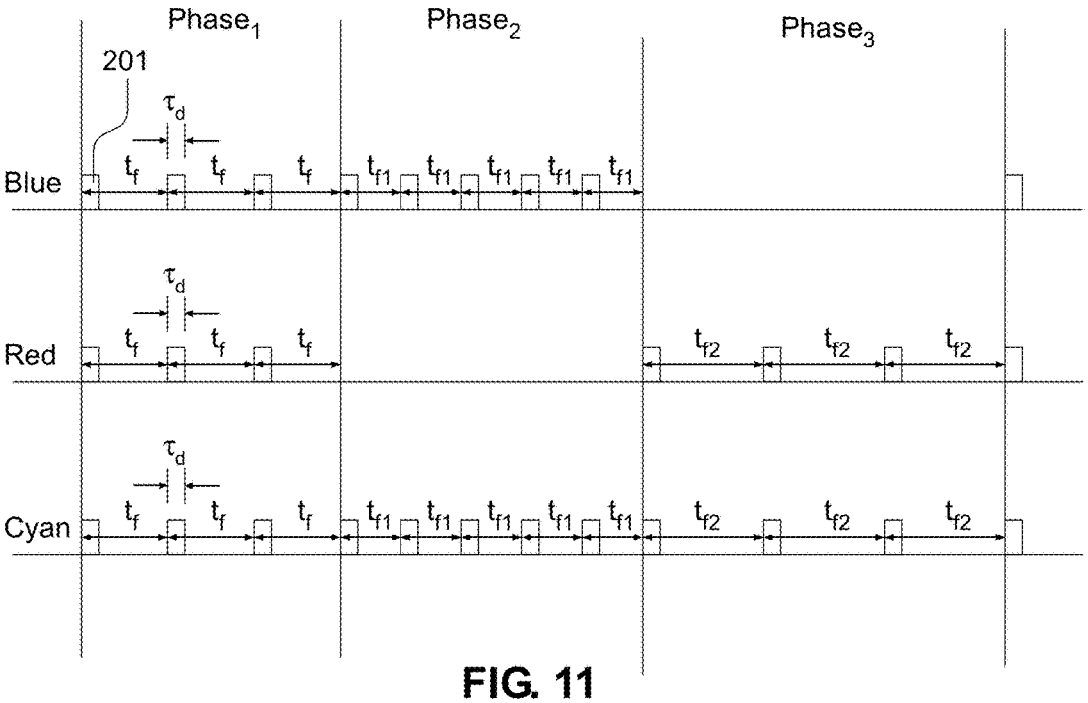
FIG. 11 shows another three phase light pattern.

FIG. 11 illustrates another three phase pattern. The first phase again comprises flashing on and off all or substantially all of the light emitting elements in a periodic manner. The second phase comprises periodically flashing two of three available colors at a first frequency, where the first frequency is preferably at a frequency near the lower bound or the upper bound of the frequency range discussed above. The third phase comprises periodically flashing a different two of three available colors at a second frequency, where the second frequency is preferably at a frequency near the opposite bound of the frequency range from the first frequency.

FIGS. 9, 10, and 11 do not illustrate all of the light patterns that may be used by embodiments according to the present disclosure. Table 4 shows some additional light patterns that may be used by embodiments according to this disclosure, but Table 4 does not show all of the light patterns that may be used by embodiments according to the present disclosure. In general, each phase of a light pattern differs from an adjacent phase in the power, frequency, and/or color output by the apparatus during the phase. This variation in phases is performed to overcome any adaptation by a subject to the flash pattern in any one phase.

TABLE 4

| Pattern | Phase 1 | Phase 2 | Phase 3 | Phase 4 | Phase 5 | Phase 6 | Phase 7 |
|---|---|---|---|---|---|---|---|
| 1 | All colors pulsed periodically | All colors pulsed randomly | Repeat phases 1 and 2 | | | | |
| 2 | All colors pulsed periodically | Cyan and red pulsed randomly | Blue and red pulsed randomly | Repeat phases 1-3 | | | |
| 3 | All colors pulsed periodically | Blue and cyan pulsed randomly | Cyan and red pulsed randomly | Repeat phases 1-3 | | | |
| 4 | All colors pulsed periodically | Red and cyan pulsed periodically at a low freq (pref. 5 Hz) | Cyan and blue pulsed periodically at a high freq (pref. 15 Hz) | Repeat phases 1-3 | | | |
| 5 | All colors pulsed periodically | All colors pulsed randomly | Cyan pulsed periodically (pref. 7 Hz) | Blue pulsed periodically (pref. 7 Hz) | Red pulsed periodically (pref. 7 Hz) | Repeat phases 1-5 | |
| 6 | All colors pulsed periodically | Cyan and red pulsed randomly | Blue and red pulsed randomly | All colors pulsed randomly | Repeat phases 1-4 | | |
| 7 | All colors pulsed periodically | Cyan and red pulsed randomly | Cyan and blue pulsed randomly | All colors pulsed randomly | Repeat phases 1-4 | | |
| 8 | All colors pulsed periodically | Red and cyan pulsed periodically at a low freq (pref. 5 Hz) | Cyan and blue pulsed periodically at a high freq (pref. 15 Hz) | All colors pulsed periodically at a freq diff. than freq of phase 1 | Repeat phases 1-4 | | |
| 9 | All colors pulsed periodically (pref. 7-9 Hz) | All colors pulsed randomly (pref. 5-15 Hz) | First color pulsed periodically | All colors pulsed randomly (pref. 5-15 Hz) | Second color pulsed periodically | All colors pulsed periodically | Third color pulsed periodically |

As discussed above, illumination near the MPE will have the most incapacitating effects. Hence, in the phases of the light patterns according to some embodiments according to the present disclosure, the power produced by the apparatus is an important factor in the overall effectiveness of the apparatus. Since flash frequencies near the fundamental frequencies of the brain have an effect, the frequency (or randomness) of the light pulses are also an important factor in the overall effectiveness of the apparatus, but probably less a factor than the power. As also discussed above, the color of the output also has an effect on a subject, but probably less an effect than power or frequency. However, the color cyan (wavelength between 495 nm and 505 nm) appears to have a particularly effective incapacitating effect. Therefore, some embodiments according to the present disclosure include cyan LEDs.

The microstructured beam former (compander) based on a single aspherical lens collects light from an angle of 106° from round dies in an LED cluster and focuses it in a 5° angle with 87.5% of the light uniformly distributed in the 5° angle. The beam former diameter is not more that 10% larger than the diameter of the LED cluster and may be fabricated from optical grade plastic with an n=1.74. The manufacturing tolerances for stock optics lead to an increase in the beam divergence of 2.32°. Using a square die instead of a circular die leads to an increase in the divergence angle of approximately 2-2.5° and a squaring of the beam shape. FIGS. 13A and 13B show calculated results of the beam shape for a square die 0.5 mm×0.5 mm. This demonstrates that the wide cluster beam can be concentrated with one inexpensive microstructured element into a narrow angle without substantial energy losses.

Another embodiment according to the present disclosure may also provide for use of the apparatus as a standard flashlight. If the LEDs of the LED array 133 are flashed at an elevated frequency (more than 60 Hz), the flicker of the LEDs are not distinguishable by the human eye. If the LEDs of the LED array comprise red, blue and green LEDs, operation of the LEDs at full power may produce white light on a target, in effect, operating as a standard flashlight. However, production of white light may require that the ratio of the number of LEDs of different colors be set to optimize the production of white light.

Another embodiment according to the present disclosure may also provide for scanning the light beam without operator control to increase the area covered by the embodiment. This is accomplished without compromising irradiance on the target, since the intensity of each flash will remain the same as for an unscanned beam, as will the number of flashes per second seen at an individual location. The light energy delivered to a target area covers an area greater than the beam footprint. This prevents a subject from escaping the effect of the flashing and can affect a few subjects simultaneously. This is done by setting the device to a sequence of directions to visit a sequence of flash points resulting in a pattern that defines an area in space. In such a case, it is necessary to spatially scan the beam through a sequence of positions while flashing to ensure the delivery of the energy to effect some level of incapacitation.

This feature is not substantial if the device operates at short distances with relatively wide beam, or if the action requires few seconds of operation. At the same time in a long term actions, such as crowd control, or the control of inmate riot in prison, for example, this feature can be helpful. In one embodiment, the main operational part of the apparatus, specifically, an electronics control module 131, a LED array 133, and a beam former 135 is housed in a rigid cylindrical body. This housing is placed inside an outer protective housing, and is attached to it via a rigid rubber cylinder with certain degree of flexibility. Two miniature step-motor actuators, displaced at 90° are attached to the inside wall of the external housing. These actuators will tilt the main unit in perpendicular directions, thus providing the multidirectional strobe. The relationship between the divergence angle of the beam, required operational distance, the relative speeds of both actuators, and the main unit tilt angle in each plane defines the covered area.

Copending and commonly assigned U.S. patent application Ser. No. 12/399,701 describes an apparatus that makes use of the impact that flashing, multi-color varying lights have on a human being. One embodiment of the apparatus disclosed in that application comprises an array of different color LEDs distributed across an area. A control mechanism is used to control the flashing of the LEDs to produce an incapacitating effect while lenses may be used to concentrate and focus light from individual LEDs. One configuration of such a device would provide that person illuminated by such a device would perceive lights of different colors coming from the same location.

Rather than using spatially distributed LEDs of different colors, additional embodiments according to the present disclosure comprise multiple light emitting areas that are spatially located close together, but where each light emitting area comprises a single color. For example, one embodiment may provide the capability to radiate red, green, or blue light. Such an embodiment may then have only three light emitting areas: a red light emitting area; a green light emitting area; and a blue light emitting area. Spatial separation of the light emitting areas, while slight (see description below), may be sufficient for a person illuminated by such a device to perceive (either consciously or unconsciously) lights of different colors coming from slightly different locations. Turning on the red, green, and blue light emitting areas simultaneously in certain proportions may cause the person illuminated by the device to perceive white light. However a specific white light emitting area can also be provided.

Some embodiments according to the present disclosure may provide both immediate physiological responses and cumulative psycho-physiological responses. The immediate physiological responses may include: a startle response where a target is immediately distracted; a blinking and squinting/avoidance response where the target experiences difficulties in keeping eyes open; decreased night vision where the target sees only as a very bright spot surrounded by a "wall" of light; and flashblindness (and further afterimages) which may be a lasting effect that results in impaired vision persisting between flashes and continues for minutes after the light is off. Cumulative psycho-physiological responses may include: discomfort followed by startling which adds to an avoidance response; disorientation which reduces the ability of an adversary to clearly target a user; and vertigo which results in feelings of physical imbalance that further limit an adversary's effectiveness. Such effects are very individual and depend on many factors including the time of exposure and surrounding conditions. The radiance provided by some embodiments according to the present disclosure, even at the prolonged exposure times, is preferably below the exposure limits determined according to the International Commission on Non-Ionizing Radiation Protection (ICNIRP) guidelines on the limits of exposure to incoherent, broadband optical radiation.

Figure 14:
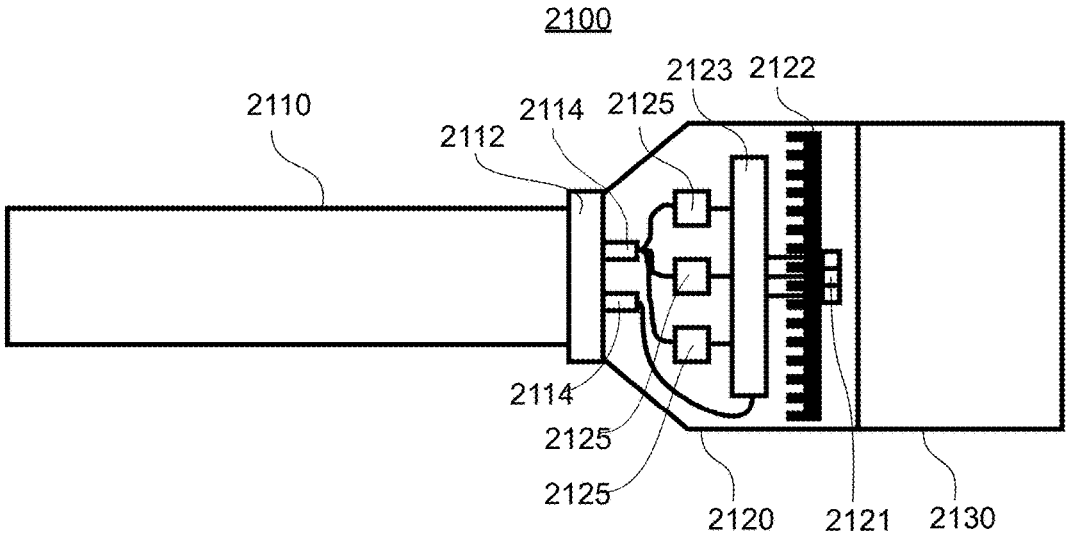
FIG. 14 shows an apparatus for incapacitation by the emission of light.

FIG. 14 illustrates an apparatus 2100 in accordance with an embodiment according to the present disclosure. The apparatus 2100 has a handle 2110, which preferably contains a battery pack or other power source used to power the apparatus 2100 through power terminals 2114. An electronics housing 2120 is preferably coupled to the handle 2110 and may be held in place by a securing nut 2112 or other securing means. Other possible securing means are described below. The electronics housing 2120 contains a high power light emitting chip 2121 disposed on a heat sink 2122. The electronics housing 2120 may also contain an electronics assembly 2123 for controlling the light emitting chip 2121. The electronics housing 2120 may also contain one or more electronic drivers 2125 for providing current to the light emitting chip 2121. For example, if the light emitting chip 2121 has red, green, and blue LEDs, a separate electronic driver 2125 may be used for each color LED. The apparatus 2100 may also have a light focusing or light concentrating element 2130 that helps concentrate the light from the light emitting chip 2121 into more of a focused beam.

The power source contained in the handle 2110 preferably comprises a rechargeable battery or rechargeable battery pack. One type of rechargeable battery used in an embodiment according to this disclosure may be a D-size, Power titanium NIMH rechargeable battery. Another type of rechargeable battery that may be used comprises a Lithium-Ion battery or battery pack. Preferably, the selected batteries provide for light output near that obtained from an externally powered DC source, while providing for desired portability and rechargeability. Alternatively, other embodiments may use simple D-sized alkaline batteries, but such batteries may provide for less optical power output due to the relationship between the internal resistance of the alkaline batteries and the dynamic resistance of the LED chip. The handle 2110 may be configured to itself be replaceable. Thus, when the apparatus 2100 runs low on power, the handle 2110 can be replaced with a fully powered handle 2110, allowing the apparatus to be used while the discharged handle 2110 is being charged or allowing the user to quickly substitute a new battery pack when the one in use is becoming depleted so as to be able to continue use of the device in a field situation. The handle 2110 may also have a receptacle or connector for connection to an external power source. Instead of deploying all of the electronics in the electronics housing 2120 as discussed above, the handle 2110 may also contain the electronics assembly 2123. The electronic drivers 2125, or other circuitry used for the operation of the apparatus. Preferably, the diameter of the handle is chosen to easily gripped by a human hand. A connection to a remote power source may also be provided so that, for example, a power pack could be carried on the user's belt or elsewhere, which would allow for greater power and/or greater time in use.

The electronics assembly 2123 receives power from the power terminals 2114 and controls the emission of light from the light emitting chip 2121. As is described in additional detail below, the electronics assembly 2123 controls the flashing of light from the light emitting chip 2121 to achieve desired flash patterns. The electronics assembly 2123 may comprise one or more field programmable gate arrays, microprocessors, microcontrollers, discrete devices or some combination thereof configured to provide the flashing capability described in additional detail below as well as previously.

The electronics assembly 2123 provides the ability to flash different colors provided by the light emitting chip in a periodic and/or nonperiodic manner. The periodic manner comprises pulsing different colors on and off at a selected frequency, where the on duration of the colors is preferably less than the off duration. The selected frequency is preferably between 5 Hz and 15 Hz. The nonperiodic manner comprises pulsing the colors on and off, where the on durations are preferably the same, while the off durations vary randomly or pseudo randomly. In this nonperiodic flashing, the time from the start from one light pulse to the start of the next light pulse preferably varies between 0.666 seconds and 0.2 seconds.

The light emitting chip 2121 preferably comprises high brightness red, green and blue LED substrates disposed on a single chip or module and spatially separated. The LED substrates may be deployed on a single chip or module to provide for a smaller size of the electronics housing 2120 and to reduce or eliminate the need for complex optics. Due to the high power consumed by such devices, the light emitting chip may be disposed on the heat sink 2122 to conduct excess heat away from the chip 2121.

Figure 16:
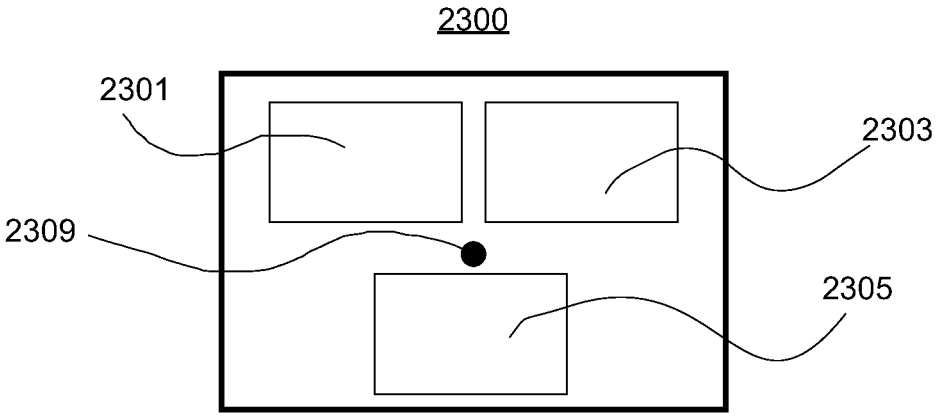
FIG. 16 shows a layout of three LED substrates within an LED module.
Figure 17:
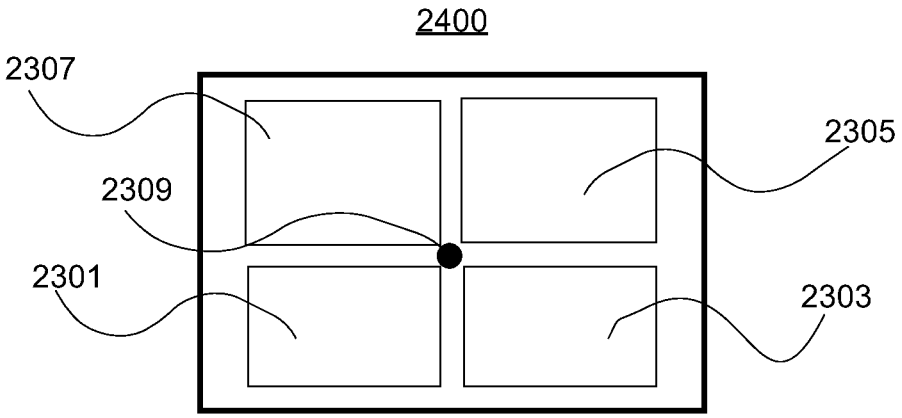
FIG. 17 shows a layout of four LED substrates within an LED module.

Some embodiments according to the present disclosure use a light emitting chip 2121 that comprises high brightness differently colored LED substrates or dies disposed on a single chip or module and spatially separated. The LED substrates may comprise just two colors, such as amber and red; cyan and blue; amber and cyan; or red and blue, or three colors, such as red, green and blue or red, blue and cyan. FIG. 16 illustrates a typical layout of the LED substrates within such a module 2300. FIG. 16 shows a red LED substrate 2301, a blue LED substrate 2303, and a green LED substrate 2305. The green LED substrate 2305 and red LED substrate 2301 are larger than the blue substrate 2303 to allow for each substrate to generate light at approximately the same optical power. Preferably, the LED substrates 2301, 2303, 2305 are spatially separated from the optical axis 2309 of the apparatus. This provides that as separate colors are flashed, the source of the light appears to move, which may further increase the incapacitating effects of the flashing light.

Figure 28:
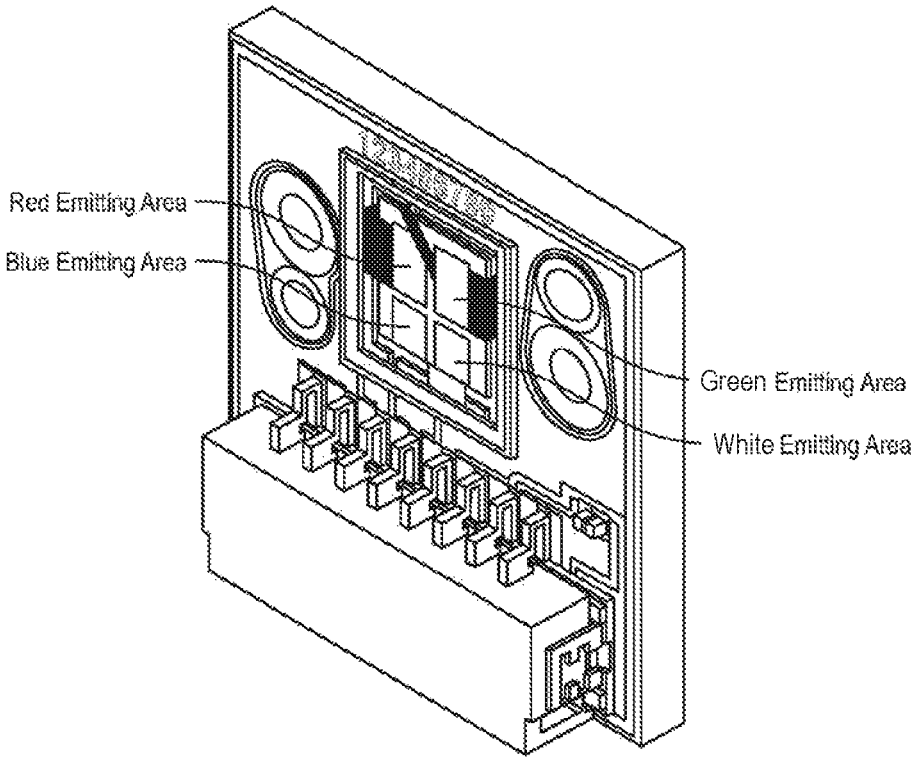
FIG. 28 depicts a commercially available LED module.

An embodiment according to the present disclosure also includes a "flashlight" mode. In the flashlight mode, red, green, and blue LED substrates are preferably concurrently operated at maximum current and are flashed on and off at a high frequency, e.g. a rate higher than 120 Hz. This should produce a white output light with flashes that are unresolvable by human eyes, hence producing a beam of white light. Other colored LED substrates may also be concurrently operated to produce the desired white light. The flashlight mode may be alternatively implemented by using a module having four LED substrates: red, green, and blue LED substrates (or other colors), as described previously; and a white LED substrate. FIG. 28 shows a module 2400 having red LED substrate 2301, a blue LED substrate 2303, and a green LED substrate 2305; and a white LED substrate 2307. With such a module 2400, the flashlight mode would be produced by flashing the white LED substrate 2307 at a high rate, e.g. a rate greater than 120 Hz. Further note that the "flashlight" mode provides another light color for use in incapacitation. That is, the apparatus may be operated to flash white light along with flashes of colored light.

Figure 18:
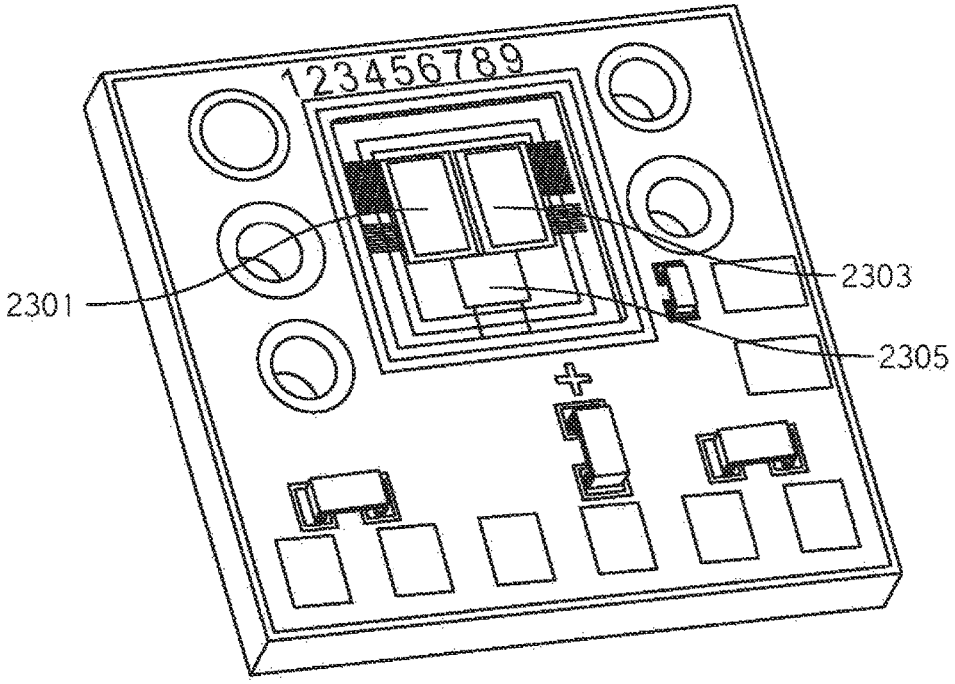
FIG. 18 depicts a multi-chip, multi-color LED module.

The chip 2121 may comprise an advanced solid state light source, such as those used in microdisplay-based rear projection television. One such light source may comprise a high brightness multiple-color LED module, such as the multi-chip, multi-color LED module depicted in FIG. 18 from Luminus Devices (Billerica, Mass.). Alternatively, multiple single color LED chips, (such as the PT120 module from Luminus devices), may be used. Such modules provide relatively high output light power at low voltages. For example, the PT120 module provides peak radiant powers of 5.6 W (red), 8 W (green), and 7.2 W (blue) with operating voltages of 3V (red), 5V (green), and 5.1V (blue) at a peak current of 30 A.

Figure 19:
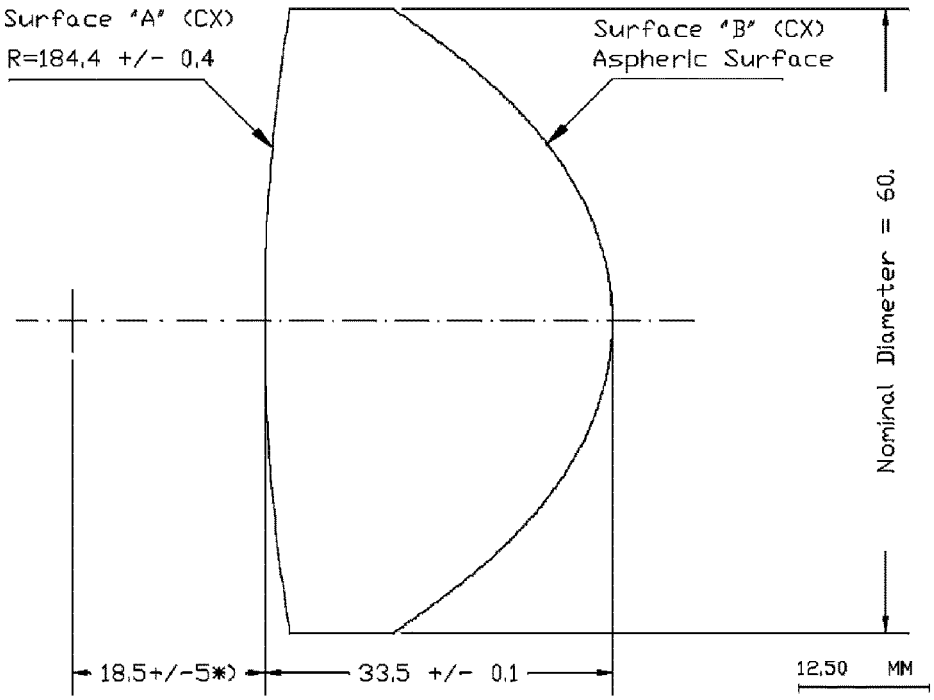
FIG. 19 illustrates an aspheric lens for light concentration.

The light focusing or light concentrating element 2130 comprises an optical element or structure that functions to form a desired beam or beams from the light emitted by the light emitting chip 2121. LEDs typically emit light with a high divergence angle, so the light focusing or light concentrating element 2130 preferably functions to form a light beam with a smaller divergence angle. The light focusing or light concentrating element 2130 may comprise an aspheric lens designed to provide for concentration of light with a specified divergence angle. For example, a lens which provides for concentration of 73% of light with a 5 degree divergence angle has been demonstrated. FIG. 19 illustrates an aspheric lens having a diameter of about 60 mm that may collect about 70% of the light from a 4.6×2.6 mm LED chip. Such a lens may be fabricated using diamond turning for low quantities. Large quantities of such lenses may be fabricated by using an injection molding process or other low cost manufacturing processes.

Figure 15:
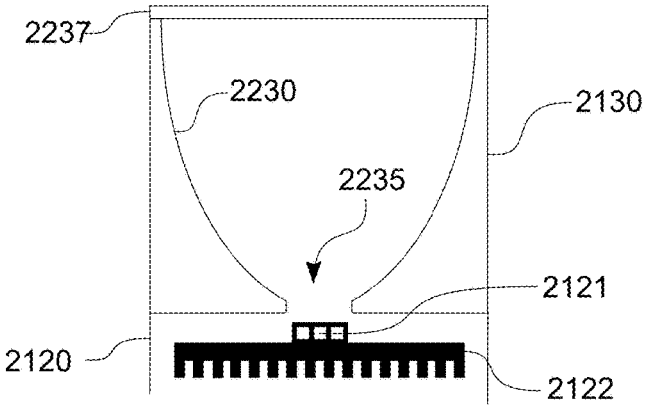
FIG. 15 shows a cross-section of a light focusing element with a contoured internal surface.

However, use of a lens may increase the cost, size, and weight of the apparatus. Therefore, the light focusing or light concentrating element 2130 may comprise a structure that has an internal surface contoured to focus the beam. FIG. 15 illustrates a cross-section of a light focusing element 2130 with an internal surface 2230 contoured to help focus the light from the light emitting chip 2121 into a less divergent beam. The curvature of the internal surface 2230 is preferably chosen to provide for increased beam concentration. The internal surface preferably comprises a mirrored surface or a surface with high reflectivity to increase the effectiveness of the beam concentration. An opening 2235 at the bottom of the light concentrating element 2130 allows light from the light emitting chip 2121 to enter the light concentrating element 2130 to be concentrated by the internal surface 2230. The light concentrating element 2130 may also have a clear cap 2237 to protect light producing and/or electrical elements with the apparatus 2100. The cap 2237 may alternatively comprise a lens to further concentrate light reflected from the internal surface 2230.

Figure 20:
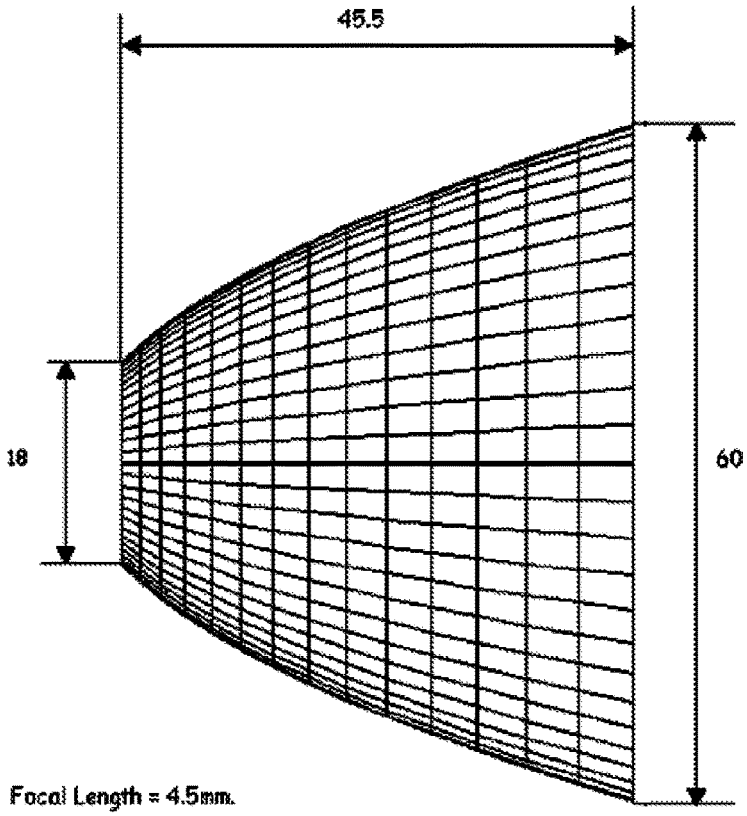
FIG. 20 shows a contour drawing of a parabolic radiator.

FIG. 20 shows a contour drawing of a parabolic radiator which may be used in an embodiment according to the present disclosure for the light concentrating element 2130. With an LED chip size of about 4.6×2.6 mm and a light concentration angle of 5°, the diameter of the reflector on the output side was calculated to be 60 mm. However, any parabolic reflector typically concentrates only 30-35% of the light source in the calculated angle. The rest of the light (stray light) is spread in an angle defined by the focal length and the opening of the reflector. In the reflector depicted in FIG. 20, this angle was 72°. Hence, the embodiments of the present disclosure that utilize a reflector present a tradeoff with embodiments that utilize a focusing lens, where the reflector may provide for lower cost, size and/or weight, while concentrating less of the light from the LED chip.

The optical power provided by embodiments of the present disclosure using a single color LED chip was measured by directing light from such an embodiment at a screen placed two meters away. The diameter of the spot with the maximum concentration of light was measured, and the diameter of the entire surrounding spot in which the light was visible was also measured. The pulse power was measured on axis, at the edge of the bright spot, and in the middle of the ring surrounding the bright spot. The measured irradiance was then multiplied by the respective spot size to estimate the power per pulse. The average irradiance in the bright spot and the irradiance in the middle of the large spot were the values used for the calculations. The data for each color LED chip are presented in Table 5 below.

TABLE 5

| | Parameters/Colors | Blue LED | Green LED | Red LED |
|---|---|---|---|---|
| Bright Spot | Diameter (cm) | 15 | 15 | 15 |
| | Full angle | 8.6° | 8.6° | 8.6° |
| | Irradiance on axis (mW/cm$^2$) | 10.5 | 9.2 | 9.5 |
| | Irradiance at the edge (mW/cm$^2$) | 9.5 | 8.5 | 8.8 |
| | Average power in the spot (mW) | 1767 | 1564 | 1617 |
| Surrounding spot | Diameter (cm) | 150 | 150 | 150 |
| | Full angle | 74° | 74° | 74° |
| | Irradiance in the middle (mW/cm$^2$) | 0.14 | 0.13 | 0.14 |
| | Average power in the spot (mW/cm$^2$) | 2449 | 2274 | 2449 |
| | Total power (mW) | 4216 | 3838 | 4066 |

The light emitting chip 2121 may produce a large amount of heat during operation, therefore the use of a heatsink 2122, as shown in FIG. 14, may be used to conduct heat away from the chip 2121 and keep it from over-heating. Also, the electronics board 2123 may also create significant amounts of heat. However, a desire to keep the electronics housing 2120 relatively small may require that the heatsink 2122 surface area be kept small. Hence, as additional cooling microfan may be disposed in the electronics housing 2120 to circulate air past the heatsink 2122 and expel it from the electronics housing 2120. Such a microfan may also serve to keep the electronics housing 2120 and the apparatus 2100 cooler overall.

Figure 21A:
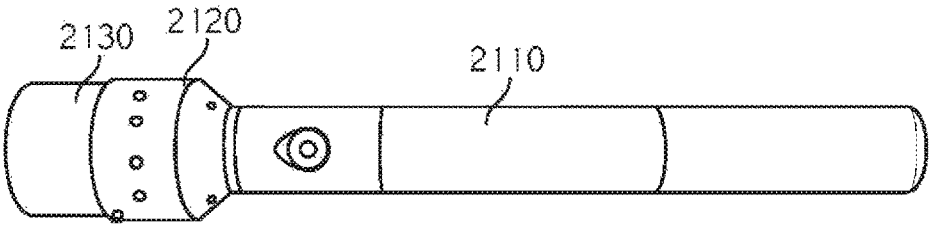
FIGS. 21A-21C show photographs of various elements of an embodiment according to the present disclosure.
Figure 21B:
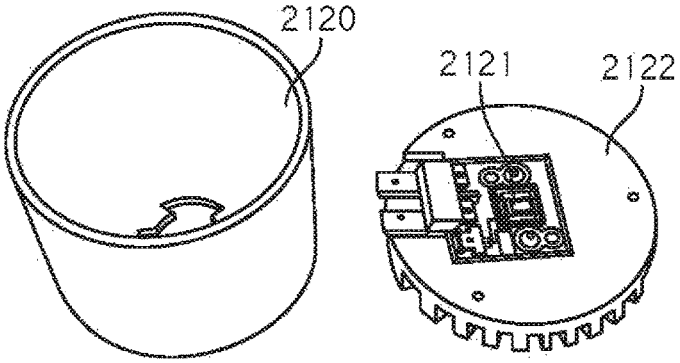
Figure 21C:
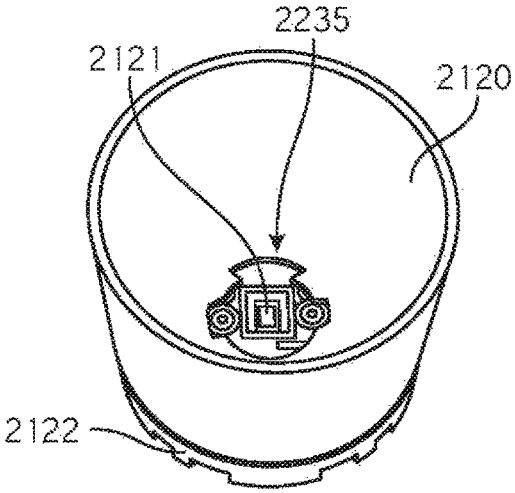

As indicated above, some embodiments according to the present disclosure are provided in flashlight-like enclosures. FIG. 21A shows a photograph of one embodiment according to the present invention. FIG. 21A shows the handle 2110, the electronics housing 2120, and the light concentrating element 2130. FIG. 21B separately shows the light concentrating element 2130 and the light emitting chip 2121 mounted on the heat sink 2122. FIG. 21C shows the light emitting chip 2121 mounted in the bottom opening 2235 of the light concentrating element 2130.

Figure 22:
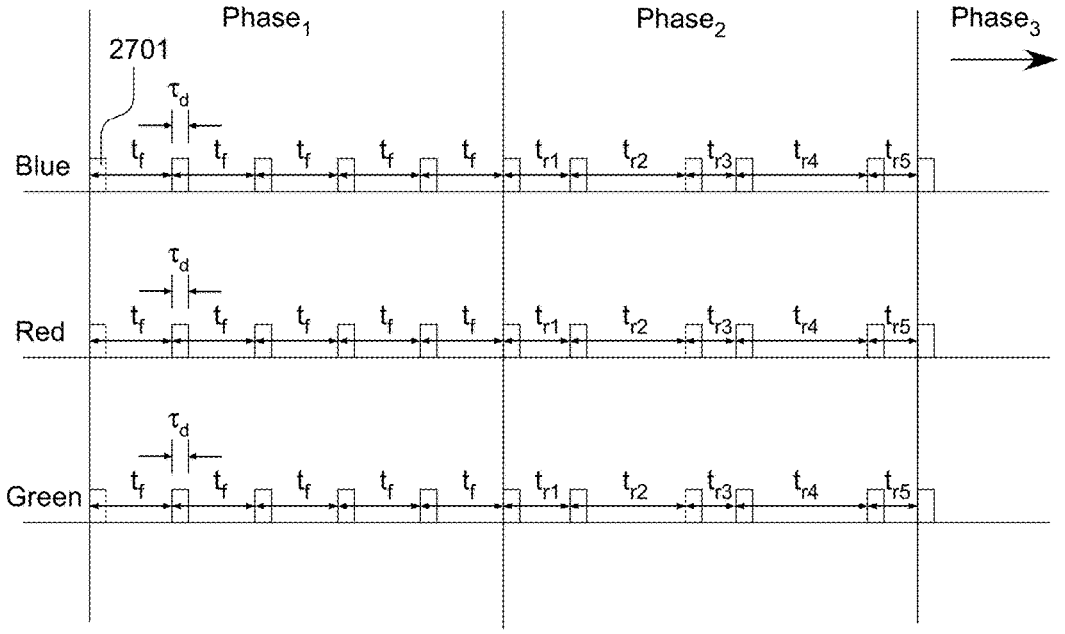
FIG. 22 shows a timeline for phases of a light pattern according to an embodiment of the present disclosure.

As discussed above, some embodiments according to the present disclosure provide a flashing light pattern that has distinct phases. FIG. 22 shows a general timeline for two phases of a light pattern according to an embodiment of the present disclosure. FIG. 22 shows the timeline for light produced from LEDs of three separate colors, Blue, Red, and Green. Other embodiments of the present disclosure may have different color LEDs and may also have fewer than or more than three colors. Also note that the number of LEDs producing each color may also vary.

In FIG. 22, light pulses 2701 have a constant duration $\tau_d$ seconds, while other embodiments may have lights pulses with varying durations. FIG. 22 also shows that each phase has the same duration of $t_{phase}$ seconds, while other embodiments according to the present disclosure may have phases that vary in duration. FIG. 22 depicts the difference between a periodic phase, Phase 1, and a random or pseudorandom phase, Phase 2. In a periodic phase, the time spacing $t_f$ from the start of one light pulse 2701 to the start of the next light pulse 2701 is the same. Hence, the pulses repeat at a frequency of $1/t_f$. In a random or pseudorandom phase, the time spacing $t_{rx}$ from one pulse 2701 to the next pulse 2701 varies in a random or pseudorandom manner. Note that while FIG. 22 shows a pattern having five light pulses in each phase, each phase will typically comprise more than five light pulses. Note also that the overall light pattern may comprise repeating the phases after the phase sequence is completed.

Some embodiments according to the present disclosure have pulse frequencies of the periodic phases between 5 and 15 Hz, with some frequencies between 7 and 9 Hz. For example, one preferred frequency may be 7 Hz. In a periodic phase, the frequency remains generally fixed throughout the phase. The time spacing for pulses in random or pseudorandom phases also preferably fit within pulse frequencies between 5 Hz and 15 Hz. That is, the time spacing of random pulses vary between 0.066 seconds and 0.2 seconds. The duration of each phase is preferably between 3 seconds and 15 seconds. The duration $\tau_d$ of the light pulses is generally such that the duty factor of the light pulses is less than 50%.

FIG. 22 illustrates a first phase where all or substantially all of the light emitting elements are flashed on and off in a periodic manner for some duration of time. This first phase takes advantage of the flashblindness and other incapacitating effects described above by irradiating a subject with a flashing pattern. The random second phase of flashing all or substantially all of the light emitting elements in a random fashion has an incapacitating effect due to the bright flashing light that has a random periodicity within the frequency range of 5 Hz and 15 Hz.

Figure 23:
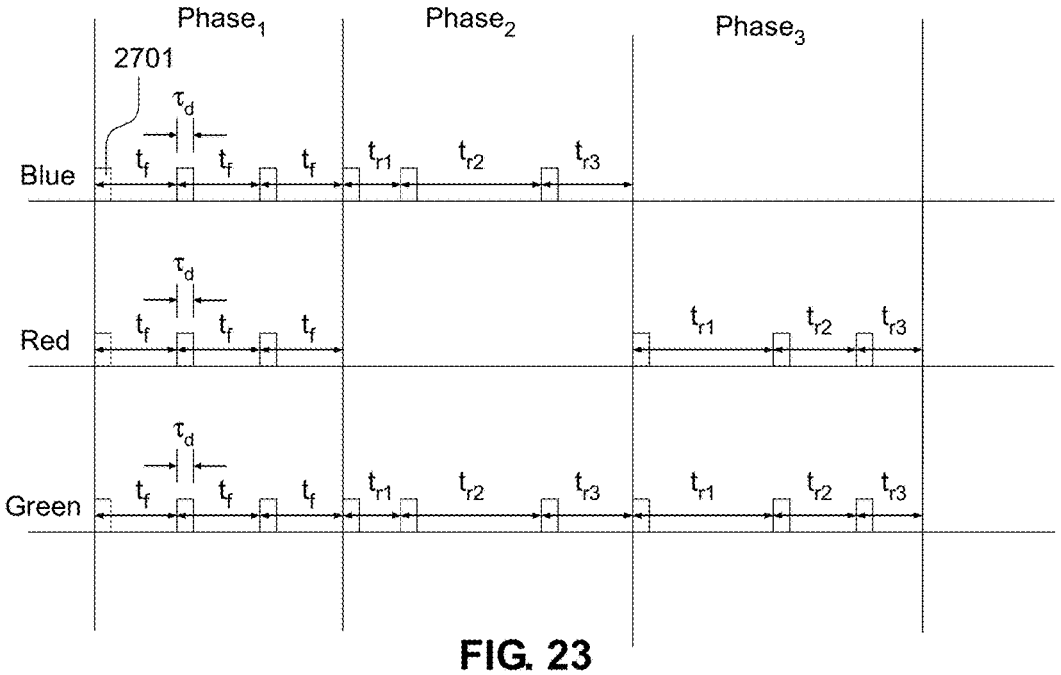
FIG. 23 shows a three phase light pattern.

FIG. 23 illustrates a three phase light pattern. The first phase comprises flashing on and off all or substantially all of the light emitting elements in a periodic manner. The second phase comprises a phase with a different duration than the first phase where two of three colors are flashed in a random manner. The third phase comprises another phase having a different duration than the first phase where a different two of the three colors are flashed in a random manner.

Figure 24:
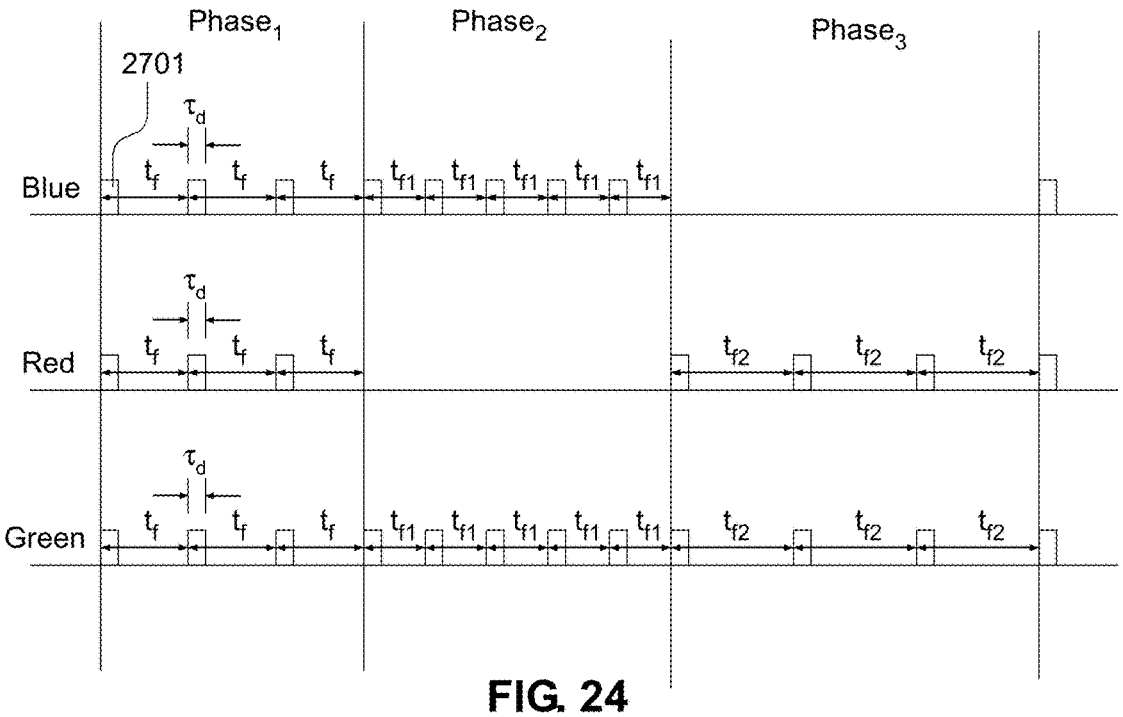
FIG. 24 shows another three phase light pattern.

FIG. 24 illustrates another three phase pattern. The first phase again comprises flashing on and off all or substantially all of the light emitting elements in a periodic manner. The second phase comprises periodically flashing two of three available colors at a first frequency, where the first frequency is preferably at a frequency near the lower bound or the upper bound of the frequency range. The third phase comprises periodically flashing a different two of three available colors at a second frequency, where the second frequency is preferably at a frequency near the opposite bound of the frequency range from the first frequency.

FIGS. 22, 23, 24 do not illustrate all of the light patterns that may be used by embodiments according to the present disclosure. Table 6 shows some additional light patterns that may be used by some embodiments according to the present disclosure, but Table 6 does not show all of the light patterns that may be used by embodiments of the present disclosure. In general, each phase of a light pattern differs from an adjacent phase in the power, frequency, and/or color output by the apparatus during the phase. This variation in phases is performed to overcome any adaptation by a subject to the flash pattern in any one phase.

TABLE 6

| Pattern | Phase 1 | Phase 2 | Phase 3 | Phase 4 | Phase 5 | Phase 6 | Phase 7 |
|---|---|---|---|---|---|---|---|
| 1 | All colors pulsed periodically | All colors pulsed randomly | | | Repeat phases 1 and 2 | | |
| 2 | All colors pulsed periodically | Cyan and red pulsed randomly | Blue and red pulsed randomly | | Repeat phases 1-3 | | |
| 3 | All colors pulsed periodically | Blue and cyan pulsed randomly | Cyan and red pulsed randomly | | Repeat phases 1-3 | | |
| 4 | All colors pulsed periodically | Red and cyan pulsed periodically at a low freq (pref. 5 Hz) | Cyan and blue pulsed periodically at a high freq (pref. 15 Hz) | | Repeat phases 1-3 | | |
| 5 | All colors pulsed periodically | All colors pulsed randomly | Cyan pulsed periodically (pref. 7 Hz) | Blue pulsed periodically (pref. 7 Hz) | Red pulsed periodically (pref. 7 Hz) | Repeat phases 1-5 | |
| 6 | All colors pulsed periodically | Cyan and red pulsed randomly | Blue and red pulsed randomly | All colors pulsed randomly | | Repeat phases 1-4 | |
| 7 | All colors pulsed periodically | Cyan and red pulsed randomly | Cyan and blue pulsed randomly | All colors pulsed randomly | | Repeat phases 1-4 | |
| 8 | All colors pulsed periodically | Red and cyan pulsed periodically at a low freq (pref. 5 Hz) | Cyan and blue pulsed periodically at a high freq (pref. 15 Hz) | All colors pulsed periodically at a freq diff. than freq of phase 1 | | Repeat phases 1-4 | |

TABLE 6-continued

| Pattern | Phase 1 | Phase 2 | Phase 3 | Phase 4 | Phase 5 | Phase 6 | Phase 7 |
|---|---|---|---|---|---|---|---|
| 9 | All colors pulsed periodically (pref. 7-9 Hz) | All colors pulsed randomly (pref. 5-15 Hz) | First color pulsed periodically | All colors pulsed randomly (pref. 5-15 Hz) | Second color pulsed periodically | All colors pulsed periodically | Third color pulsed periodically |

Human tests have shown that a combination of colored and white light flashes may be more effective in incapacitating a subject than either colored flashing light or white flashing light alone. Human tests have also shown that the most effective colors may be cyan and orange close to red. Human tests also indicate that incapacitation may be further increased when the colors and white light are flashed in a constant flashing mode rather than a random flashing mode. As indicated above, some embodiments according to the present disclosure may provide for white light generation by using outputs from three colored LED segments or have a fourth LED segment that outputs white light.

Figure 25:
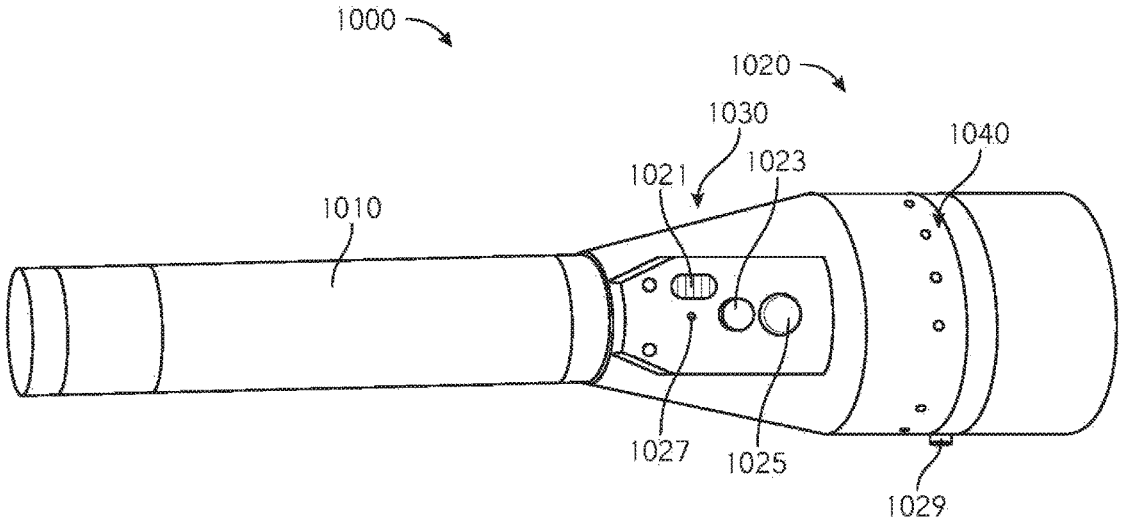
FIG. 25 shows an incapacitator according to an embodiment of the present disclosure.
Figure 26:
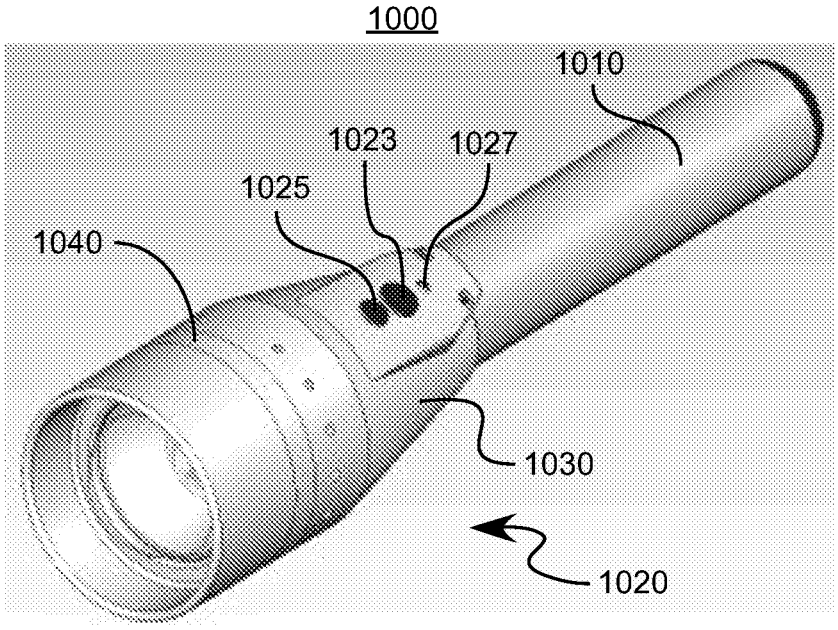
FIG. 26 shows a perspective view of an incapacitator.

An incapacitator according to an embodiment of the present disclosure is depicted in FIG. 25. As shown in FIG. 25, the incapacitator 1000 has a general "flashlight" shaped body, with a handle 1010 that is sized to be gripped by a single hand and a larger sized head 1020. The head 1020 may comprise an electronics housing 1030 and an optical housing 1040. The handle 1010 may contain a battery for supplying energy for the operation of the incapacitator 1000. The head 1020 may have switches 1023, 1025 used for controlling the incapacitator 1000. For example, one switch 1023 may be used to enable the "flashlight" mode described above. The other switch 1025 may then be used to trigger the incapacitating mode of the incapacitator 1000. An indicator 1027 may be used to provide status on the state of the incapacitator 1000, as described in additional detail below. A programming port 1021 may be used to provide access to electronics within the incapacitator 1000 to update or change programming used within the device, as described in additional detail below. In alternative embodiments, the programming port 1021 may be disposed within the head 1020 and accessible only when the handle 1010 is removed. The incapacitator 1000 may also have a set screw 1027 or other adjustable fastener to allow positions of a lens or lenses within the incapacitator 1000 as described in additional detail below. FIG. 26 shows a perspective view of the incapacitator 1000.

Figure 27:
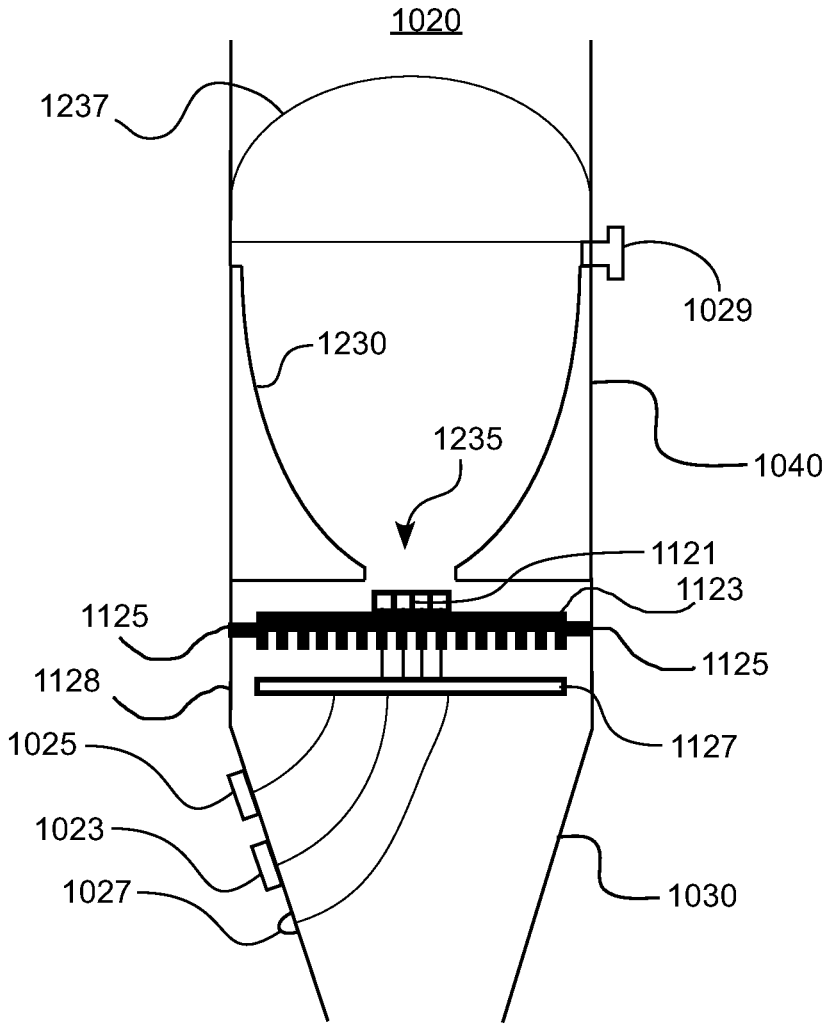
FIG. 27 shows a cross-section of an incapacitator head.

FIG. 27 shows a cross-section of the incapacitator head 1020 with the electronics housing 1030 and optical housing 1040 according to an embodiment of the present disclosure. The optical housing 1040 contains a reflector 1230 with an opening 1235 positioned above a light emitting apparatus 1121. The reflector 1230 and opening 1235 are oriented to direct light from the light emitting apparatus 1121 towards a lens 1237. The electronics housing 1030 comprises the light emitting apparatus 1121 and an electronics circuit 1127. The light emitting apparatus 1121 is preferably positioned on a heat sink 1123 in a fashion to conduct excess heat away from the light emitting apparatus 1121. Further, the heat sink 1123 may also contain one or more additional mechanical structures 1125 to conduct heat from the heat sink 1123 to a shell 1128 surrounding the electronics housing 1030. Preferably, the heat sink 1123, mechanical structures 1125, and/or the shell 1128 are fabricated from materials conducive to heat conduction, such as metal. The optical housing 1030 may also comprise heat conductive material to further facilitate heat dissipation. The electronics circuit 1127 receives inputs from the switches 1023, 1025 and controls the light emitting apparatus 1121.

Similar to apparatus 2100 described above, the light emitting apparatus 1121 may comprise a light emitting diode array for operating in both the flashlight mode and the incapacitating mode. Preferably, the light emitting diode array comprises a four element array having three colored light emitting substrate areas and a fourth substrate area emitting white light. The light emitting diode array may comprise a high brightness multiple-color LED module, such as the Phatlight CBT-380RGBW module from Luminus Devices. FIG. 28 depicts the Phatlight CBT-380RGBW module. Table 7 below shows the radiant power versus current that may be obtained from the CBT-380RGBW module.

TABLE 7

| | Parameters/Chip | | | | | | | |
|---|---|---|---|---|---|---|---|---|
| | Red | | Green | | White | | Blue | |
| | Chip Size | | | | | | | |
| | 4.6 × 2.6 mm | | 4.6 × 2.6 mm | | 3 × 3 mm | | 2.0 × 2.7 mm | |
| Output | R.power (W) | Flux (lumen) | R.power (W) | Flux (lumen) | R. (W) | Flux (lumen) | R.power (W) | Flux (lumen) |
| 3.2 A | | | | | | 510 | | |
| 4 A | | | | | | | 1.88 | 115.6 |
| 6 A | 2.34 | 443 | 2.09 | 1089 | | | 2.57 | 154.5 |
| 8 A | | | | | | | 3.12 | 185 |
| 9 A | 3.29 | 599 | 2.89 | 1481 | | 650-1350 (depends on the bin code) | | |
| 12 A | 4 | 703 | 3.46 | 1795 | | | | |
| 13.5 A | | | | | | 1500 | | |
| 18 A | 5.26 | 936 | 4.05 | 2044 | | | | |
| 30 A | 8.2 | 1478 | 6.8 | 3327 | | | | |

Figure 29A:
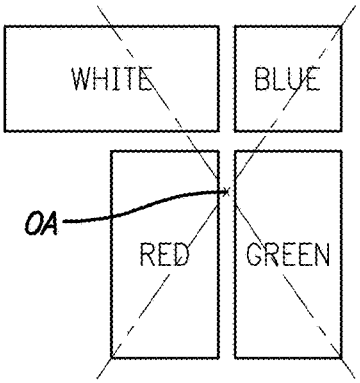
FIGS. 29A-29E depict possible arrangements of colored LED arrays on LED modules.
Figure 29B:
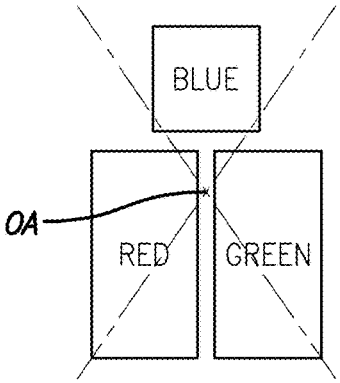
Figure 29C:
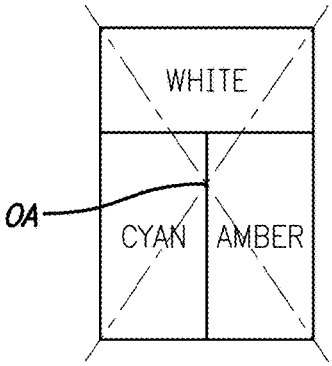
Figure 29D:
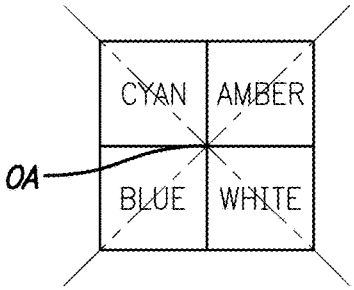
Figure 29E:
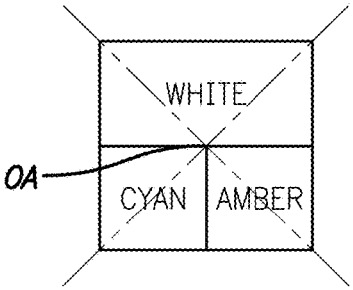

FIG. 29A depicts the arrangement and relative size of the light emitting areas on the CBT-380GBW module. In FIG. 29A, the rectangular areas depict LED arrays of 4.6×2.6 mm and the square areas depict LED arrays of 2.6×2.6 mm. FIGS. 29B-29E depict other arrangements of LED arrays where the rectangular areas again depict LED arrays of 4.6×2.6 mm and the square areas depict LED arrays of 2.6×2.6 mm. The LED array will be placed as shown with respect to the optical axis OA for the lens system so that each LED is spaced away from the optical axis. The LED array is placed relative to the optical axis (OA) such that the OA is centered at the diagonals from the outer corners of the LEDs as shown in FIG. 29A. FIG. 29B shows a similar configuration with three LED dies. For FIGS. 29A and 29B, the spacings S are 0.15 to 0.2 mm. FIGS. 29C-29E depict arrays using amber and cyan colored LED arrays rather than red and green. They may be similarly spaced as in FIGS. 29A and 29B, or as depicted, they may be substantially adjacent. Those skilled in the art will understand that other arrangements of LED arrays, sizes of LED arrays, and other colors of LED arrays than those depicted in FIGS. 29A-29E may be used in accordance with some embodiments of the present disclosure.

Returning to FIG. 27, the reflector 1230 preferably has a shape and dimensions to concentrate and focus light at a desired distance from the incapacitator 1000. As discussed above, a parabolic radiator, such as that depicted in FIG. 20, provides light direction and focus with desirable characteristics. Simulated results and achieved using a model of the reflector depicted in FIG. 20 with the CBT-380RGBW module are presented in Table 8 below. Note that these simulated results are obtained from a LED flash frequency of 5 Hz, with an on time of 20 msec, and a target distance of 2 m. Note, however, reflectors of other shapes and dimensions may also provide desirable characteristics, depending upon such parameters as size of the light emitting element and the desired focus and distance at which light focus is to be maintained. Note that for certain applications, the reflector 1230 may be used without a lens 1237 in the incapacitator head 1020.

TABLE 8

| Par/LEDs | | Blue | Red | Green | White | Combination | Comments |
|---|---|---|---|---|---|---|---|
| Current (A) | | 8 | 12 | 12 | 9 | 41 max | |
| Radiant Power (W) | simulation | 0.5 | 1 | 1 | 1 | | |
| | specification | 3.1 | 3.42 | 3.4 | | | |
| Luminance Flux (Lm) | specification | 190 | 600 | 1700 | 1100 | | |
| Illuminance (lux) | measurement | | | | 2100 | | |
| Irradiance ($mW/cm^2$) | simulation | 0.2 | 0.53 | 0.53 | 10200* | | *illuminance (lux) |
| | theoretical | 0.62 | 1.81 | 1.8 | | | |
| | measurement #1 | 0.75 | 1.38 | 0.7 | 0.37 (460 nm) | 5.2 | refl. closer to chip |
| | measurement #2 | 0.54 | 1.0 | 1.22 | 1.57 (460 nm) | 5.9 | refl. in calculated position |
| Spot Size (cm × cm) | simulation | 7.5 × 10 | 2.5 × 5 | 2.5 × 5 | 5 × 7.5 | 25 × 25 | at the brightest spot |
| | measurement | 38 × 38 | 25 × 25 | 25 × 25 | 34 × 34 | 30 × 30 | spot distributed |
| Divergence Angle (°) | simulation | 2.3 | 1 × 1 | 1 × 1 | 1.6 × 2.5 | 6.8 × 6.8 | |
| | measurement | 11 | 7 | 7 | 9.7 | 8.6 | |
| Spot Separation | simulation | 120 | 50 | 50 | 100 | large | |
| | measurement | | | | | | distributed |

Figure 30A:
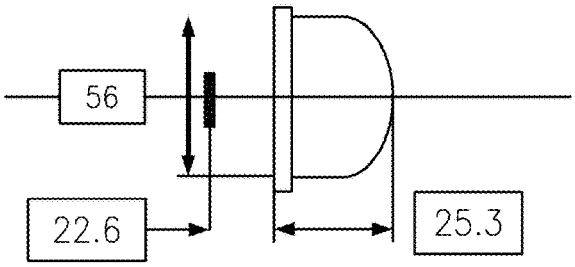
FIG. 30A depicts a Commercial-Off-the-Shelf lens.
Figure 30B:
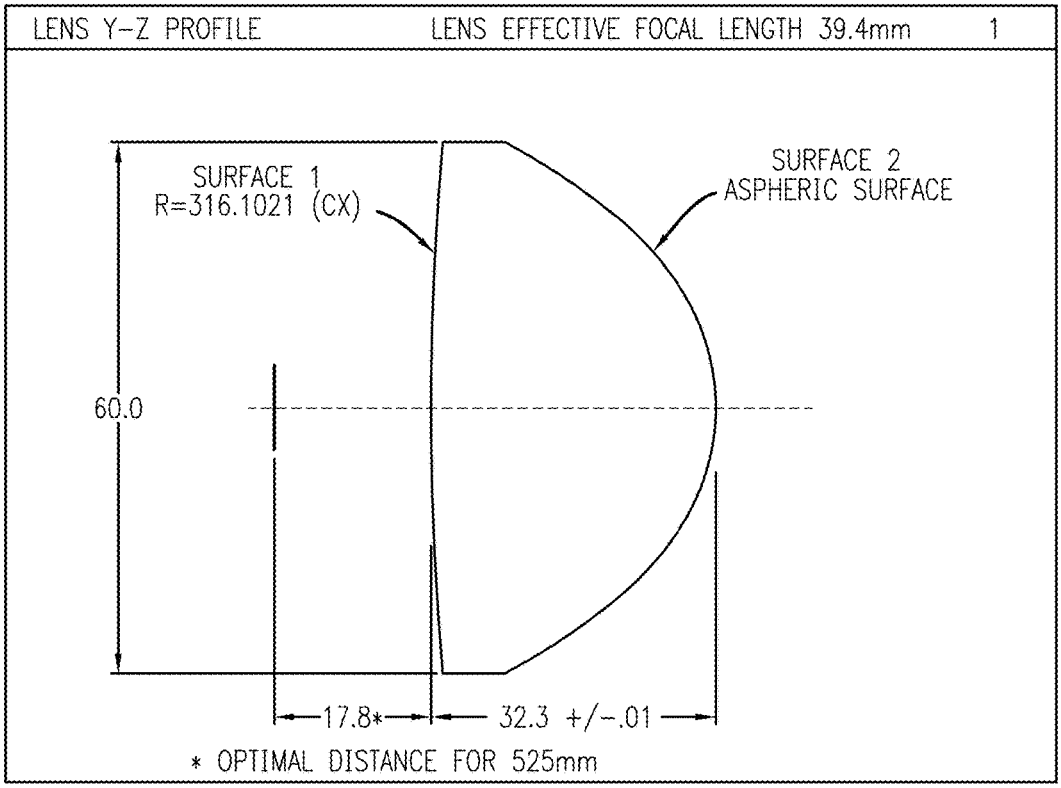
FIG. 30B depicts an aspheric lens.

The lens 1237 in the incapacitator head 1020 may also be used to concentrate and focus light. The lens may be an aspheric lens such as that depicted in FIG. 19 above. FIG. 30A shows a COTS lens with a diameter of 56 mm, a back focal length of 22.6 mm, and a thickness of 25.3 mm available from JML Optical Industries, Inc. with characteristics near the desired characteristics. FIG. 30B depicts an aspheric lens with characteristics near the desired characteristics. Particular exemplary parameters for the aspheric lens of FIG. 30B are shown in Table 9 below. This lens gives about 2 to 2.5 times higher power than the lens shown in FIG. 19.

TABLE 9

| Notes for Aspheric Convex-Convex Lens as in FIG. 30B |
|---|
| NOTES:<br>1. ALL DIMENSIONS ARE IN MM.<br>2. MATERIAL: OPTICAL GRADE POLYSTYRENE OR REXOLITE<br>3. MINIMUM CLEAR APERTURES:<br>SURFACE "A" (PROXIMA) - 54.0 MM CLEAR APERTURE DIAMETER, SPHERICAL SURFACE<br>SURFACE "B" (DISTAL) - 60 MM DIAMETER, ASPHERICAL SURFACE |

TABLE 9-continued

Notes for Aspheric Convex-Convex Lens as in FIG. 30B

4. SURFACE "A": FIT TO REF. TEST PLATE OVER MINIMUM CLEAR APERTURE: POWER - 4 FRINGES.
5. SURFACE "B" IS ASPHERICAL
5.1 SURFACE "B" THE ASPHERIC EQUATION IS:

$$Z = \frac{Y^2/R}{1+(1-(k+1)\cdot Y^2/R^2)^{0.5}} + AY^4 + BY^6 + CY^8 + DY^{10}$$

WHERE:
Z - SAG
Y - SEMI APERTURE
R - VERTEX RADIUS OF CURVATURE (CX) = −24.595 ± 0.02
(SIGN OF RADIUS IS NEGATIVE)
K - CONIC CONSTANT = −1.00 ± 0.02
A - $4^{TH}$ ORDER COEFFICIENT = (−8.28266 ± 0.02) E-06
B - $6^{TH}$ ORDER COEFFICIENT (−1.339242 ± 0.003) E-09
C - $8^{TH}$ ORDER COEFFICIENT = (+3.42497 ± 0.007) E-12
D - $10^{TH}$ ORDER COEFFICIENT = (−3.367105 ± 0.007) E-16
6. SURFACES QUALITY:
SURFACES "A" AND "B": SCRATCH AND DIG 60-40.
SURFACES "A" IRREGULARITY - 1 FRINGE P-V (λ = 632.8 NM).
SURFACE "B": SURFACE ROUGHNESS - 0.01 μm RMS
SURFACE "B" IRREGULARITY RELATIVELY TO REFERENCE ONE DEFINED BY EQUATION 5.1 IS 1 FRINGE (λ = 632.8 NM)
7. CENTERING: MAXIMUM EDGE THICKNESS VARIATION TO BE 0.03 MM T.I.R. OVER CLEAR APERTURE DIAMETER.
OPTIONAL:
SURFACES "A" AND "B" COATED WITH HIGH EFFICIENCY ANTIREFLECTION COATINGS.

Table 10 below shows simulated results using a lens such as that depicted in FIG. 30A and measured results using a lens such as that depicted in FIG. 30B with the CBT-380RGBW module. The results are again based on a LED flash frequency of 5 Hz, with an on time of 20 msec, and a target distance of 2 m. As shown in Tables 8 and 10, the lens generally produced more concentrated and brighter light.

TABLE 10

| Par/LEDs | | Blue | Red | Green | White | Combination | Comments |
|---|---|---|---|---|---|---|---|
| Current (A) | | 8 | 12 | 12 | 9 | 41 max | |
| Radiant | simulation | 0.5 | 1 | 1 | 1 | | |
| Power (W) | specification | 3.1 | 3.42 | 3.4 | | | |
| Luminance Flux (Lm) | specification | 190 | 600 | 1700 | 1100 | | |
| Illuminance (lux) | measurement | | | | 14820 | | |
| Irradiance ($mW/cm^2$) | simulation | 1.9 | 1.9 | 1.9 | 38000* | | *illuminance (lux) |
| | theoretical | 5.89 | 6.5 | 6.46 | | | |
| | measurement | 5.7 | 4.2 | 3.15 | 3.17 (460 nm) | 14.25 (R3.8, G3.17, B4.57, W2.7) | |
| Spot Size (cm × cm) | simulation | 16 × 12 | 25 × 12.5 | 25 × 12.5 | 23 × 23 | | |
| | measurement | 15 × 10 | 25 × 13 | 24 × 15 | 18 × 18 (26 × 26) | | |
| Divergence Angle (°) | simulation | 5.1 × 5.0 | 6.8 × 3.4 | 6.8 × 3.4 | 6.6 × 6.6 | | |
| | measurement | same | same | same | same | | |
| Spot Separation (cm) | simulation | 14 | 12.5 | 12.5 | 10 | | |
| | measurement | 21 | 16 | 6 | 20 | | installation |

As briefly discussed above, one mode of operation of the incapacitator 1000 may be a "flashlight" mode, where only the white LED area is turned on to produce white light with a flashlight-like effect. Table 11 presents a comparison of the results achieved from directing light from the white LED area of the CBT-380RGBW module (at various currents) using a reflector or lens with the conventional white flashlights. Table 10 again, shows the brighter light obtained from using a lens.

TABLE 11

| Device/Parameters | Current | Spot Size (In.) | Irradiance at 2 m (lux) |
|---|---|---|---|
| LEDI-3, Lens | 1 A | 7 × 7 | 2,722 |
| | 4.2 A | 7 × 7 | 8,509 |
| | 9 A | 7 × 7 | 14,870 |
| LEDI-3, Reflector | 1 A | ≈12 × 12 | 460 |
| | 4.2 A | ≈12 × 12 | 1,330 |
| | 9 A | ≈12 × 12 | 2,100 |
| StreamLight Q5 | | 9 × 9 | 3,000 |
| | | 5 × 5 bright 14 × 14 total | 5,200 |

Aspheric lenses may be relatively expensive to fabricate or purchase. A suitable alternative lens may be a Fresnel lens. A Fresnel lens may have a larger spot due to a shorter focus, but may provide good color mixing when defocused. Overall, the Fresnel will generally provide less light than an aspheric lens, but a Fresnel lens should be much less expensive to fabricate. Table 12 below presents a comparison of test results obtained from an aspheric lens and a Fresnel lens.

TABLE 12

| Color/ | Aspheric Lens | | Fresnel Lens | | | | |
|---|---|---|---|---|---|---|---|
| Parameter | Spot | | Spot | | Power Drop | | |
| Screen at 2 m | Size (in.) | Irradiance mW/cm$^2$ | Size (in.) | Irradiance mW/cm$^2$ | Theory | Experiment | Unspecified Losses |
| Red | 6 × 11 | 6.6 | 8 × 13 | 3.1 | 63% | 46% | 17% |
| Green | 6 × 11 | 4.8 | 8 × 12 | 2.6 | 67% | 54% | 13% |
| Blue | 6 × 6 | 10.04 | 6 × 8 | 5.7 | 78% | 57% | 21% |
| White | 6.5 × 6 | 7.8 | 7 × 8 | 4.1 | 69% | 53% | 16% |

Further improvements may be made to the lens by using an antireflection coating on the lens. Table 8 shows the results obtained with a hard antireflection coating on the aspheric lens described above. As shown in Table 13, a gain of around 8-9% was achieved due to the coating.

TABLE 13

| Color | Uncoated Lens Irrad (mW/cm$^2$) | Coated Lens Irrad (mW/cm$^2$) |
|---|---|---|
| White | 6.7 | 8.6 |
| Red | 5.3 | 5.8 |
| Green | 4.4 | 5.23 |
| Blue | 11.5 | 12.5 |

Returning again to FIG. 27, the set screw 1027 may be used to adjust the position of the lens 1237, based on the desired focusing point of the incapacitator. For example, the set screw 1027 may be loosened to allow the lens 1237 to be moved forward or back while the incapacitator 1000 is operated and the emitted beam is observed. When the desired beam mixing is seen, the set screw can be tightened to hold the lens 1237 in place. If the concentrated beam setting is desired, the set screw 1027 can be loosened to allow the lens 1237 to return to its original position. In other embodiments, a sliding mechanism may be used in place of the set screw 1027, to allow a user to slide the lens 1237 forward or back to achieve a desired focusing or defocusing of the emitted light beam.

In some embodiments according to the present disclosure, a light beam may be configured to produce a square or rectangle around the illuminated target. As discussed above, light emitting areas may be configured as square or rectangular arrays. The reflector and/or lens within the incapacitator may be configured to radiate light to maintain the square or rectangular shape of the light emitting area so that the beam pattern on a target is also square or rectangular. A square or rectangular beam pattern may facilitate the identification and tracking of a target with a light beam. However, as discussed above, the position of the lens 1237 may be changed to defocus the beam to produce more of a circular pattern, such as the beam seen with a typical flashlight.

As described above, the incapacitating mode generally involves the flashing of lights of different colors at the eyes of an intended target. In one embodiment, light is directed such that one eye receives light of one color and the other eye receives light of another color. Therefore, it is preferable that the reflector 1230 and/or lens 1237 of the incapacitator 1000 be configured so that the light coming from the different colored light emitting areas not be totally combined, but that the target perceives the light as coming from spatially separated locations. The target will then perceive the flashing light coming from the incapacitator as "bouncing" back and forth between two separate locations along with a different color in each eye.

Figure 31:
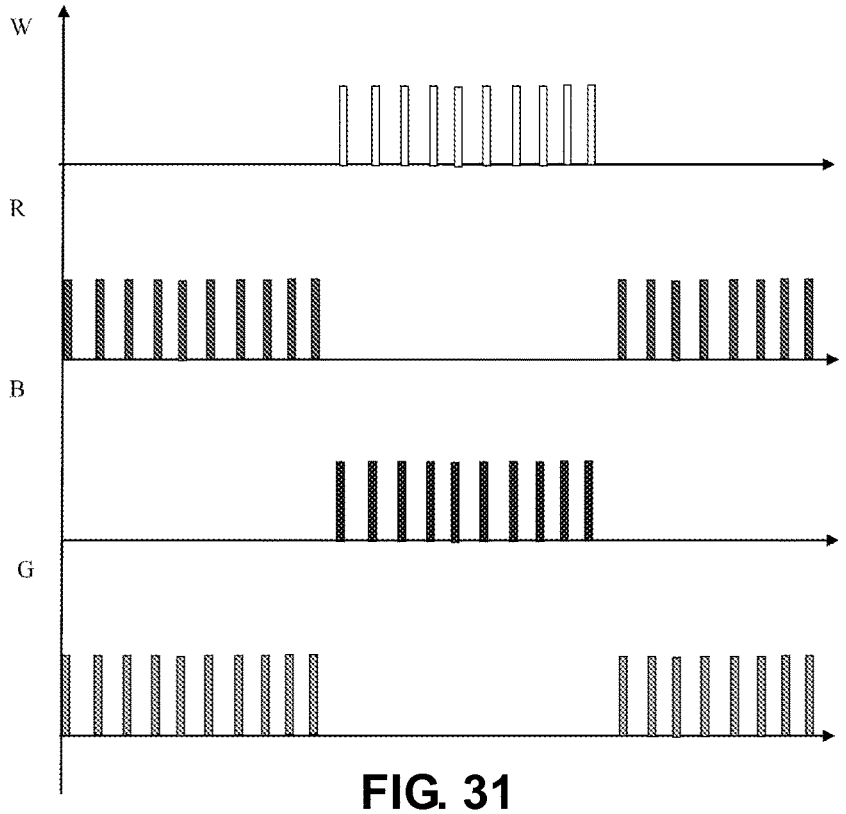
FIG. 31 shows a flash pattern that may be useful in incapacitating a single individual.

The incapacitating mode flashes light with a desired pattern. The patterns may differ depending upon whether it is desired to incapacitate an individual in a stand-off situation or impact multiple people in a crowd. FIG. 31 shows a pattern that may be useful in incapacitating a single individual. In FIG. 31, the flashing pattern is: red (shown by the row labeled R) and green (shown by the row labeled G) colors flash simultaneously for 5 seconds; followed by blue (shown by the row labeled B) and white (shown by the row labeled W) colors flashing for 5 seconds; than the flashing pattern repeats. The on duration for each flash is preferably 25 ms, but may be longer or shorter. Note again that with this flashing pattern, it is preferable that the light from the incapacitator be directed such that one eye receives light of one color and the other eye receives light of the other color. Incapacitators according to embodiments of the present disclosure are not limited to the pattern depicted in FIG. 31.

Other patterns may also be useful in affecting a target individual. Although different patterns of flashing have been explained, one variable is significant for all patterns and that is that greater intensity results in greater incapacitating effect.

Figure 43A:
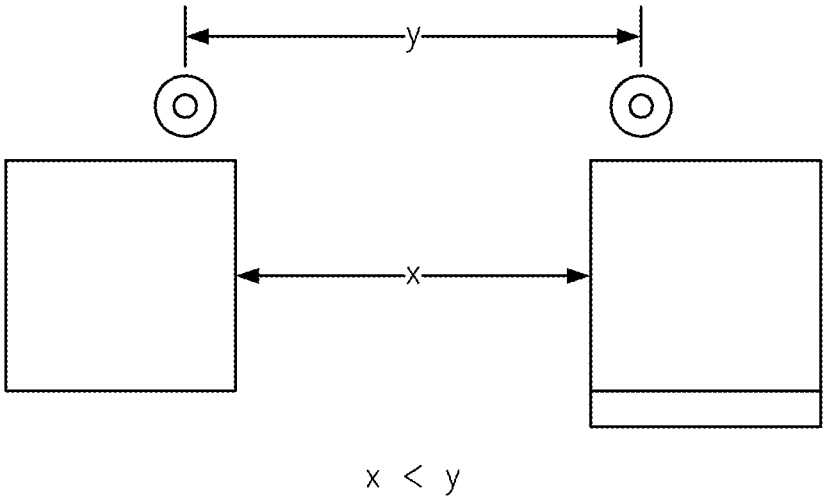
FIGS. 43A and 43B show the exposure of different light spots on each eye within a range of distance.
Figure 43B:
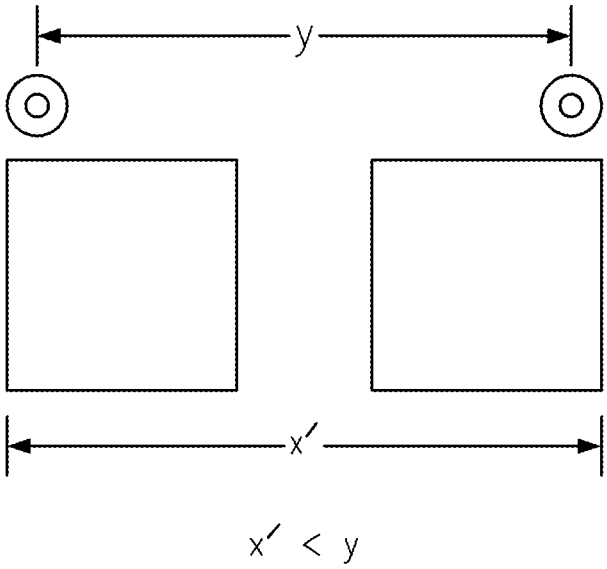

In order to effect having one eye receiving one color and the other eye receiving another color certain variables must be determined and/or assumed. The color images must be separated when received by the target individual. First, the field operating desired range or working distance for law enforcement with respect to an individual is about 7 to about 21 feet. An interpupillary distance of about 68-72 mm is assumed. Therefore the left/right separation of dies should be in the range of about not less than about 0.15 mm. FIGS. 43A and 43B illustrate how the separated color can be implemented for a given distance range. In FIG. 43A at the maximum distance, the separation x of the light spots must be somewhat less than the interpupillary distance Y. In FIG. 43B there is illustrated the configuration for a minimum distance in which the distance x' to the outer edges of the light spots must be somewhat greater than the interpupillary distance Y. For this type of individual target control operation, the same two LEDs are used in order to place the light spots in the eye during the pattern. A constant color selection is used for a time of 5-10 seconds. Then another two colors with the appropriate spacing on the targets eyes is used. For example, in a first series, red and green and in a second series, blue and white. A flash rate of 8-9 Hz is used. Another flash sequence for this purpose is: (1) red and green at 11 Hz for 5 seconds; (2) white and blue at 7 Hz for 5 seconds; red and green at 7 Hz for 5 seconds white and blue at 11 Hz for 5 seconds. This pattern can then be repeated but with the frequency randomized.

In a single target situation, the square dies provide an officer the opportunity to target the individual and move in to overcome the target. An aspheric lens of the type in FIG. 30B with Effective Focal Length 39.4 mm provides the achievement of the goal. The optical parameters of the lens are defined to direct light to each eye individually within this range of distance and eye spacing. A specific aspheric lens design is outlined in Table 9. An angle of dispersion of from about 5° to about 5.5° can be achieved with such an aspheric lens.

Figure 32:
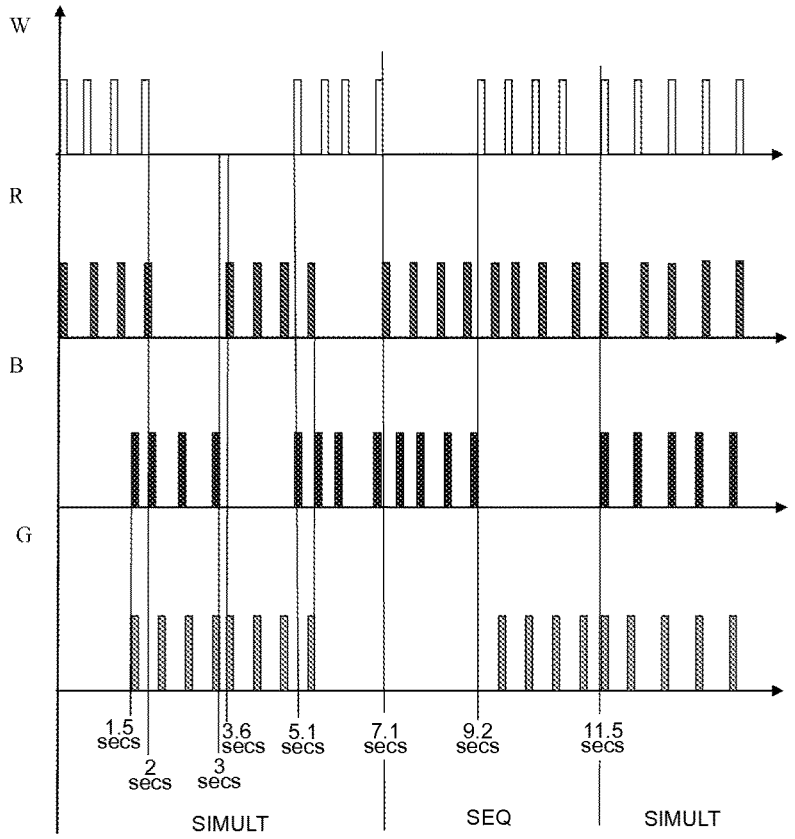
FIG. 32 depicts a pseudo-random pattern of various color pulses that may be useful for crowd control.

Other patterns may be useful in affecting groups of individuals for crowd control. FIG. 32 depicts a pseudo-random pattern of various color pulses over a 20 second time period. In FIG. 32, the row labeled R indicates red flashes; the row labeled W indicates white flashes; the row labeled B indicates blue flashes; and the row labeled G indicates green flashes. As shown in FIG. 32, there is a time period where multiple flashes may occur simultaneously, followed by a time period where the flashes may occur sequentially, and followed by another time period of simultaneous flashes. Again note that incapacitators according to embodiments of the present invention are not limited to the pattern depicted in FIG. 32 for crowd control. Other patterns may also be useful for crowd control. Also, this type of pattern is useful for individuals but lacking the color-eye separation feature.

As briefly discussed above, incapacitator 1000 may also have the capability to run in a "flashlight" mode. The "flashlight" mode may be provided by turning on only the white LED emitting area. Using the CBT-380RGBW module, the white LED provides an illumination of 24,142 lux at a distance of 2 meters when operated in constant current mode. This is four times higher than the best flashlights generally known in the art and available for purchase. However, to provide such illumination, active cooling of the CBT-380RGBW module may be necessary, which may not be acceptable in a handheld device. For the "flashlight" mode, the white LED area may be operated in a pulsed mode to decrease the power required and heat generated. Operation of the incapacitator 1000 in the "flashlight" mode may use a pulsed mode at a frequency of around 200 Hz, and at a duty cycle of approximately ⅕. At this frequency and duty factor, the incapacitator 1000 (using the aspheric lens described above) provides an average illuminance of 5,600 lux (with antireflection coated lens), which is close to that of the brightest flashlights. Moreover, the illuminated spot is generally larger than most commercial flashlights. The flashlight mode may also be programmed to operate in a full-power mode to provide maximum light from the incapacitator or an "energy saving" mode where less power (e.g. 50% of full power) is used, but the light from the incapacitator is also less. Duty factor settings between the full power and energy saving modes may be ⅙ and 1/12 or ⅓ and ⅙. Note that higher duty factors may result in operating times before a battery recharge or replacement is required.

Due to the currents needed to drive the high brightness LEDs, heat generation and dissipation is a concern in the fabrication and operation of incapacitators according to embodiments of the present invention. As shown in FIG. 27, the light emitting element 1121 is preferable disposed on a heat sink 1123 providing for dissipation of heat from the light emitting element 1121. Further, the heat sink 1123 may be coupled to other structures 1125 that allow for the conduction of heat to the surface of the incapacitator head 1120. The incapacitator head 1120 itself may also be made of metal to allow for additional heat conduction away from the light emitting element 1121. For example, the other structures 1125 may comprise a copper plate used to conductively couple the heat sink 1123 to the incapacitator head 1120. However, such heat conducting elements are generally constructed of relatively heavy metal, resulting in an overall increase in weight for the incapacitator.

Heat generated by the light emitting element 1121 may be reduced by controlling the operating time for the element 1121. For example, electronics within the incapacitator may be programmed to automatically turn off the light emitting element 1121 after 20 seconds of continuous operation or some other time duration. The cessation of operation after some predetermined time period allows the light emitting element some time to cool down and thus prevents heat-related damage from occurring to the light emitting element 1121 or other electronics within the incapacitator. The automatic shutoff may also lengthen battery operating time before requiring a recharge by essentially preventing the incapacitator from unintentionally being left on for long periods of time.

Further protection of the light emitting element 1121 or other incapacitator electronics may be provided by mounting a thermocouple or other temperature sensitive device at or near the light emitting element 1121. For example, a thermocouple may be used to trigger an automatic shutoff of the incapacitator 1000 if the temperature of the light emitting element 1121 reaches 70° C. or some other desired temperature. The light emitting element 1121 may require additional power electronics to drive its light emitters and the power electronics may also heat up during the operation of the incapacitator. Therefore, a thermocouple or other heat sensing device may be used to sense the heat from the power electronics in additional to or as an alternative to the thermocouple for the light emitting element 1121. The power electronics thermocouple would also trigger a shutdown of the device if a selected temperature is reached.

Figure 33A:
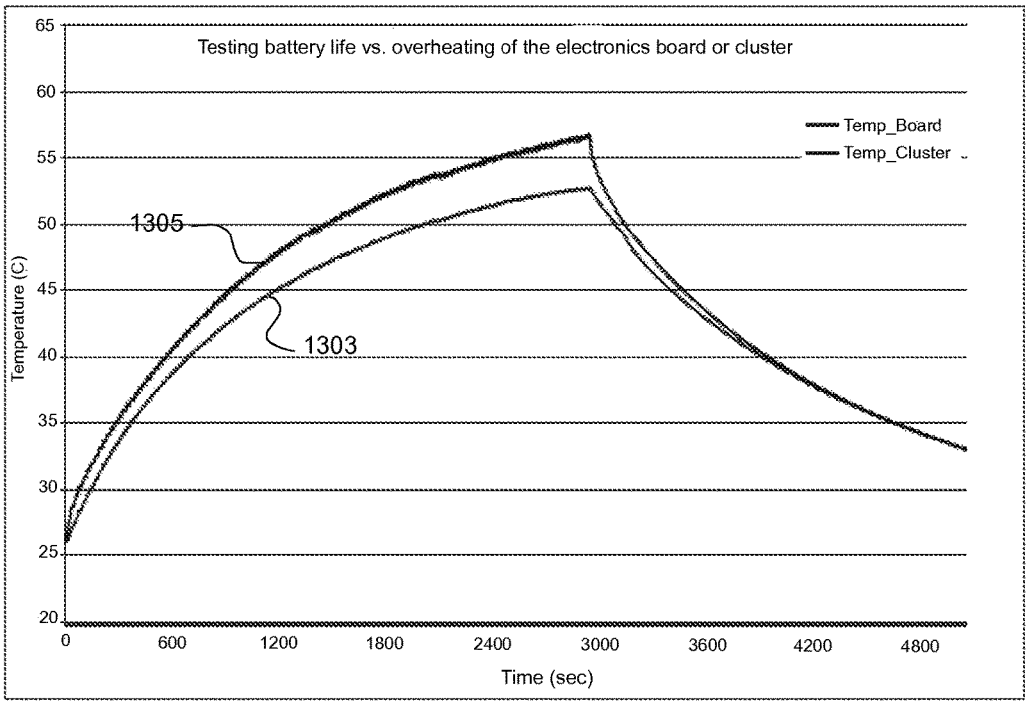
FIGS. 33A and 33B show temperature versus time results for an all metal body incapacitator.
Figure 33B:
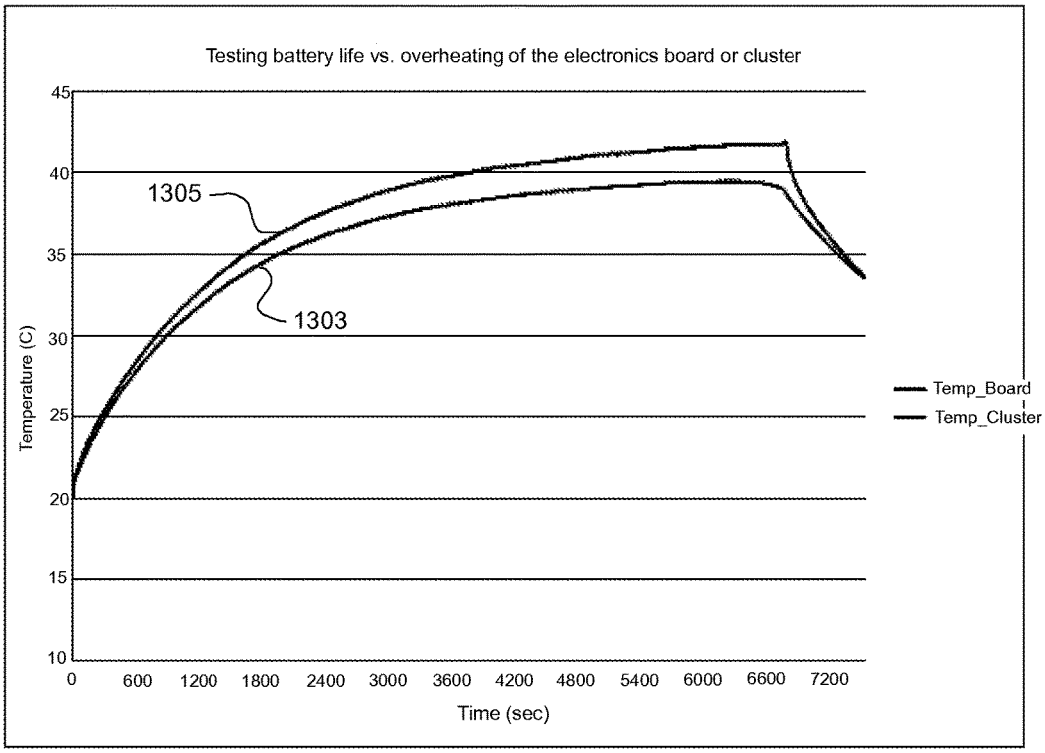

FIG. 33A shows the results of triggering several cycles of the crowd control pattern depicted in FIG. 32 in an incapacitator having a metal head and using the CBT-380RGBW module, until the unit reaches an automatic shutdown of 50% of battery capacity. Curve 1303 shows the temperature sensed on a power electronics board and curve 1305 shows the temperature sensed at the CBT-380RGBW module. The decline in temperature appears when the unit shuts off due to the battery capacity shutdown. FIG. 33B shows a similar set of curves when the incapacitator is operated in the flashlight mode. These graphs show that the battery was exhausted before the LED module or power electronics overheated. The graphs also show that the LED module warms a few degrees faster than the electronics.

Figure 34A:
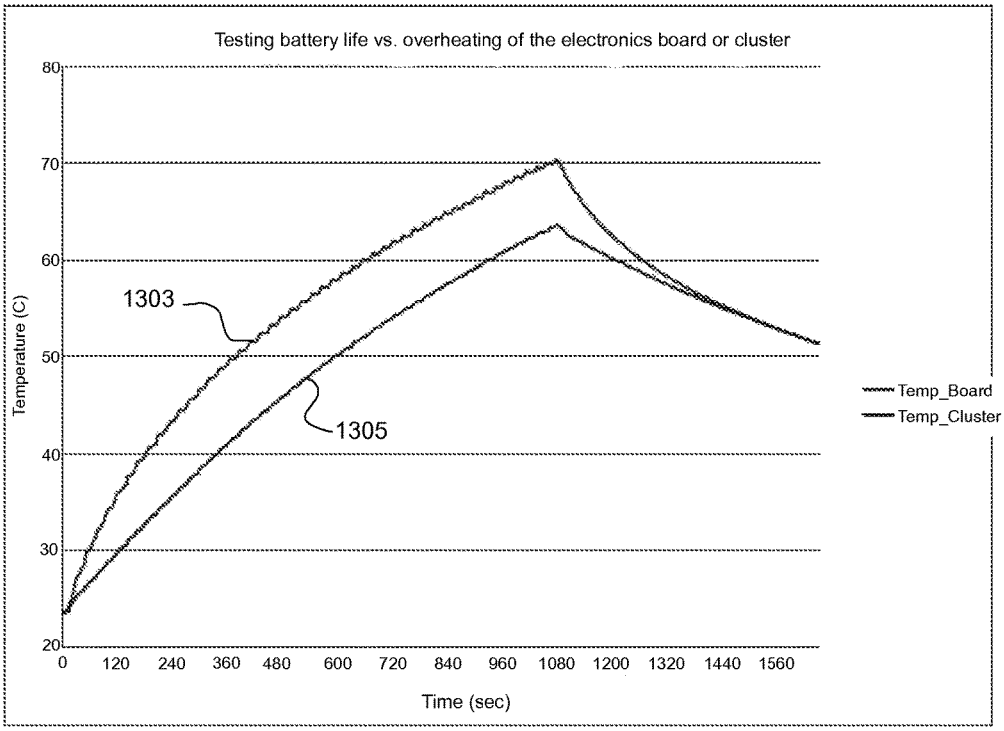
FIGS. 34A and 34B show temperature versus time results for a partially plastic incapacitator.
Figure 34B:
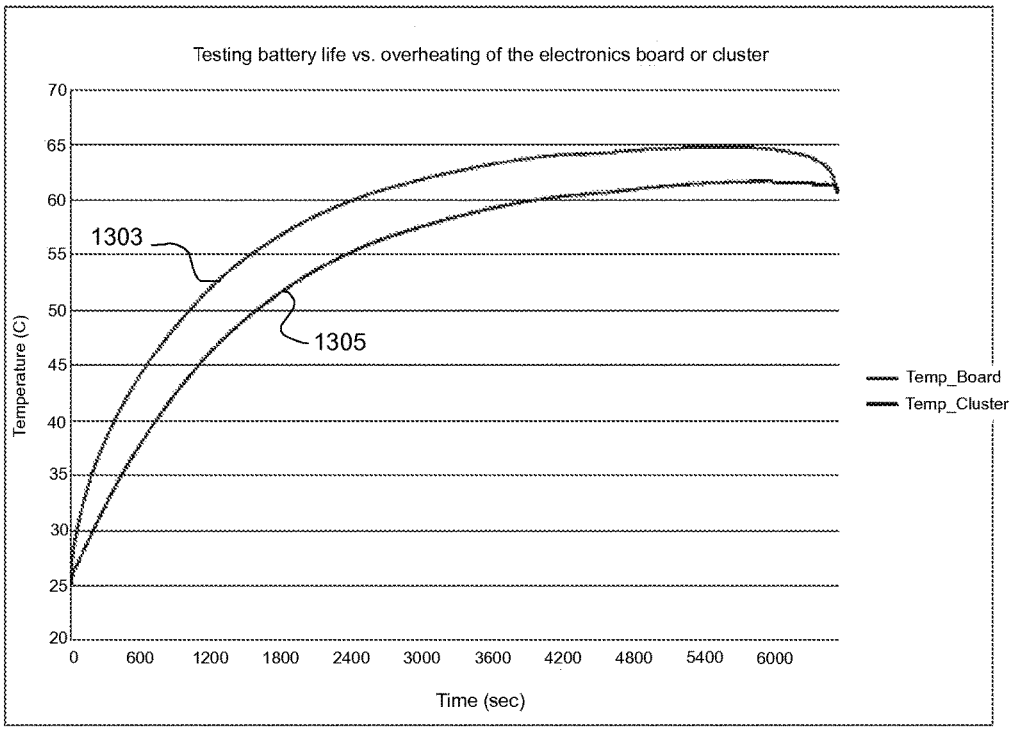

As discussed above, the overall weight of the incapacitator may be reduced by reducing the size and weight of the heat sink and/or other heat conducting structures within the incapacitator. These structures or portions of them may be replaced with structures made of plastic or other such lighter weight materials. Such materials may reduce the weight of the incapacitator, but may also reduce the heat conduction capabilities of the unit, resulting in thermal issues for the unit. FIGS. 34A and 34B show the temperatures at LED module and power electronics sensors using a similar test to that used for the results shown in FIGS. 33A and 33B for an incapacitator using plastic rather than metal for some structures and using a reduced weight heat sink. FIG. 34A shows that the power electronics board temperature (represented by curve 1303) actually heated up faster than the LED module temperature (represented by curve 1305) when the partially plastic incapacitator operated in the crowd control mode. FIG. 34B shows the temperatures when operating the partially plastic incapacitator in the flashlight mode. FIG. 34A shows that the thermal limits within the incapacitator were reached before the battery drained when operating the incapacitator in the crowd control mode. FIGS. 33B and 33B show that there was no significant difference in flashlight operating time between the all metal and partially plastic incapacitators.

Figure 35:
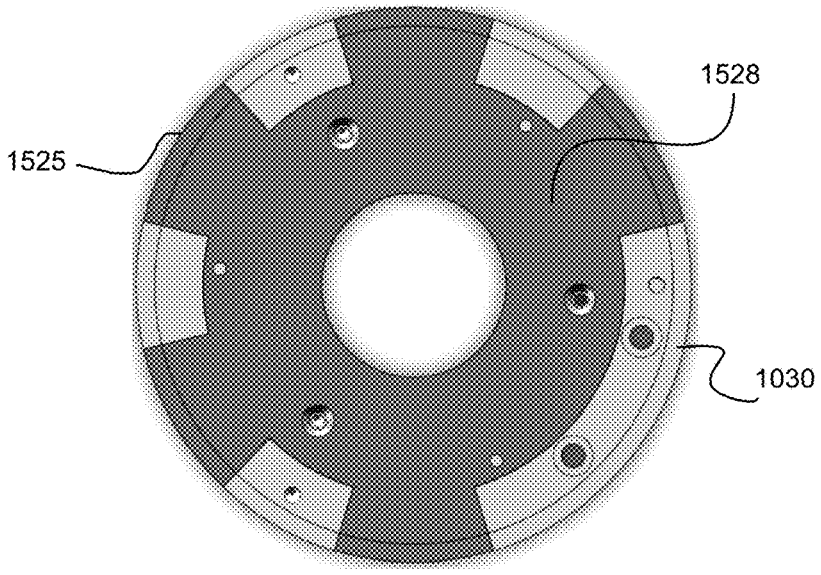
FIG. 35 shows a heat-dissipating ground plane.

As noted above, one method of dissipating heat from the head 1020 is provided by disposing a heat sink 1123 under the light emitting apparatus 1121 as shown in FIG. 27. However, as discussed above, the electronics circuit 1127 used to control the light emitting apparatus 1121 may itself be a significant source of heat. Therefore, some embodiments of the present invention may use a thick metal ground plane disposed beneath the electronics circuit 1127 to dissipate heat from the electronics circuit 1127. FIG. 35 shows a heat-dissipating ground plane 1528 disposed within the electronics housing 1030. The ground plane 1528 may comprise copper, a copper allow, or other metal or other materials providing appropriate electrical grounding and heat dissipation. The electronics circuit 1127 (not shown in FIG. 35) is then disposed upon the ground plane 1528 to allow heat to be conducted away by the ground plane 1528. The heat dissipation is facilitated by tabs 1525 that project from the ground plane 1528 to the external surface of the electronics housing 1030. This allows heat from the electronics circuit 1127 disposed on the ground plane 1528 to be conducted to the external ambient environment of the electronics housing 1030. The ground plane 1528 may also be configured to conductively couple to the light emitting apparatus 1121 (not shown in FIG. 25) and/or a heat sink conductively coupled to the light emitting apparatus 1121 to allow the ground plane 1528 to also conduct heat away from the light emitting apparatus 1121.

Figure 36A:
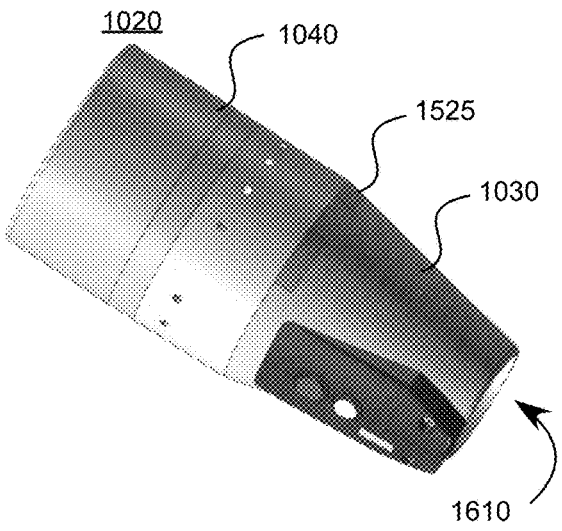
FIG. 36A shows an incapacitator head using a heat-dissipating ground plane and using internal coupling for attaching a handle to the head.
Figure 36B:
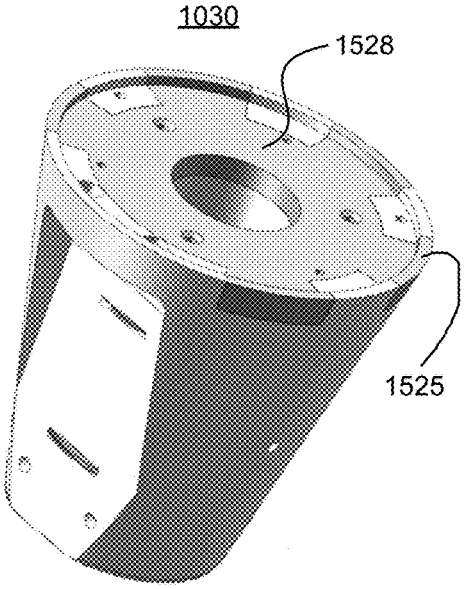
FIG. 36B shows an electronics housing with a heat-dissipating ground plane.

FIG. 36A shows an external view of an embodiment of the incapacitator head 1020 where the tabs 1525 of the ground plane 1528 extend to and are flush with the external portions of the electronics housing 1030. In this embodiment, tabs 1525 are configured to perform the majority of the heat conduction from the electrical circuit within the head 1020. Therefore, the electronics housing 1030 and/or the optical housing 1040 may comprise metal, plastic, a mix of metal and plastic, or other materials, since the external portion of the electronics housing 1030 (other than the ground plane tabs 1525) is not relied on to provide conductive coiling for the items within the housing 1030. FIG. 36B shows a drawing of the electronics housing 1020 with the ground plane 1528 disposed within the housing 1020.

Figure 37A:
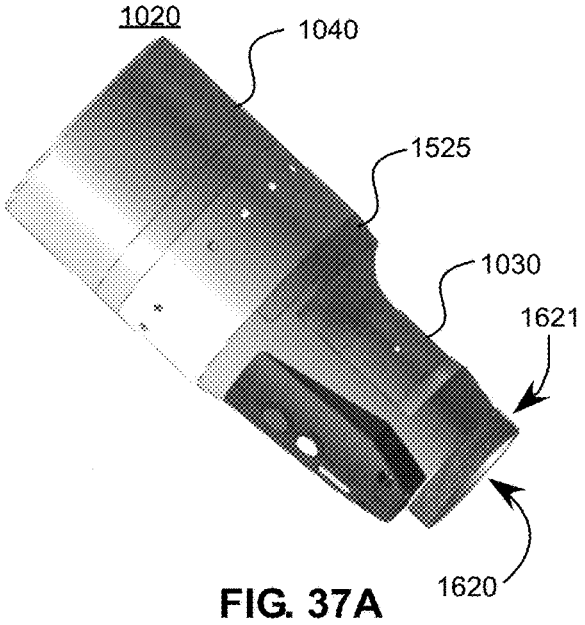
FIG. 37A shows a smaller diameter incapacitator head using a heat-dissipating ground plane and using external coupling for attaching a handle to the head.
Figure 37B:
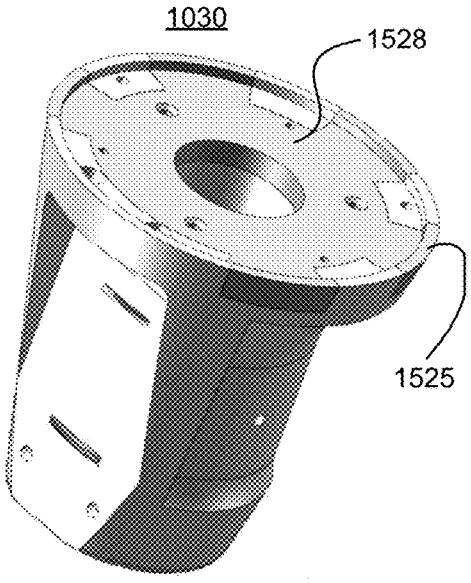
FIG. 37B shows a drawing of an electronics housing with a ground plane disposed within the housing.

FIG. 37A shows an external view of another embodiment of the incapacitator head 1020 where the tabs 1525 of the ground plane 1528 extend to and are flush with the external portions of the electronics housing 1030. In this embodiment, the electronics housing 1030 has a smaller diameter than the embodiment depicted in FIGS. 36A and 36B to allow for some weight reduction and easier handling. In this embodiment, the electronics housing 1030 and/or the optical housing 1040 may again comprise metal, plastic, a mix of metal and plastic, or other materials, since the external portion of the electronics housing 1030 (other than the ground plane tabs 1525) is not relied on to provide conductive coiling for the items within the housing 1030. FIG. 37B shows a drawing of the electronics housing 1020 with the ground plane 1528 disposed within the housing 1020.

Figure 38A:
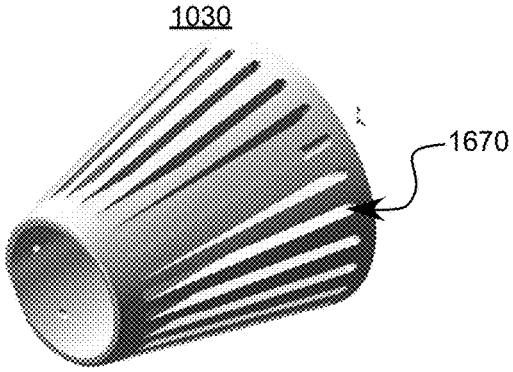
FIGS. 38A, 38B, and 38C show a slotted electronics housing.
Figure 38B:
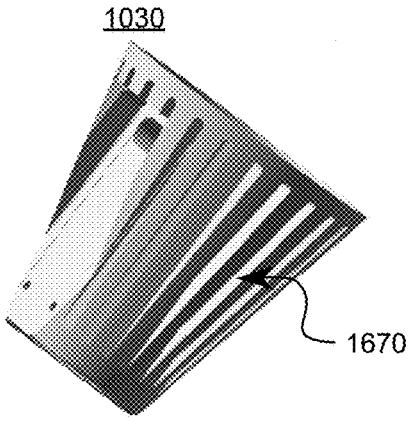
Figure 38C:
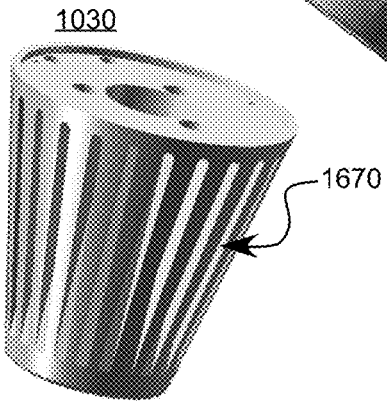

FIGS. 38A, 38B, and 38C show various views of a slotted electronics housing 1030. This housing 1030 may be used in place of the electronics housing 1030 depicted in FIGS. 36A, 36B, 37A, and 37 B and elsewhere. With the housing 1030 depicted in FIGS. 38A, 38B, and 38C, slots 1670 are cut into the housing 1020 to allow air to freely circuit around the elements disposed within the housing 1020. These slots 1670 may lessen the need for heat sinks or heat conductive ground planes to be used within the housing 1030 or lessen the weight and/or size of such heat sinks or ground planes and thus decrease the overall weight or size of the incapacitator. Heat generated by the elements within the housing 1030 is freely dissipated into the air surrounding the elements. Note also that the weight of the housing 1030 may also be decreased due to the material removed to create the slots 1670.

Note also the FIG. 36A depicts the entry point 1610 where the handle 1010 (shown in FIG. 25) internally couples to the head 1020. In FIG. 36A, the handle 1010 may couple to a fixture within the head 1020, such as a grooved slot, threads, or other holding means, to preferably tightly mechanically couple the handle 1010 to the head. Electrical contacts between an electrical source in the handle 1010 (e.g. a battery pack) to electronics with the head 1020 is provided through the entry point 1610.

FIG. 37A depicts where the handle 1010 may externally couple to the head 1020. In FIG. 37A, there are external threads 1621 on the head 1020, so that the handle 1010 screws on to the head 1020. Electrical contacts between an electrical source in the handle 1010 (e.g. a battery pack) to electronics with the head 1020 is provided through the entry point 1620. Other embodiments may use still other mechanisms or means for coupling the handle 1010 to the head 1020. Other head embodiments or electrical housing embodiments may use the described mechanisms or means or other mechanisms or means to couple a handle to a head.

For example, the slotted electronics housing depicted in FIGS. 38A, 38B, and 38C may use internal or external coupling to attach a handle to a head.

As briefly discussed above, some embodiments of the incapacitator 1000 contain a battery pack within the handle 1010 of the incapacitator 1000 as depicted in FIG. 25. An exemplary battery pack providing appropriate characteristics for operating with the CBT-380RGBW module and associated electronics has a pack capacity of 2300 mA; an operating voltage of 7.4 V, a charge voltage of 8.4V; and average discharge current of 6000 mA; a pulse discharge current of 41000 mA; a normal battery charge current of 500 mA; and a fast battery charge current of 2000 mA. The battery pack and handle 1010 may be configured to mate with the head 1020 to allow for easy and quick disconnect. Preferably, the battery pack is configured to allow recharge from a 120 V house current charger and/or a 12 V automobile charger.

An incapacitator according to an embodiment of the present invention may comprise a battery operated dual mode device in a conventional mid-size flashlight format, which provides ultra-bright flickering light of different colors, frequencies and color/frequency combinations in the 5-20 Hz range as well as intense narrow beam of white light on the level of the brightest conventional flashlights. The device may be a supportive offensive/defensive device to security forces in the everyday operations and also replace the conventional flashlight because of its dual mode operation.

Such an incapacitator may by effective at distances up to 21 feet in day operations and up to 35-40 feet in night operation. Using a single powerful RGBW LED chip (such as the CBT-380RGBW module described above), allows the incapacitator to provide four highly intense (red, green, blue and white) beams slightly separated in space (on the target). Such a chip and the optics within the incapacitator provide beam profiles that are rectangular in red and green and square in blue and white with an average concentration angle at 6° full angle. The irradiance at a distance of 7 feet may be as follows: red is 7.7 $mW/cm^2$; green is 5.5 $mW/cm^2$; blue is 12.6 $mW/cm^2$; and white is 9.4 $mW/cm^2$ (plus/minus 10%). Irradiance would be 9 times lower at a distance of 21 feet. The incapacitator may be configured to operate in a color mixing mode which provides a wide angle (approximately 20°) beam of mixed overlapping colors when the lens placed approximately 3 mm out of focus. The irradiance provided by each color is 2-2.5 times lower in the color mixing mode.

The incapacitator according to this embodiment may also operate as a conventional flashlight. In such a mode, the incapacitator provides a square white beam of 6° full angle. It can operate in two regimes: energy saving and full power. In the energy saving mode, it can provide 2700 lumen (+/−10%) at 7 feet. In the full power mode, it can provide 5550 lumen (+/−10%) at 7 feet.

The power supply for this embodiment may be a rechargeable battery pack contained within the handle of the device. If battery power is low, the handle can be detached and replaced with a spare handle. The low battery handle can then be recharged whenever operational conditions permit. An indicator on the unit can provide an indication of low battery power and the need for a recharge.

The incapacitating mode features may be programmable, allowing a nearly infinite variety of operational combinations of beam sequencing, frequencies and pulse durations. A programmable chip may be located within electronics inside this embodiment to provide the programmable features. The chip may be programmed at the time of manufacturing through a connector located on the device (for example, see element 1021 in FIG. 25) and can be reprogrammed as desired. Operation of the incapacitator in the incapacitating mode may be triggered by simply pushing a button on the device. The unit will then cycle through the programmed flash sequence and the cycle can be reinitiated by pushing the button again.

Effective use of the incapacitating mode of the unit may be provided by first pointing the unit a target's face. Once the incapacitating flashing is triggered, the unit should be rotated such that one beam flashes in one eye and the other beam flashes in the other eye. When the flashing sequence switches to another set of colors, the unit should be rotated or retargeted such that the new colors flash with one color in one eye and the other color in the other eye.

Other embodiments according to the present invention may provide for the selection of multiple incapacitating flash patterns or other colors for use in the flash patterns. Still other embodiments may provide for modes adapted for operation for targets at longer ranges, or for targets at shorter ranges, or selection of longer and shorter range modes. Still other embodiments may use light emitting elements other than the LED arrays discussed above.

Figure 39A:
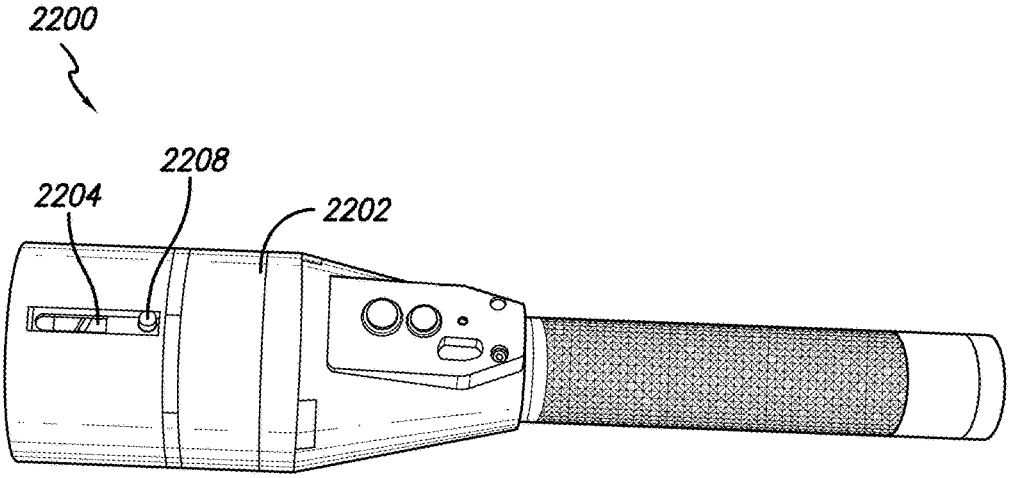
FIGS. 39 A and 39B show a moving lens embodiment in a rearward and forward position respectively.
Figure 39B:
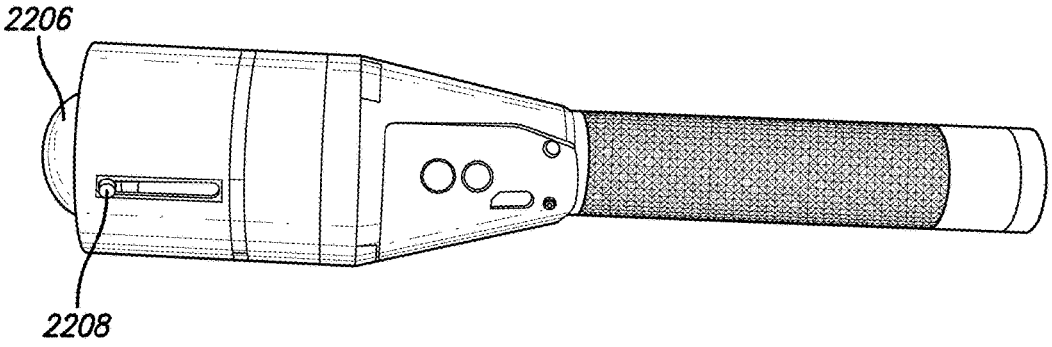

A further embodiment is described with reference to FIGS. 39A and 39B, 40A and 40B, 41A and 41B and 42A and 42B. This embodiment is a structure that allows the user to move the lens along the optical axis in relation to the LED source. As seen in FIGS. 39A and 39B, the unit 2200 has outer cover shell 2202 in which there is an elongate slot 2204 parallel with the optical axis. Inside the outer cover shell a lens 2206 is mounted on a lens housing (not shown) that is slidably mounted inside of the outer cover shell 2202. The lens housing has a knob 2208 that projects through the slot 2204 to be accessible from the outside. Sliding the knob 2208 backward and forward moves the lens housing and the lens 2206 inside the outer cover shell 2202. In FIG. 39A, the knob 2208 is in the rearward position and in FIG. 39B the knob 2208 is in the forward position.

This structure provides the opportunity of moving the lens 2206 along the optical axis in relation to the LED light source. This movement places the source out of the lens focal plane (defocuses the beam), which in turn changes the size and shape of the light spot on the target. Refocusing provides more options for using the device specifically in the white flashlight mode, but also is useful in some incapacitating applications. As will be seen, the structure allows movement of the lens from a first, most rearward position to a second, most forward position. The focused position is placed at a selected medium point in the range of motion, so that the most rearward position has the source in front of the focal plane and the most forward position has the source behind the focal plane.

Figure 40A:
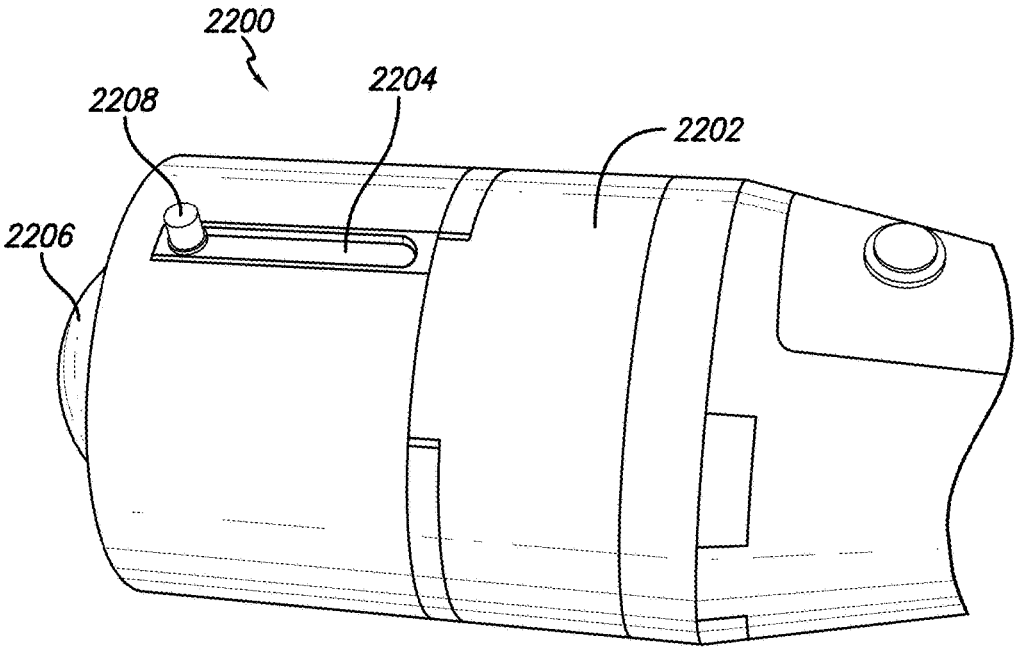
FIGS. 40A and 40B show a moving lens embodiment in a forward unfocused position and the spot made on a target respectively.
Figure 40B:
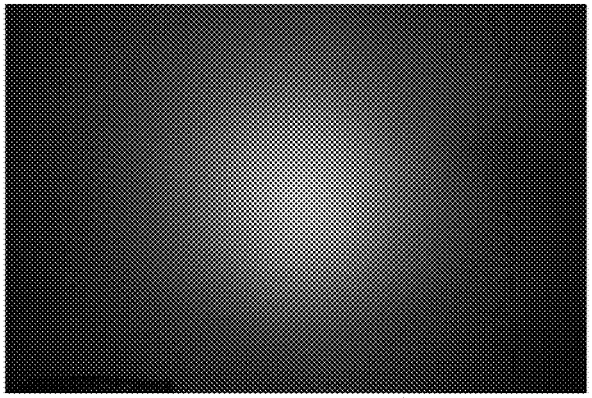

When the lens is in the forward position as in FIGS. 39B and 40A, the light spot is similar to the spot provided by all conventional flashlights with reflector. Security forces are accustomed to such a pattern. For example when police stop a car and check the driver's license illuminating it with the central part of the spot, they can still see the content of the area surrounding the driver via illuminating with less intense light surrounding the central spot. This is shown in FIGS. 40A and 40B.

Figure 41A:
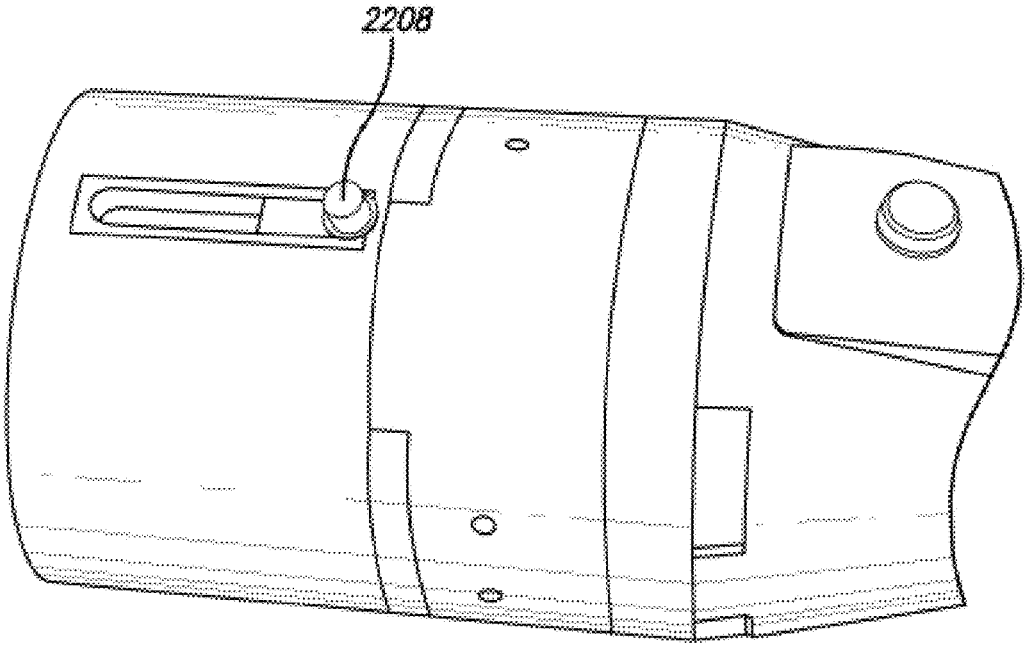
FIGS. 41A and 41B show a moving lens embodiment in a rearward unfocused position and the spot made on a target respectively.

FIG. 41A shows the device head with the knob 2208 moved backwards, the lens 2206 being in the rearward position. The spot in that position is a large circle as in FIG.

41B. This feature is useful for the quick search at short and medium distances, and is not provided by the conventional flashlight.

Figure 42A:
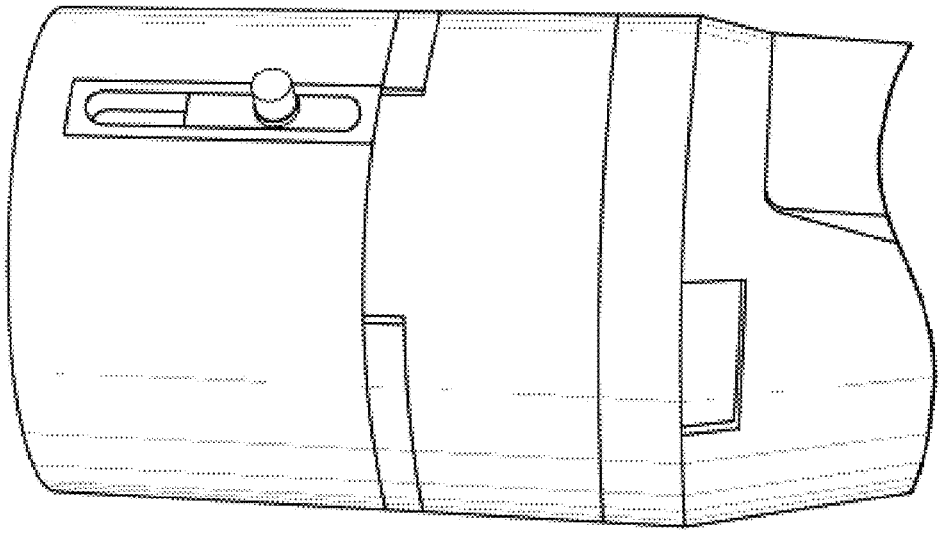
FIGS. 42A and 42B show a moving lens embodiment in a focused position and the spot made on a target respectively.
Figure 42B:
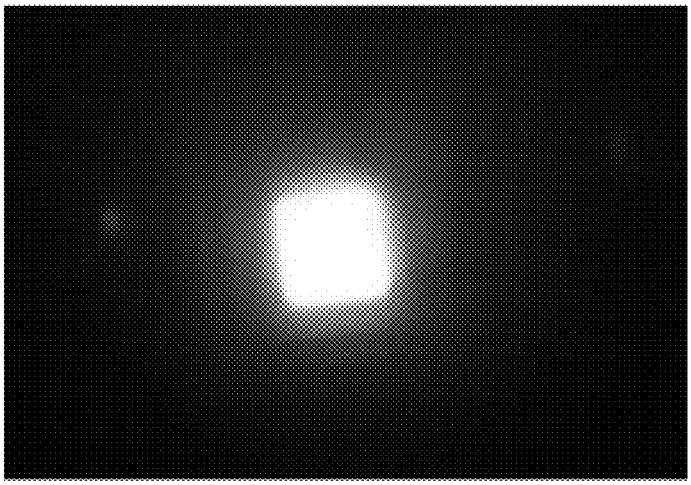

FIG. 42A shows a position, forward of the most rearward position, where the source is in focus. This provides a very narrow beam and a very bright spot as shown in FIG. 42B. This feature in flashlight mode can be very useful for signaling far field illumination and spotting and following the target at a far distance.

Figure 41B:
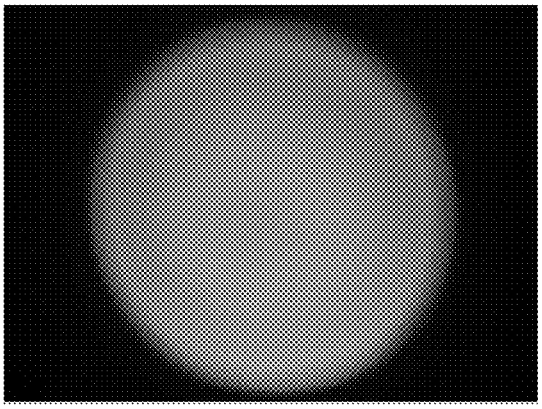

Similar spot patterns will appear when the device is used in the incapacitating multicolor flashing modes. In the focused position of the lens the patterns are as described above. In the defocused modes, all colors will be mixed, despite that in the defocused mode the intensity of each color is reduced, the effect can still be substantial because a number of color can work together. The effect of the defocused light in the incapacitating mode, when the pattern shown in FIG. 40A is used, is not substantial because a substantial amount of light is wasted in the wide (and therefore of low intensity) spot surrounding the central spot. Contrary however, the effect of the defocused light in the incapacitating mode, when the pattern shown in FIG. 41B is used may have substantial effect, and can be used at short to moderate distances in such situations as crowd control and locking inmates in cells in prisons.

As discussed above in regards to FIG. 9, FIG. 10, FIG. 11 and Table 4, various sequences of light may be used to achieve an incapacitating effect upon a viewer of the light emitted from the various embodiments described above. In particular, FIGS. 9-11 and Table 4 depict light sequences achieved though flashing Blue, Red and Cyan light emitting areas. FIGS. 31 and 32 describe light sequences using blue, green, red, and white light emitting areas. The light sequences shown in FIGS. 31 and 32 generally rely upon the fundamental color of the light to obtain an incapacitating effect, that is, the different colors from the different light emitting areas are not controlled to achieve a different color light. However, as briefly described above, the light from the different light emitting areas can be controlled to obtain either a tight or wide beam in which the light from the separate light emitting areas is mixed together. Light sequences using mixed light may also achieve an incapacitating effect.

With four light emitting areas that may be mixed together, an alternative flashing sequence may comprise a 24 second sequence in which different patterns of blue, green, red, and white light emitting areas are flashed on in four intervals where each interval has about a six second duration. In the first six second interval, all four of the light emitting areas (Blue, Green, Red and White) are flashed on simultaneously at a frequency of 11 to 17 Hz and with a duty cycle from 35 to 50%. In this first interval, a flash frequency of 13 Hz with a duty factor of 50% may provide the most desired results. In the second six second interval, the blue, green, and red light emitting area flash simultaneously at gradually increasing frequencies with a duty cycle from 35 to 50%. For example, the frequency of flashing in the second interval could increase through frequencies of 9, 11, 13, 15, 17 and 19 Hz, change every second, and/or have a duty factor around 50%. In the second interval, the amplitudes of the blue, green and red light emitting areas may be controlled to provide an amber-orange colored light in a wavelength range of 580-600 nm. In the third six second interval, the blue, green and red light emitting areas again flash simultaneously at gradually increasing frequencies with a duty cycle from 35 to 50%, similar to the sequence for the second six second interval. However, the amplitudes of the blue, green, and red light emitting areas are controlled to provide a different colored light at a different wavelength range than that of the second interval. For example, the amplitudes may be controlled to provide a cyan colored light in the wavelength range of 485-505 nm. In the fourth six second interval, all four light emitting areas flash simultaneously at a frequency of 11 to 17 Hz and with a duty cycle from 35 to 50%, similar to the flash sequence of the first interval.

This flash sequence may provide incapacitating effects since the first interval will cause the target to be subject to a blinding impact caused by a white strobe (from the white light emitting area) with enhanced red (620-630 nm), green (520-530 nm) and blue (460-470 nm) components. The second interval may provide a strong amber-orange light that is responsible for a startle effect. The third interval provides a strong cyan light that also provides a startle effect along with additional confusion resulting from the color change in the light. The fourth interval provides a string blinding light similar to that provided in the first interval. Human tests have indicated that orange-amber and cyan colored lights are the colors primarily responsible for a startle effect (also referred to as a discomfort effect).

The flash sequence described immediately above has a duration of 24 seconds comprising four intervals having six second durations, but other flash sequences using white, red, green and blue light emitting areas may have durations longer or shorter than 24 seconds and may have intervals longer or shorter than six second each.

Returning to the incapacitating apparatus 2100 shown in FIG. 14 and related figures, the apparatus 2100 is shown as having a light concentrating element 2130 with an internal surface 2230. As discussed above, the internal surface 2230 may be a parabolic reflector such as depicted in FIG. 20. Similarly, the incapacitator 1000 depicted in FIGS. 25 and 26 has a reflector 1230 within the incapacitator head 1020, where the reflector 1230 may again be a parabolic reflector such as depicted in FIG. 20. However, due to the spacing of the light emitting elements beneath the parabolic reflector (such as elements 1121 in FIG. 27), the light from the individual elements may not be efficiently combined. In some embodiments of the incapacitator disclosed herein, the light coming from different light emitting areas may not be not be totally combined, while in other embodiments, combination of the light from the different light emitting areas is desired.

Figure 44A:
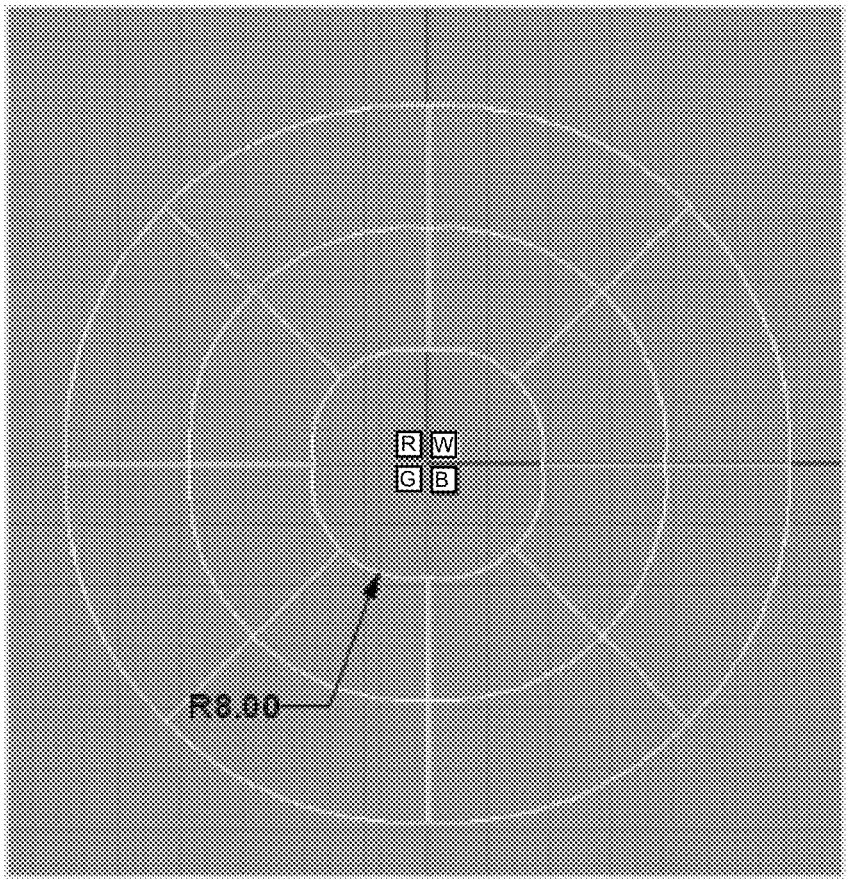
FIG. 44A shows a top view of a combined parabolic reflector.
Figure 44B:
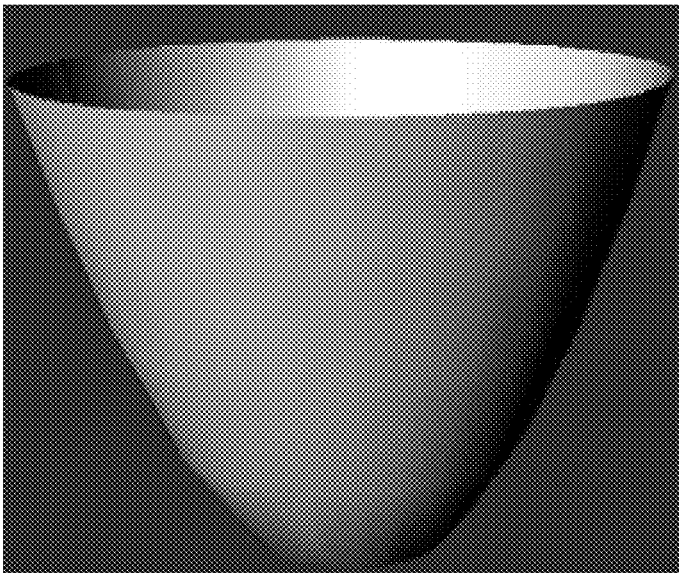
FIG. 44B shows a three dimensional view of a combined parabolic reflector.

An alternative reflector comprises a reflector having four parabolic sections or petals combined into a single reflector. FIG. 44A depicts a top view of the combined reflector and FIG. 44B shows a three dimensional perspective view. This type of reflector may be referred to herein as a combined parabolic reflector or a petal reflector. The combined parabolic reflector has four "petals," where each petal comprises a paraboloid conical section where the curvature center of each paraboloid conical section is aligned with a diagonal through the center of a corresponding light emitting area. The combined parabolic reflector provides that the light emitted from the separate light emitting areas may be concentrated in a central beam of a desired diameter, while allowing the separate colors to be more efficiently mixed in the central beam without a resulting dark spot in the central zone of the beam.

Figure 45:
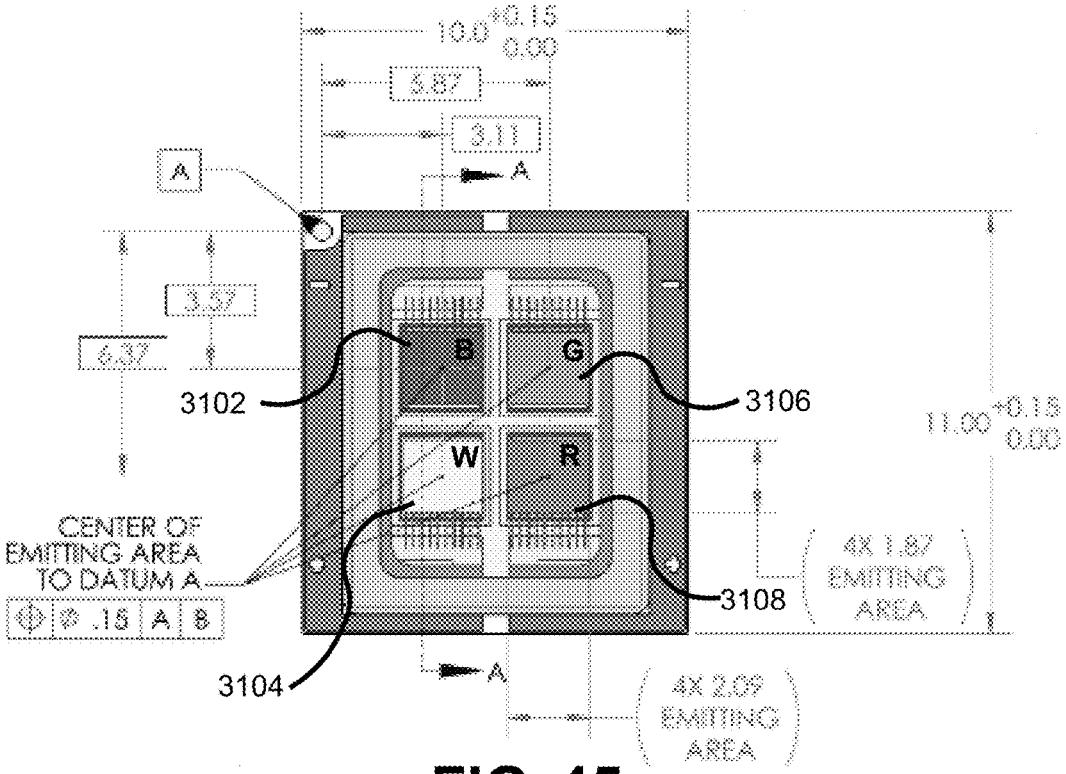
FIG. 45 shows mechanical dimensions of an SBM-160 color mix light emitting device from Luminus Devices, Inc.

An exemplary incapacitator comprising a combined parabolic reflector and a commercial off-the-shelf light emitting diode substrate is described in additional detail below. The light emitting substrate may comprise an SBM-160 color mix LED from Luminus Devices of Billerica, Mass. FIG. 45 shows the mechanical dimensions of the SBM-160 device in millimeters. Table 14 below shows the characteristic of the SBM-160 device. Note that each light emitting area may be driven with a controllable current up to 4.0 A, where the control currents are used to control the intensity of light from each light emitting area.

TABLE 14

| Color | Dominant Wavelength | Chip Emitting Area | Drive Current Typical (CW) | Lumen range |
|---|---|---|---|---|
| Red | 623 nm | 4 $mm^2$ | 4.0 A | 260-352 red lumens |
| Green | 525 nm | 4 $mm^2$ | 4.0 A | 740-900 green lumens |
| Blue | 460 nm | 4 $mm^2$ | 4.0 A | 110-165 blue lumens |
| White | 6500K CCT | 4 $mm^2$ | 4.0 A | 590-780 white lumens |
| | | | Total | 1700-2197 lumens (average 1948.5) |

Figure 46A:
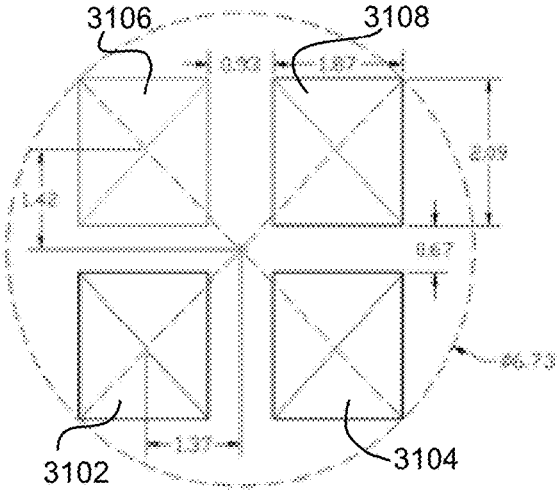
FIG. 46A shows four light emitting areas of the Luminus SBM-160 device in relation to a nominal optical axis for the device.
Figure 46B:
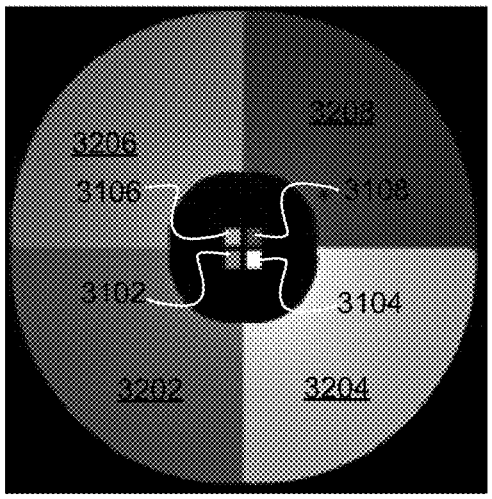
FIG. 46B shows the relationship of the light emitting substrate of the Luminus SBM-160 device to the four sectors of a combined parabolic reflector.
Figure 47:
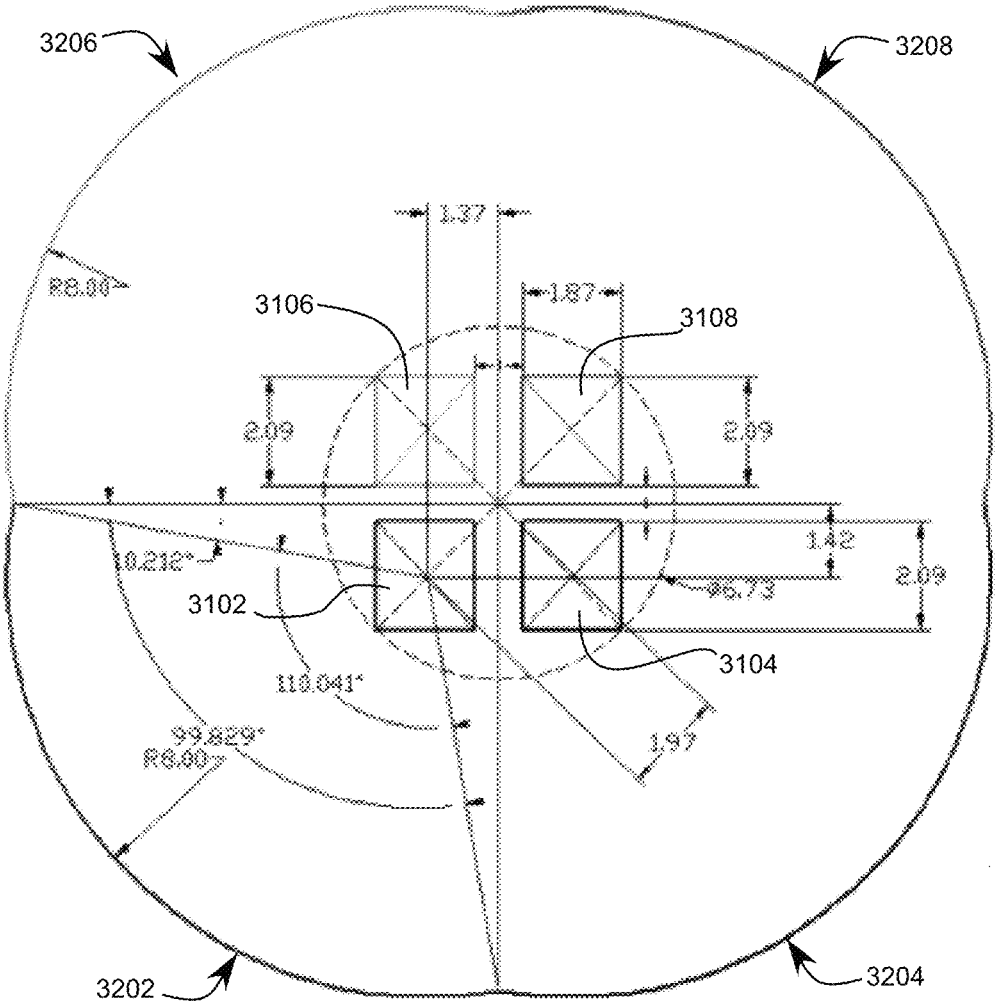
FIG. 47 shows an enlarged view of the four light emitting areas in relation to the four parabolic sectors.

FIG. 46A shows the four light emitting areas 3102, 3104, 3106, 3108 of the Luminus SBM-160 LED in relation to a nominal optical axis for the device. FIG. 46B shows the relationship of the light emitting substrate 3100 to the four sectors 3202, 3204, 3206, 3208 of a combined parabolic reflector 3200 having a nominal diameter of about 60 mm. As shown in FIG. 46B, parabolic sector 3202 corresponds to the blue light emitting area 3102, parabolic sector 3204 corresponds to the white light emitting area 3104, parabolic sector 3206 corresponds to the green light emitting area 3106 and parabolic sector 3208 corresponds to the red light emitting area 3108. FIG. 47 shows an enlarged view of the four light emitting areas 3102, 3104, 3106, 3108 in relation to the parabolic sectors 3202, 3204, 3206, 3208. As shown in FIG. 47, one desired configuration is where the curvature centers of the "petals" (i.e., the parabolic sectors) 3202, 3204, 3206, 3208 coincide with diagonal intersections within each light emitting area 3102, 3104, 3106, 3108.

An appropriate size for portions of the combined parabolic reflector may be derived from the general equation for conical sections shown in Eq. 6 below. Note that the selection of the overall size of the reflector may be based on size and weight considerations for the incapacitator or the total size of the light emitting areas or other factors. These factors may then drive the size selections for portions of the combined parabolic reflector. The general equation for conical sections is as shown in Eq. 6 below:

$$Z(Y) = \frac{\frac{Y^2}{R}}{1 + \sqrt{1 - (K+1)\frac{Y^2}{R^2}}} \quad \text{Eq. 6}$$

where R is the radius at the vertex and K is the conic constant

For a parabola, K=−1, so Eq. 6 is rewritten as Eq. 7 below:

$$Z(Y) = \frac{Y^2}{2R} \quad \text{Eq. 7}$$

The focal length F=R/2, so Eq. 7 may be rewritten as Eq. 8 below:

$$Z(Y) = \frac{Y^2}{4F} \quad \text{Eq. 8}$$

Figure 48:
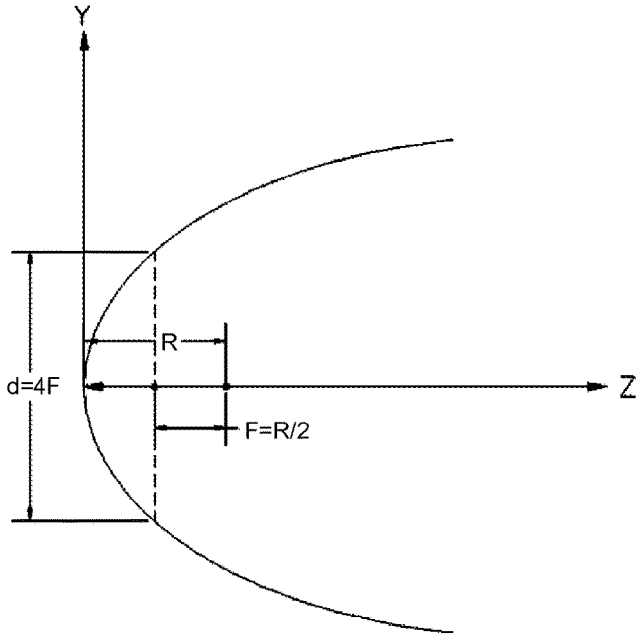
FIG. 48 shows a paraboloid curve in the Z-Y coordinates.

Referring now to FIG. 48, which shows the paraboloid curve in the Z-Y coordinates, it can be seen that at focal plane location Z(Y)=F, the circle diameter of the paraboloid section by focal plane is calculated as shown in Eq. 9 below:

$$d=2Y=2\sqrt{4F^2=4F} \quad \text{Eq. 9}$$

Therefore, given a specified paraboloid focal length of F, the hole diameter at the focal plane is defined as d=4F.

Figure 49:
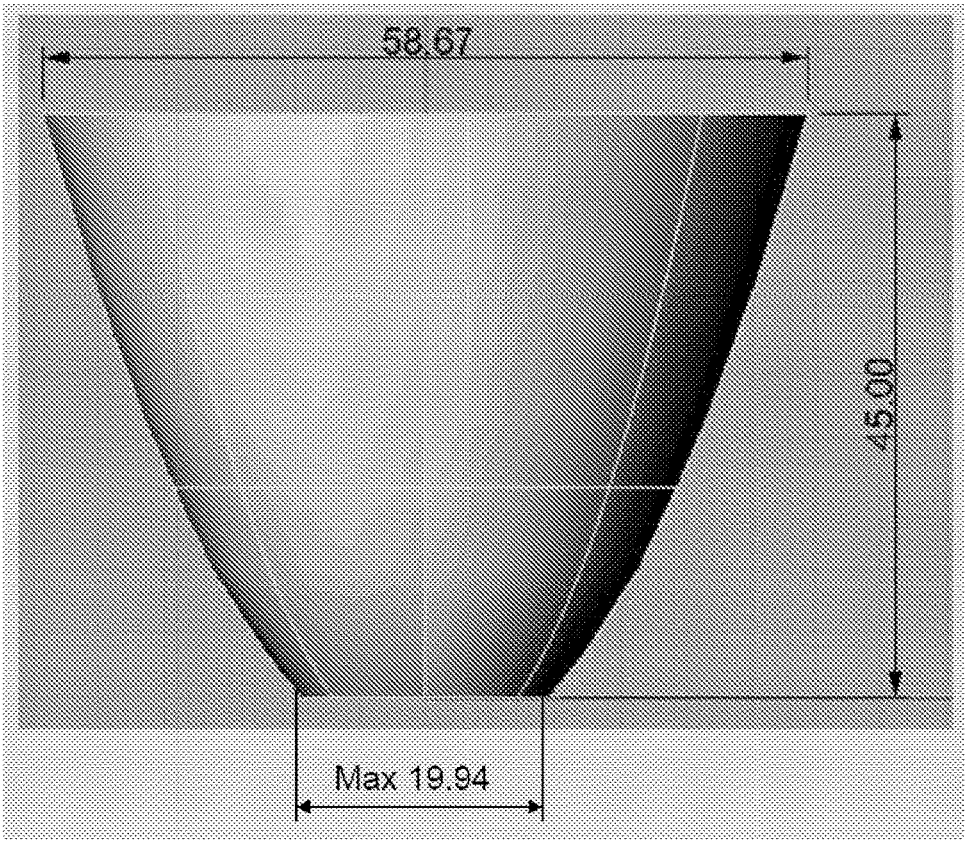
FIG. 49 shows the overall dimensions of the combined parabolic reflector with a diameter of approximately 60 mm.
Figure 50A:
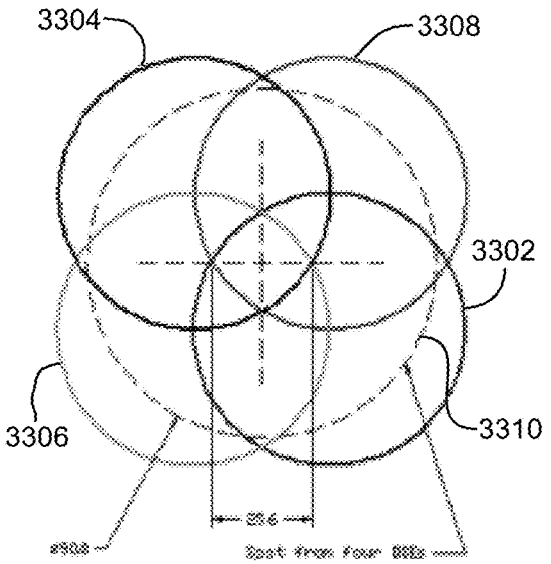
FIG. 50A shows the beam overlap for beams from four light emitting areas at a distance of 2 m.
Figure 50B:
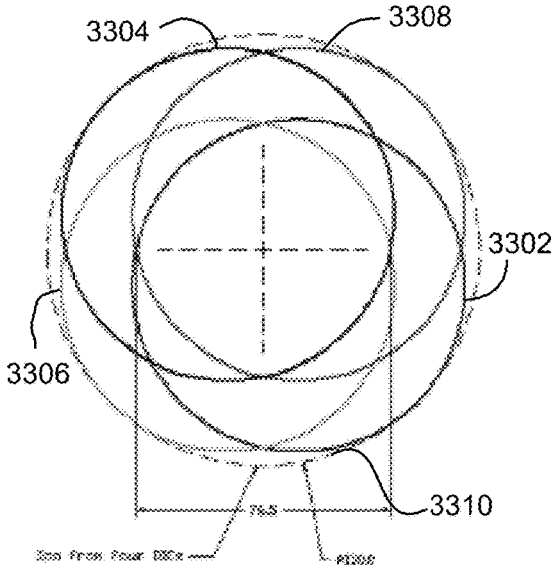
FIG. 50B shows the beam overlap for beams from four light emitting areas at a distance of 3 m.
Figure 50C:
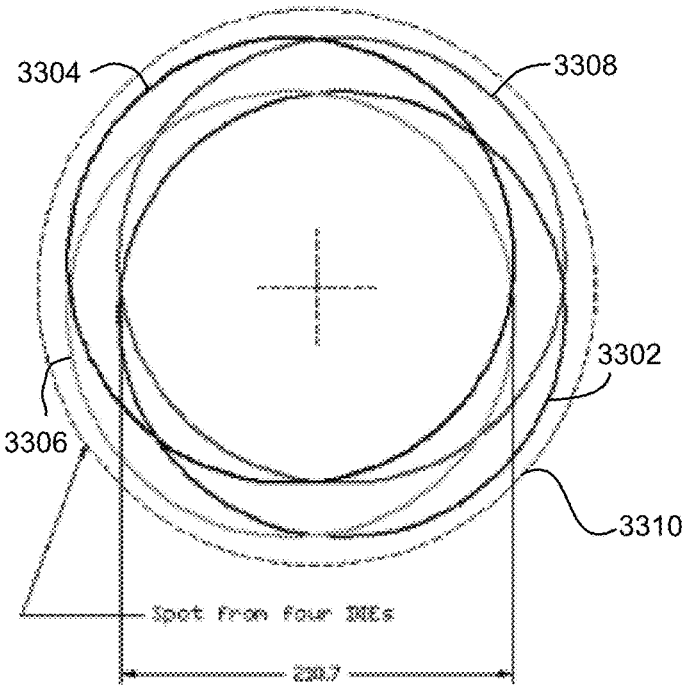
FIG. 50C shows the beam overlap for beams from four light emitting areas at a distance of 7 m.

FIG. 49 shows the overall dimensions of the combined parabolic reflector configured for use with the SBM-160 device with the dimensions presented above. As shown in FIG. 49, the reflector has a length of about 45 mm, the output end has a diameter of about 58.67 mm and the end of the reflector where the SBM-160 device is located has a maximum diameter of about 19.94 mm. An incapacitator having the 60 mm combined reflector shown in FIG. 49 and using the SBM-160 device could produce outputs as summarized in Table X below. Table X shows the illuminance, light spot size, and spot center achieved from each light emitting area operating separately and combined all together for distances of 2 m, 3 m, and 7 m. FIGS. 50A, 50B, and 50C show the overlap for the beams from each separate light area at distances of 2 m, 3 m, and 7 m, respectively. Table 15 and FIG. 50C shows that the light beams from the separate light emitting areas provide substantial overlap at distances of 7 m and greater, which provide the increased light brightness even at increased distances.

TABLE 15

| | Illuminance, Lux | | | Spot Size Diameter Estimation, mm | | | Spot Center [X, Y] Position with respect to X = 0; Y = 0, mm | | |
|---|---|---|---|---|---|---|---|---|---|
| DIE Type | 2 m | 3 m | 7 m | 2 m | 3 m | 7 m | 2 m | 3 m | 7 m |
| All | 14500 | 6500 | 1200 | 90 | 130 | 300 | 0.0; 0.0 | 0.0; 0.0 | 0.0; 0.0 |
| WHITE | 6600 | 2600 | 470 | 70 | 100 | 240 | +25; −25 | +15; −15 | +20; −20 |
| RED | 2400 | 1100 | 200 | 70 | 100 | 240 | +25; +25 | +15; +15 | +20; +20 |
| GREEN | 5800 | 2600 | 470 | 70 | 100 | 240 | −25; +25 | −15; +15 | −20; +20 |
| BLUE | 950 | 410 | 78 | 70 | 100 | 240 | −25; −25 | −15; −15 | −20; −20 |

Figure 51A:
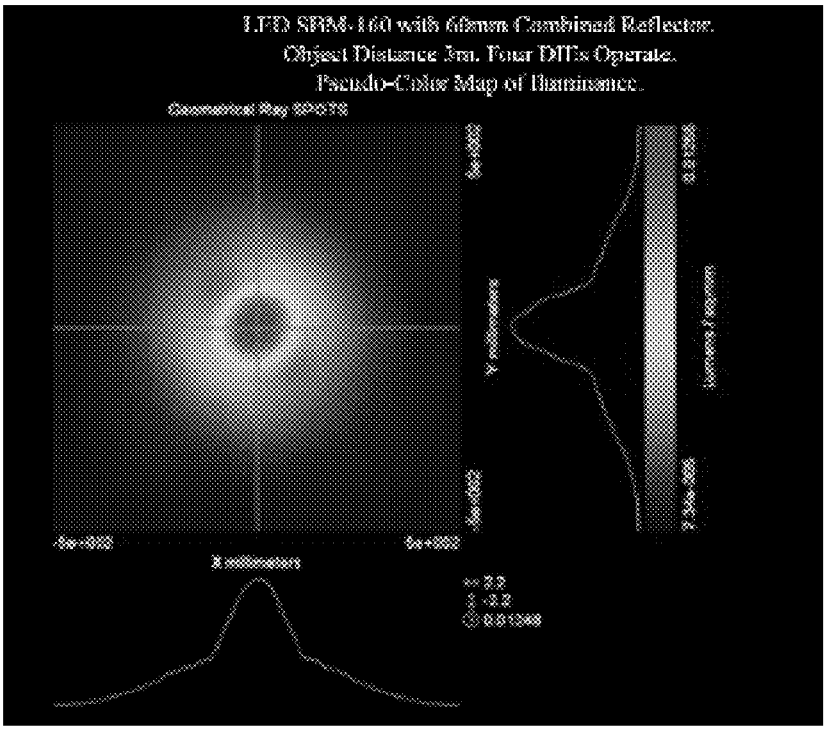
FIG. 51A shows a map of illuminance at 3 m obtained from a combined parabolic reflector coupled to an SBM-160 device.
Figure 51B:
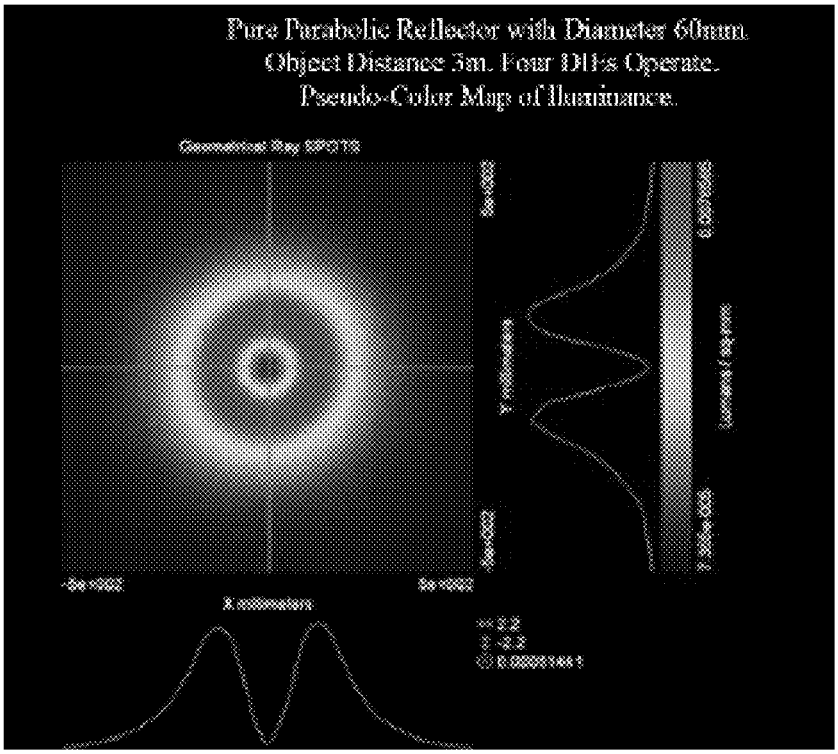
FIG. 51B shows a map of illuminance at 3 m obtained from a pure parabolic reflector coupled to an SBM-160 device.
Figure 52A:
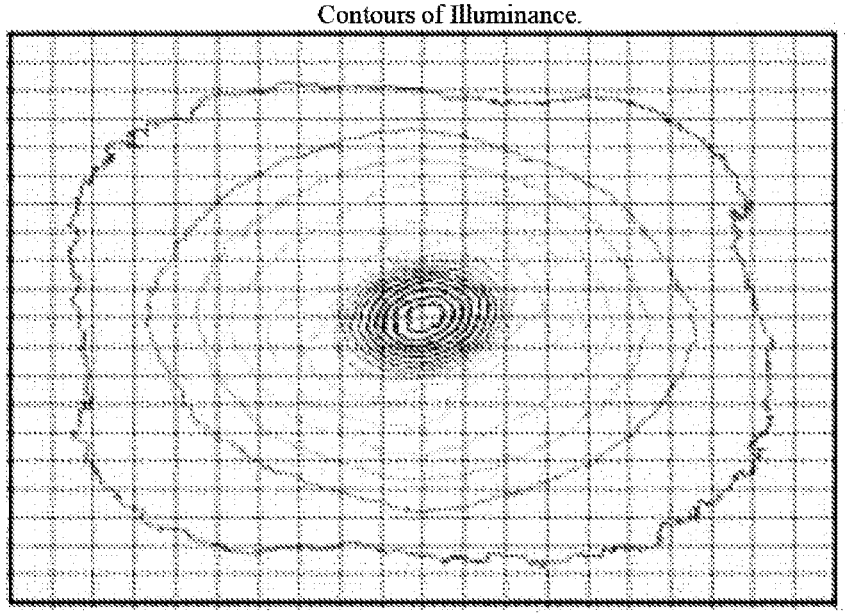
FIG. 52A shows the contours of illuminance at 3 m for a combined parabolic reflector coupled to an SBM-160 device.
Figure 52B:
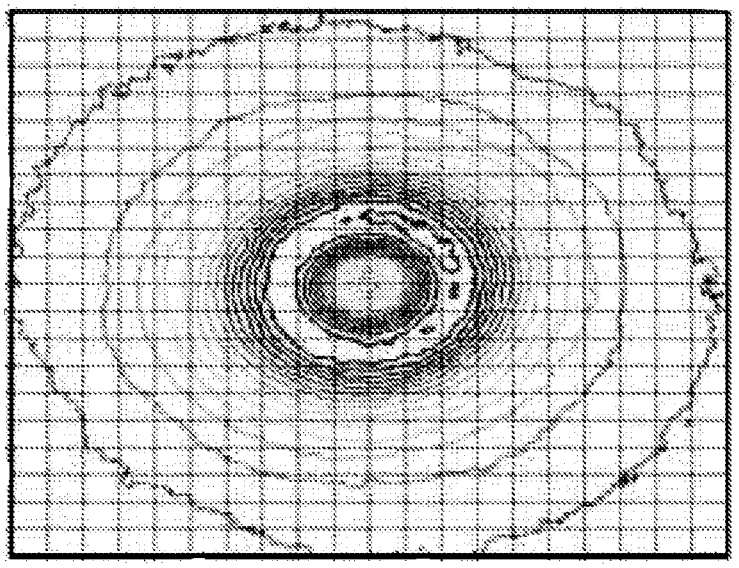
FIG. 52B shows the contours of illuminance at 3 m for a pure parabolic reflector coupled to an SBM-160 device.
Figure 53A:
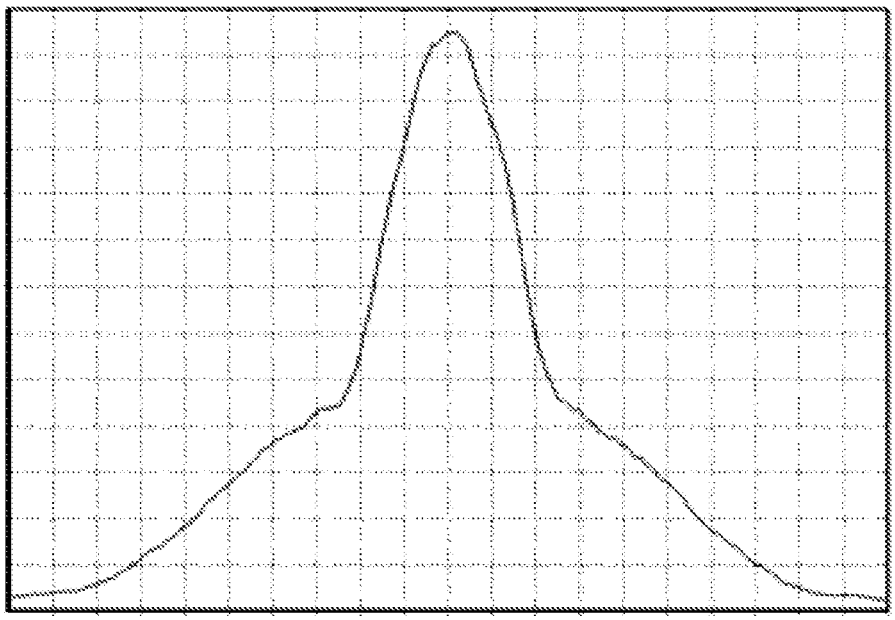
FIG. 53A shows a graph of the energy distribution of the beam at 3 m for a combined parabolic reflector coupled to an SBM-160 device.
Figure 53B:
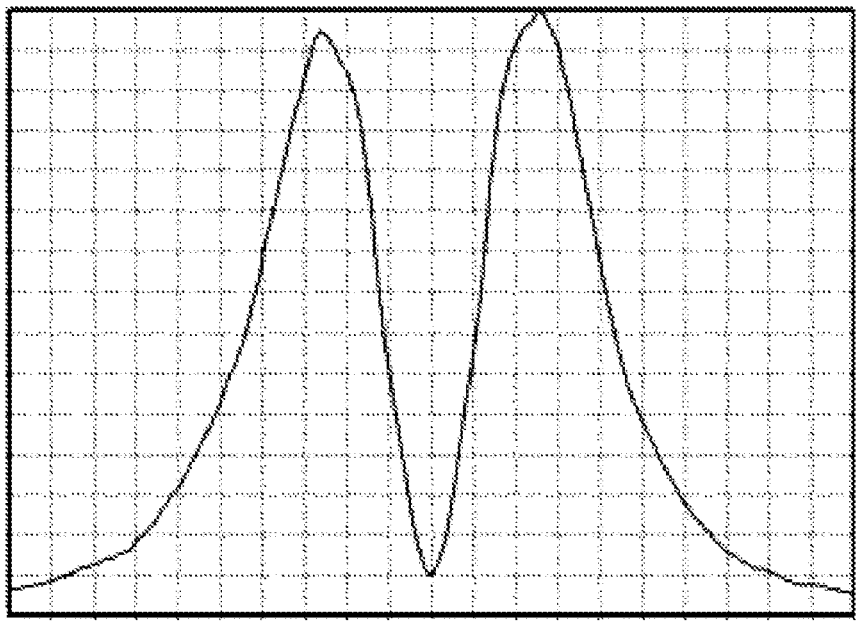
FIG. 53B shows the graph of the energy distribution of the beam at 3 m for a pure parabolic reflector coupled to an SBM-160 device.

A pure parabolic reflector is discussed above in regard to FIG. 20, where FIG. 20 shows the dimensions of a pure parabolic reflector having a diameter of 60 mm. Incapacitators according to the present disclosure utilizing a combined parabolic reflector (i.e., a petal reflector) provide a significant increase in illuminance over incapacitators utilizing a pure parabolic reflector of near equal diameter. FIG. 51A shows a map of illuminance at 3 m obtained from a combined parabolic reflector coupled to the SBM-160 device described above, while FIG. 51B shows a map of illuminance at 3 m obtained from a pure parabolic reflector coupled to the SBM-160 device. FIG. 51B shows the appearance of a dark spot in the center of the beam for the pure parabolic reflector, while FIG. 51A does not show a dark spot. FIG. 52A shows the contours of illuminance for a combined parabolic reflector with the SBM-160 device and FIG. 52B shows the contours of illuminance for a pure parabolic reflector. FIG. 52B shows that the beam from the pure parabolic reflector is wider than the beam from the combined reflector shown in FIG. 52A. FIG. 53A shows a graph of the energy distribution of the beam for a combined parabolic reflector with the SBM-160 device and FIG. 53B shows the graph of the energy distribution of the beam for a pure parabolic reflector. FIG. 53A clearly illustrates the energy from the beam of the combined reflector is concentrated in a relatively narrow beam and peaks at the center of the beam, while FIG. 53B shows that the energy from the beam of the pure parabolic reflector is spread over a wider diameter and does not peak at the center of the beam. FIGS. 51A-53B show that for reflectors with 60 mm diameters, the combined parabolic reflector concentrates all colors in a central beam of a desired diameter and does not have a "dark spot" in the center of the beam, unlike the pure parabolic reflector. The 60 mm diameter combined parabolic reflector provides an almost two fold increase in flux over the 60 mm diameter pure parabolic reflector for a spot of similar diameter (276 lumens for the combined parabolic reflector versus 147 lumens for the pure parabolic reflector.

Figure 54:
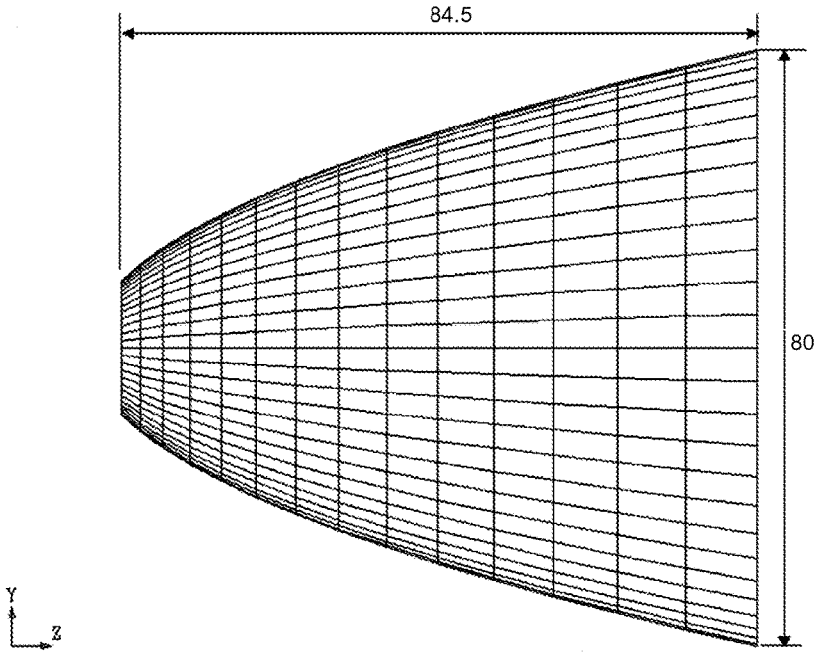
FIG. 54 shows the dimensions of a pure parabolic reflector with an 80 mm diameter and a length of 84.5 mm.
Figure 55:
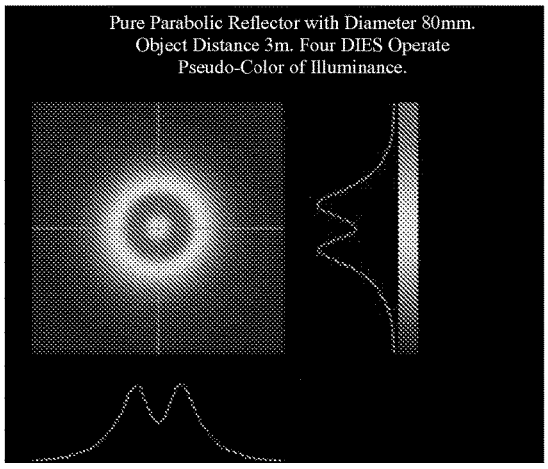
FIG. 55 shows a map of illuminance at 3 m for the 80 mm pure parabolic reflector coupled to an SBM-160 device.
Figure 56:
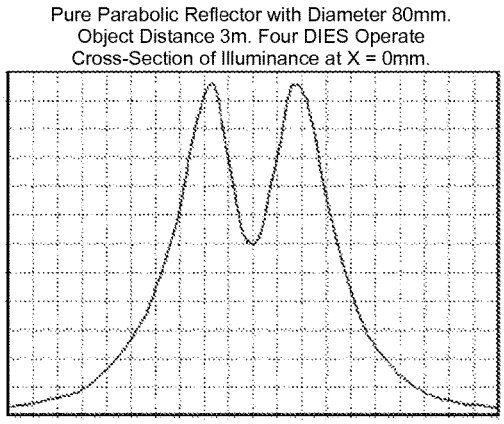
FIG. 56 shows a graph of the energy distribution at 3 m for the 80 mm pure parabolic reflector coupled to an SBM-160 device.

A larger pure parabolic reflector, when coupled to the SBM-160 device, can provide output energy nearly equal to the 60 mm diameter combined parabolic reflector described above. FIG. 54 shows the dimensions of a pure parabolic reflector with an 80 mm diameter and a length of 84.5 mm. When coupled to an SBM-160 device, the 80 mm diameter pure parabolic reflector may provide a flux output of 319 lumens at a range of 3 m. FIG. 55 shows a map of illuminance for the 80 mm pure parabolic reflector at 3 m and FIG. 56 shows a graph of the energy distribution for the 80 mm pure parabolic reflector. FIGS. 55 and 56 show that, while higher output energy is obtained, the 80 mm pure parabolic reflector still does not efficiently mix the energy from the multiple light emitting areas and a dark spot still occurs at the center of the beam, albeit less "dark" than the dark spot of the 60 mm pure parabolic reflector.

Figure 57:
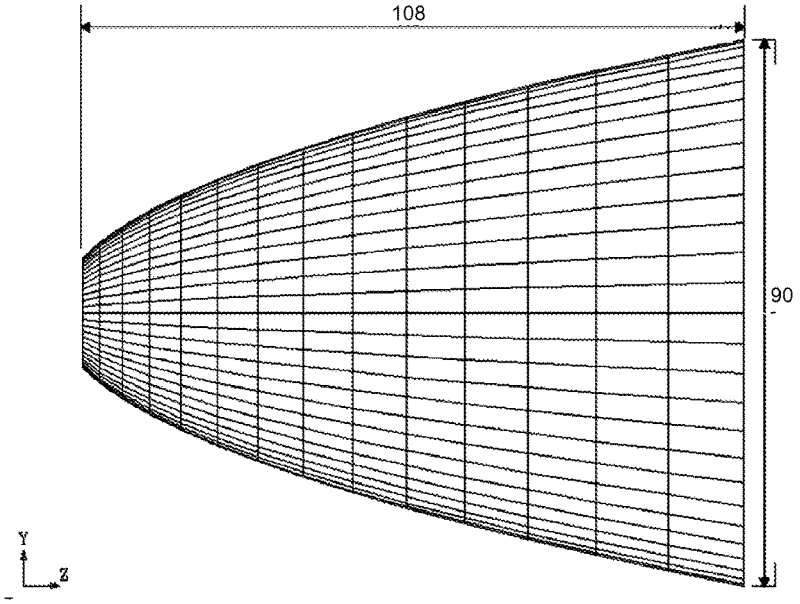
FIG. 57 shows the dimensions of a pure parabolic reflector with a 90 mm diameter and a length of 108 mm.
Figure 58:
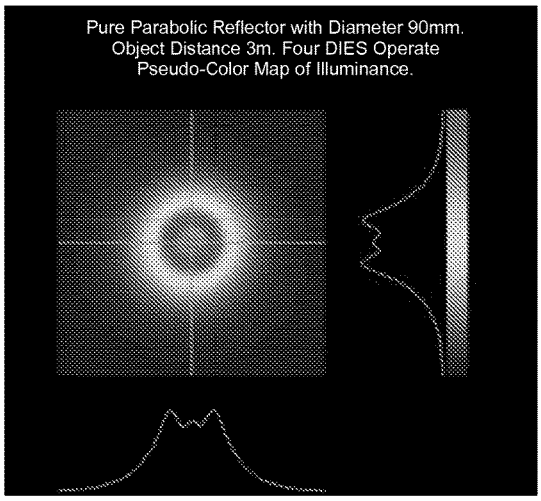
FIG. 58 shows a map of illuminance at 3 m for the 90 mm pure parabolic reflector coupled to an SBM-160 device.
Figure 59:
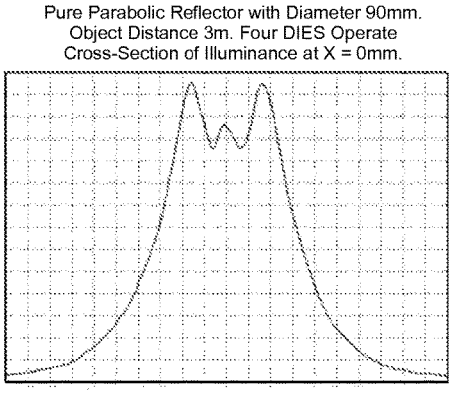
FIG. 59 shows a graph of the energy distribution at 3 m for the 90 mm pure parabolic reflector coupled to an SBM-160 device.

An even larger pure parabolic reflector, when coupled to the SBM-160 device, can provide an output spot that exhibits relatively god color mixing from the multiple light emitting areas. FIG. 57 shows the dimensions of a pure parabolic reflector with an 90 mm diameter and a length of 108 mm. FIG. 58 shows a map of illuminance for the 80 mm pure parabolic reflector at 3 m and FIG. 59 shows a graph of the energy distribution for the 80 mm pure parabolic reflector. FIGS. 58 and 59 show that the 90 mm pure parabolic reflector provides a good mix of the energy from the multiple light emitting areas and the dark spot is nearly eliminated. However, the larger size of the 90 mm pure parabolic reflector will result in a larger and heavier incapacitator than an incapacitator utilizing a 60 mm reflector.

An incapacitating apparatus 6000 utilizing the combined parabolic reflector described above is shown in FIG. 60. Similar to the light incapacitating apparatus described above in regard to FIG. 14 and FIG. 26, the light incapacitating apparatus 6000 has a handle 6100, which may contain a battery pack or other power source used to power the apparatus 6000. The handle 6100 also contains electronics, including a light emitting device such as the SBM-160 device, that control and output optical energy from the apparatus 6000. The optical energy from the apparatus is concentrated with a light concentrating element comprising a combined parabolic reflector, i.e., a petal reflector, contained in an apparatus head 6300. The apparatus head 6300 may also contain the electronics that control and output optical energy from the apparatus 6000 rather than the electronics being contained within the handle 6100. Control of the apparatus is provided by one or more control switches 6200. The control switches can turn the apparatus on and off and select a flashlight mode or an incapacitating light sequence mode in a manner similar to that described above. The control switches 6200 may be configured to command the apparatus electronics to allow any one or more of several light sequences to be selected. Other embodiments of the present invention may combine the combined parabolic reflector with an aspheric lens or other lens type for additional light concentrating and control capability.

As discussed above, FIG. 27 shows an embodiment of an incapacitator using both a 60 mm diameter pure parabolic reflector 1230 and a 60 mm diameter aspheric lens 1237. AS discussed above, the embodiment depicted in FIG. 27 uses a light emitting device having four separate light emitting areas, a red area, a blue area, a green area, and a white area. One suitable light emitting device is the Pathlight RGB chip CBM 380 from Luminus Devices, Inc. (Billerica, Mass.). This light emitting device is significantly larger than the SBM-160 device described above. Table 16 below shows the characteristics of the CBM 380 device.

TABLE 16

| Color | Dominant Wavelength | Chip Emitting Area | Drive Current Typical (CW) | Lumen range |
|---|---|---|---|---|
| Red | 623 nm | 12 $mm^2$ | 12.0 A | 600-970 red lumens |
| Green | 525 nm | 12 $mm^2$ | 12.0 A | 200-2600 green lumens |
| Blue | 460 nm | 5.4 $mm^2$ | 8.1 A | 250-350 blue lumens |
| White | 6500K CCT | 9 $mm^2$ | 9.0 A | 1450-1750 white lumens |
| | | | Total | 4300-5670 lumens (average 4985) |

From Tables 14 and 16, it can be seen that the CBM 380 device has a significantly larger area, but it can have a significantly larger optical power output than the SBM-160 device. When used in an incapacitating apparatus such as the one depicted in FIG. 27, the CBM 380 device provides a brighter output than the SBM-160 device incorporated into an apparatus using a combined parabolic reflector, such as the apparatus depicted in FIG. 60. An apparatus using the CBM 380 device and a pure parabolic reflector can be configured to provide a flashlight mode with a square beam that allows a target to be easily followed and can also be configured to provide a uniform square beam. However, the CBM 380 device currently has a higher cost that the SBM-160 device, which can increase the overall cost of the incapacitator.

Further, as discussed above in regard to FIG. 27, a defocus mode may be required to achieve a uniform round beam with color overlap. As such, an incapacitator using the CBM 380 device and a pure parabolic reflector may require additional mechanical mechanisms to achieve the uniform round beam, which may lead to increased costs and weight. In the flashlight mode, an incapacitator with the CBM 380 device and a pure parabolic reflector still may not provide the desired beam in the flashlight mode. Also, as noted above, the CBM 380 uses significantly more current that the SBM-160 device, which will require unique heat dissipation management that can again lead to increased costs and weight. An incapacitator using the CBM 380 device may also require increased duty factors when using an incapacitating light sequence, also leading to increased power consumption and heat dissipation issues.

Finally, as described in regard to FIG. 27, the incapacitating sequence of the incapacitator shown in FIG. 27 may be configured to achieve its results by providing spatially separated light patterns to a target's eyes. Hence, the user may have to carefully point the incapacitator using the CBM 380 and a pure parabolic reflector at the target to achieve the desired incapacitating effects.

Figure 60:
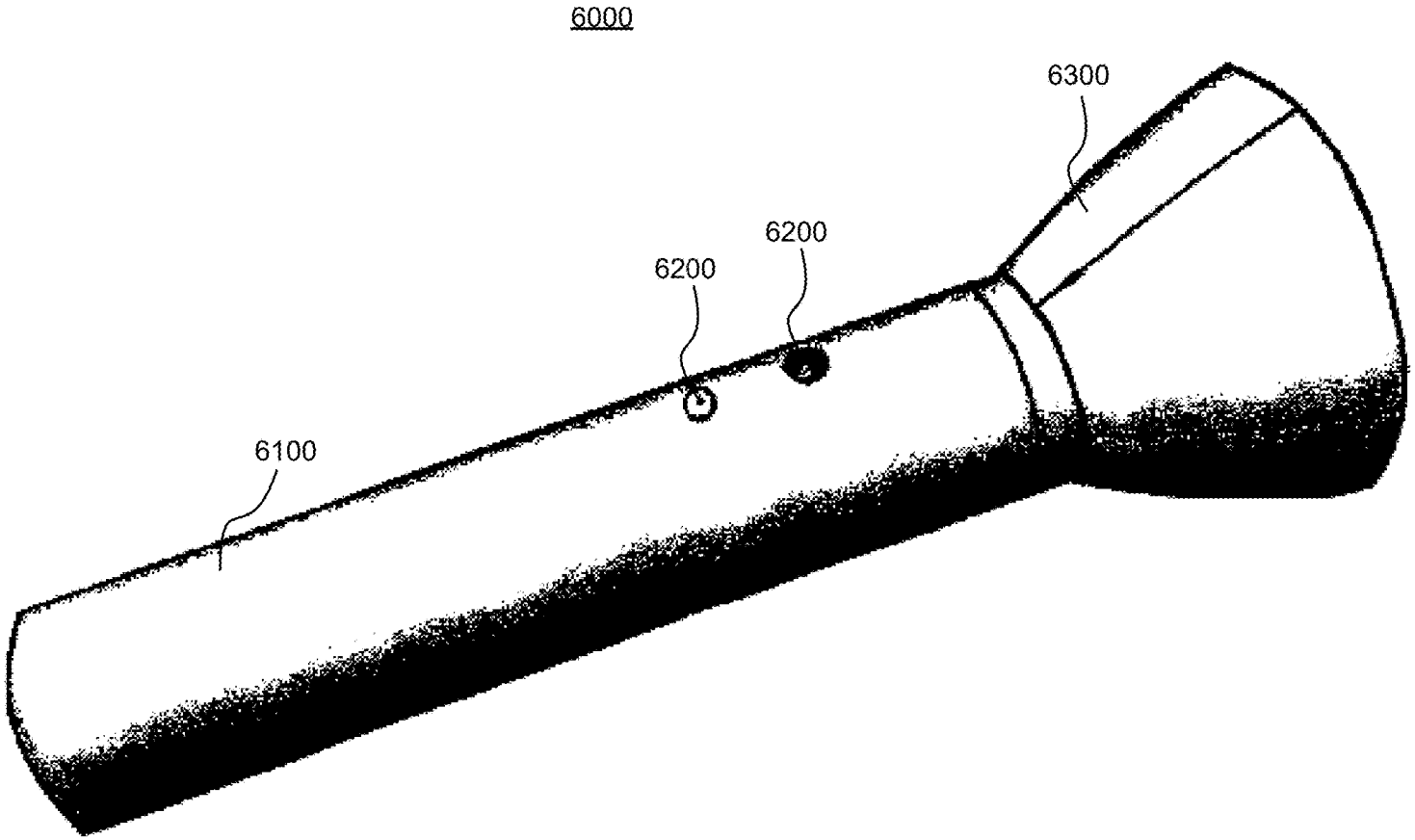
FIG. 60 shows an incapacitating apparatus with a combined parabolic reflector.

As discussed above, an incapacitator using the combined parabolic reflector, such as the incapacitator 6000 depicted in FIG. 60, may be configured to provide an automatic mixing of colors from all four light emitting areas without any additional mechanical mechanism. However, such an incapacitator may not have the square beam that may be provided by the incapacitator utilizing the CBM 380 device and a pure parabolic reflector. Note also that since the incapacitator using the combined parabolic reflector efficiently mixes and directs the colors from separate light emitting areas, incapacitating light sequences that do not rely upon spatially separated light sources being perceived by the eyes of the target may be used. For example, the 24 second light sequence of four six second intervals described above may be generated by the incapacitating apparatus 6000 depicted in FIG. 60 to achieve desired incapacitating results. Other light sequences may also be used to achieve incapacitating results.

The incapacitating apparatus 6000 depicted in FIG. 60 has primarily been described with respect to the SBM-160 device from Luminus Devices, Inc. Those skilled in the art understand that other light emitting devices may be used in accordance with the disclosure herein. For example, light emitting devices having fewer than or more than four light emitting areas or light emitting devices larger than or smaller than the SBM-160 device may be used in incapacitating apparatus. Note also that the incapacitating apparatus shown in FIG. 60 is not limited to a combined parabolic reflector with a diameter of 60 mm. Combined parabolic reflectors of different diameters or different lengths may be used to achieve desired beam forming results.

The foregoing Detailed Description of exemplary and preferred embodiments is presented for purposes of illustration and disclosure in accordance with the requirements of the law. It is not intended to be exhaustive nor to limit the invention to the precise form or forms described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom.

What is claimed is:

1. A method for incapacitation of a subject comprising:

providing four light emitting areas, wherein each light emitting area of the four light emitting areas outputs light at a different wavelength or color temperature from other light emitting areas of the four light emitting areas;

concentrating light from the four light emitting areas to produce a combined light beam;

controlling the light from the four light emitting areas to flash in a sequence of at least four separate intervals to cause the light beam to flash, wherein the at least four intervals comprise:

a first interval, wherein the first interval comprises simultaneously flashing on and off all four light emitting areas at frequencies between 11 to 17 Hz with duty cycles from 35 to 50%;

a second interval, wherein the second interval comprises simultaneously flashing on and off three light emitting areas of the four light emitting areas at frequencies between 11 to 17 Hz with duty cycles from 35 to 50% and wherein amplitudes of the three light emitting areas are controlled to obtain light of a first flashed color;

a third interval, wherein the third interval comprises simultaneously flashing on and off three light emitting areas of the four light emitting areas at frequencies between 11 to 17 Hz with duty cycles from 35 to 50% and wherein amplitudes of the three light emitting areas are controlled to obtain light of a second flashed color, wherein the second flashed color is different from the first flashed color; and a fourth interval, wherein the fourth interval comprises simultaneously flashing on and off all four light emitting areas at frequencies between 11 to 17 Hz with duty cycles from 35 to 50%; and directing the flashing light beam towards the subject.

2. The method according to claim 1, wherein the sequence has a twenty-four second duration and the first interval, second interval, third interval, and fourth interval each have a duration of six seconds.

3. The method according to claim 1, wherein the four light emitting areas comprise:

a first light emitting area emitting blue colored light in a wavelength range of about 460-470 nm;

a second light emitting area emitting green colored light in a wavelength range of about 520-530 nm;

a third light emitting area emitting red colored light in a wavelength range of about 620-630 nm; and a fourth light emitting area emitting white light, and wherein the first flashed color comprises amber-orange colored light in a wavelength range of about 580-600 nm and the second flashed color comprises cyan colored light in a wavelength range of about 485-505 nm or alternatively reversing the order of the colors.

4. The method according to claim 1 wherein one or more parameters for one or more intervals are modifiable via programming.

5. The method according to claim 2, wherein the first interval or the fourth interval or the first interval and the fourth interval have flash frequencies of about 13 Hz and duty cycles of about 50%.

6. The method according to claim 2, wherein second interval or the third interval or the second interval and the third interval have duty cycles of about 50% and flash frequencies which start at 9 Hz and increase by about 1 to 2 Hz once per second.

7. An apparatus for causing incapacitation comprising:

a handle and a head member, wherein the head member comprises:

a light emitting device comprising four light emitting areas consisting of a red light emitting area, a green light emitting area, a blue light emitting area, and a white light emitting area, and;

a light concentrating element configured to concentrate the four light emitting areas into a combined light beam;

an electronics assembly configured to control the four light emitting areas to flash the light beam in a sequence of at least four separate intervals, wherein the at least four intervals comprise:

a first interval, wherein the first interval comprises simultaneously flashing on and off all four light emitting areas at frequencies between about 11 to 17 Hz with duty cycles from about 35 to 50%;

a second interval, wherein the second interval comprises simultaneously flashing on and off three light emitting areas of the four light emitting areas at frequencies between about 11 to 17 Hz with duty cycles from about 35 to 50% and wherein amplitudes of the three light emitting areas are controlled to obtain light of a first flashed color;

a third interval, wherein the third interval comprises simultaneously flashing on and off three light emitting areas of the four light emitting areas at frequencies between about 11 to 17 Hz with duty cycles from about 35 to 50% and wherein amplitudes of the three light emitting areas are controlled to obtain light of a second flashed color, wherein the second flashed color is different from the first flashed color; and a fourth interval, wherein the fourth interval comprises simultaneously flashing on and off all four light emitting areas at frequencies between about 11 to 17 Hz with duty cycles from about 35 to 50%.

8. The apparatus according to claim 7, wherein the sequence has a twenty-four second duration and the first interval, second interval, third interval, and fourth interval each have a duration of six seconds.

9. The apparatus according to claim 7, wherein the blue light emitting area emits blue colored light in a wavelength range of about 460-470 nm, the green emitting area emits green colored light in a wavelength range of about 520-530 nm, the red light emitting area emits red colored light in a wavelength range of about 620-630 nm; and wherein the first flashed color comprises amber-orange colored light in a wavelength range of about 580-600 nm and the second flashed color comprises cyan colored light in a wavelength range of about 485-505 nm.

10. The apparatus according to claim 7, wherein the light concentrating element comprises a pure parabolic reflector or a lens or a lens and a pure parabolic reflector.

11. The apparatus according to claim 7, wherein the light emitting device comprises a high brightness light emitting diode substrate.

12. The apparatus according to claim 7, wherein the light concentrating element comprises a combined parabolic reflector.

13. The method according to claim 7 wherein parameters for the sequence are programmable.

14. The apparatus according to claim 8, wherein the first interval or the fourth interval or the first interval and the fourth interval have flash frequencies of about 13 Hz and duty cycles of about 50%.

15. The apparatus according to claim 8, wherein second interval or the third interval or the second interval and the third interval have duty cycles of about 50% and flash frequencies which start at about 9 Hz and increase by about 1 to 2 Hz once per second.

16. The apparatus according to claim 10, wherein the lens comprises an adjustable aspheric lens.

17. An apparatus for causing incapacitation comprising:

a handle configured for being held within a human hand;

a head coupled to the handle, wherein the head comprises:

a light emitting apparatus having at least two spatially separated light emitting areas, wherein each light emitting area emits light at a different wavelength;

an electronics assembly for controlling the emission of light from the light emitting apparatus; and a combined parabolic reflector disposed to receive light from the light emitting apparatus, wherein the combined parabolic reflector has at least two parabaloid conical sections and each parabaloid conical section has a curvature center aligned with a diagonal through a center of a corresponding light emitting area, whereby the light emitting areas are enabled on and off either together or separately by the electronics assembly; and wherein the light emitting apparatus comprises a light emitting diode module with four light emitting areas, and the four light emitting areas comprise: a red light emitting substrate; a blue light emitting substrate; a green light emitting substrate; and a white light emitting substrate, and the combined parabolic reflector comprises four parabaloid conical sections; and wherein the electronics assembly controls the light emitting substrates to flash in a sequence of at least four separate intervals, wherein the at least four intervals comprise:

a first interval, wherein the first interval comprises simultaneously flashing on and off all four light emitting substrates at frequencies between about 11 to 17 Hz with duty cycles from about 35 to 50%;

a second interval, wherein the second interval comprises simultaneously flashing on and off the red, blue, and green three light substrates at frequencies between about 11 to 17 Hz with duty cycles from about 35 to 50% and wherein amplitudes of the red, blue, and green light emitting substrates are controlled to obtain light of a first flashed color;

a third interval, wherein the third interval comprises simultaneously flashing on and off the red, blue, and green three light substrates at frequencies between about 11 to 17 Hz with duty cycles from about 35 to 50% and wherein amplitudes of the red, blue, and green three light substrates are controlled to obtain light of a second flashed color, wherein the second flashed color is different from the first flashed color; and a fourth interval, wherein the fourth interval comprises simultaneously flashing on and off all four light emitting substrates at frequencies between about 11 to 17 Hz with duty cycles from about 35 to 50%.

18. The apparatus according to claim 17, wherein the combined parabolic reflector has a diameter at an outer end of the reflector between about 55 and 65 mm and a length of about 45 mm.

19. The apparatus according to claim 17, wherein the electronics assembly is controllable to select between flashing of light from multiple substrates and emission of light without flashing from all substrates.

20. The apparatus according to claim 17, wherein the sequence has a twenty-four second duration and the first interval, second interval, third interval, and fourth interval each have a duration of six seconds.

21. The apparatus according to claim 17, wherein the red light emitting substrate emits light with a wavelength of about 623 nm, the blue light emitting substrate emits light with a wavelength of about 460 nm, the green light emitting substrate emits light with a wavelength of about 525 nm, and the white light emitting substrate emits light with a color temperature of about 6500K and wherein the first flashed color comprises amber-orange colored light in a wavelength range of about 580-600 nm and the second flashed color comprises cyan colored light in a wavelength range of about 485-505 nm.

22. The apparatus according to claim 17, wherein the electronics assembly is configured for controlling the emission of light via programming.

23. The apparatus according to claim 20, wherein the first interval or the fourth interval or the first interval and the fourth interval have flash frequencies of about 13 Hz and duty cycles of about 50%.

24. The apparatus according to claim 20, wherein second interval or the third interval or the second interval and the third interval have duty cycles of about 50% and flash frequencies which start at about 9 Hz and increase by about 1 to 2 Hz once per second.

25. A method for incapacitation of a subject comprising:

providing at least two light emitting areas, wherein at least one of the light emitting areas emits colored light;

flashing the light emitting areas in a pattern;

concentrating the light emitted from the light emitting areas into one or more light beams with a combined parabolic reflector, wherein the combined parabolic reflector has at least two paraboloid conical sections and each parabaloid conical section has a curvature center aligned with a diagonal through a center of a corresponding light emitting area;

directing the one or more light beams towards the subject;

wherein the at least two light emitting areas comprise four light emitting areas, and the four light emitting areas comprise: a red light emitting area; a blue light emitting area; a green light emitting area; and a white light area, and the combined parabolic reflector comprises four paraboloid conical sections;

wherein the pattern comprises a sequence of at least four separate intervals, wherein the at least four intervals comprise;

a first interval, wherein the first interval comprises simultaneously flashing on and off all four light emitting areas at frequencies between about 11 to 17 Hz with duty cycles from about 35 to 50%;

a second interval, wherein the second interval comprises simultaneously flashing on and off the red, blue, and green three light emitting areas at frequencies between about 11 to 17 Hz with duty cycles from about 35 to 50% and wherein amplitudes of the red, blue, and green light emitting areas are controlled to obtain light of a first flashed color;

a third interval, wherein the third interval comprises simultaneously flashing on and off the red, blue, and green three light areas at frequencies between about 11 to 17 Hz with duty cycles from about 35 to 50% and wherein amplitudes of the red, blue, and green three light emitting areas are controlled to obtain light of a second flashed color, wherein the second flashed color is different from the first flashed color; and a fourth interval, wherein the fourth interval comprises simultaneously flashing on and off all four light emitting areas at frequencies between about 11 to 17 Hz with duty cycles from about 35 to 50%.

26. The method according to claim 25, wherein the combined parabolic reflector has a diameter at an outer end of the reflector between about 55 and 65 mm and a length of about 45 mm.

27. The method according to claim 25, wherein the sequence has a twenty-four second duration and the first interval, second interval, third interval, and fourth interval each have a duration of six seconds.

28. The method according to claim 25, wherein the red light emitting area emits light with a wavelength of about 623 nm, the blue light emitting area emits light with a wavelength of about 460 nm, the green light emitting area emits light with a wavelength of about 525 nm, and the white light emitting area emits light with a color temperature of about 6500K to 7300K and wherein the first flashed color comprises amber-orange colored light in a wavelength range of about 580-600 nm and the second flashed color comprises cyan colored light in a wavelength range of about 485-505 nm.

29. The method according to claim 25 further comprising programming the pattern.

30. The method according to claim 27, wherein the first interval or the fourth interval or the first interval and the fourth interval have flash frequencies of about 13 Hz and duty cycles of 50%.

31. The method according to claim 27, wherein second interval or the third interval or the second interval and the third interval have duty cycles of about 50% and flash frequencies which start at about 9 Hz and increase by 2 Hz once per second.

* * * * *